United States Patent [19]

Temus et al.

[11] Patent Number: 4,952,339

[45] Date of Patent: Aug. 28, 1990

[54] DEWATERING NUCLEAR WASTES

[75] Inventors: Charles J. Temus, Puyallup; Ronald E. Burnham, Auburn; Gregory R. Allan, Redmond, all of Wash.

[73] Assignee: Nuclear Packaging, Inc., Federal Way, Wash.

[21] Appl. No.: 330,950

[22] Filed: Mar. 24, 1989

Related U.S. Application Data

[63] Continuation of Ser. No. 178,870, Mar. 25, 1988, abandoned, which is a continuation of Ser. No. 899,426, Aug. 22, 1986, abandoned, which is a continuation-in-part of Ser. No. 715,006, Mar. 22, 1985, abandoned.

[51] Int. Cl.[5] ..... G21F 9/08

[52] U.S. Cl. ..... 252/632; 210/771; 252/633

[58] Field of Search ..... 34/50, 77, 78; 210/682, 210/751, 770, 771; 252/631, 628, 626, 632, 633

[56] References Cited

U.S. PATENT DOCUMENTS

| | | | |
|---|---|---|---|
| 1,948,313 | 2/1934 | Powelson | 23/50 |
| 2,716,289 | 8/1955 | Lauck | 34/27 |
| 3,099,607 | 7/1963 | Lustenader et al. | 202/64 |
| 3,404,722 | 10/1968 | Bloore | 159/23 |
| 4,008,171 | 2/1977 | Tiepel et al. | 252/301.1 W |
| 4,040,973 | 8/1977 | Szivos et al. | 252/301.1 W |
| 4,043,050 | 8/1977 | Hancock | 34/48 |
| 4,119,560 | 10/1978 | Sheeline | 252/301.1 W |

(List continued on next page.)

FOREIGN PATENT DOCUMENTS

| | | |
|---|---|---|
| 1614497 | 8/1970 | Fed. Rep. of Germany . |
| 2006414A | 5/1979 | United Kingdom . |
| 2113902A | 8/1983 | United Kingdom . |

OTHER PUBLICATIONS

P. L. Piciulo, "Technical Considerations for High Integrity Containers for the Disposal of Radioactive Ion--Exchange Resin Waste," Brookhaven National Laboratory, Aug. 12, 1981, pp. 47-62.

(List continued on next page.)

*Primary Examiner*—Ivars Cintins

*Attorney, Agent, or Firm*—Christensen, O'Connor, Johnson & Kindness

[57] ABSTRACT

A method of predictably dewatering a slurry that contains radioactive particles to a condition for safe permanent storage. Interstitial water is removed from the slurry, and then a sufficient quantity of adsorbed water is removed from the particles so that at the permanent storage temperature the particles will be just unsaturated with respect to adsorbed water. The dewatering endpoint is set to at least unsaturate the particles at the permanent storage temperature. This minimum volume of adsorbed water removal is necessary to assure the subsequent uptake of any condensed water that develops during storage in a sealed container. An upper dewatering endpoint is preferably set so that the volume of adsorbed water removed from the particles does not excessively unsaturate the particles, so that the sealed storage container that eventually confines the dewatered particles will not burst if the particles later become exposed to ambient water or water vapor. This upper dewatering limit is both particle- and container-specific and is set to assure that any increase in particle volume, if the particular particles become further hydrated at the permanent storage temperature, will not exceed the volume of compressible gas, typically air but alternatively an inert gas, in the particular container.

Systems and apparatuses for dewatering nuclear wastes are also provided. In one embodiment, a disposable container with a top region and a bottom region is provided with a waste influent port for introducing a slurry of radioactive particles into the container bottom region and with an air inlet port for introducing relatively dry air into the container top region. A vapor collector manifold is selectively disposed in the container bottom region to draw air uniformly through the particle bed. A vapor outlet port, connected to the vapor collector manifold, is provided to remove the humidified air that has passed through the particle bed from the container.

44 Claims, 14 Drawing Sheets

U.S. PATENT DOCUMENTS

| | | | |
|---|---|---|---|
| 4,134,216 | 1/1979 | Stevens | 34/77 |
| 4,234,447 | 11/1980 | Hay, II et al. | 252/301.1 W |
| 4,234,448 | 11/1980 | Hirano et al. | 252/301.1 W |
| 4,268,409 | 5/1981 | Ga et al. | 252/301.1 W |
| 4,290,907 | 9/1981 | Horiuchi et al. | 252/301.1 W |
| 4,305,780 | 12/1981 | Black | 159/16 R |
| 4,446,063 | 5/1984 | Critchley et al. | 252/633 |
| 4,559,170 | 12/1985 | Gay et al. | 252/628 |
| 4,580,354 | 4/1986 | Lindberg | 34/50 |
| 4,656,757 | 4/1987 | Oschmann | 34/50 |

OTHER PUBLICATIONS

"Radwaste Report No. 1," Swuco, Inc., Jul. 15, 1986, pp. 22–23.

European Search Report dated Mar. 6, 1989 for European Application No. 86307775.6, Publication No. 0257159.

Published European Application No. 86302115.0, filed Mar. 21, 1986, entitled "Dewatering Nuclear Wastes". Inventors: C. J. Temus, R. E. Burnham, and G. R. Allan. Published on Oct. 8, 1986 as Publication No. 0196843.

Chemical Abstracts, vol. 82, No. 10, Mar. 10, 1975, p. 446, No. 64141x. Authors: K. Szivos, G. Lovass, L. Liptak, J. Hirling, and O. Pavlik. "Concentration at Temperatures below the Boiling Point and Storage of Liquid Radioactive Waste Materials".

Fig. 7.
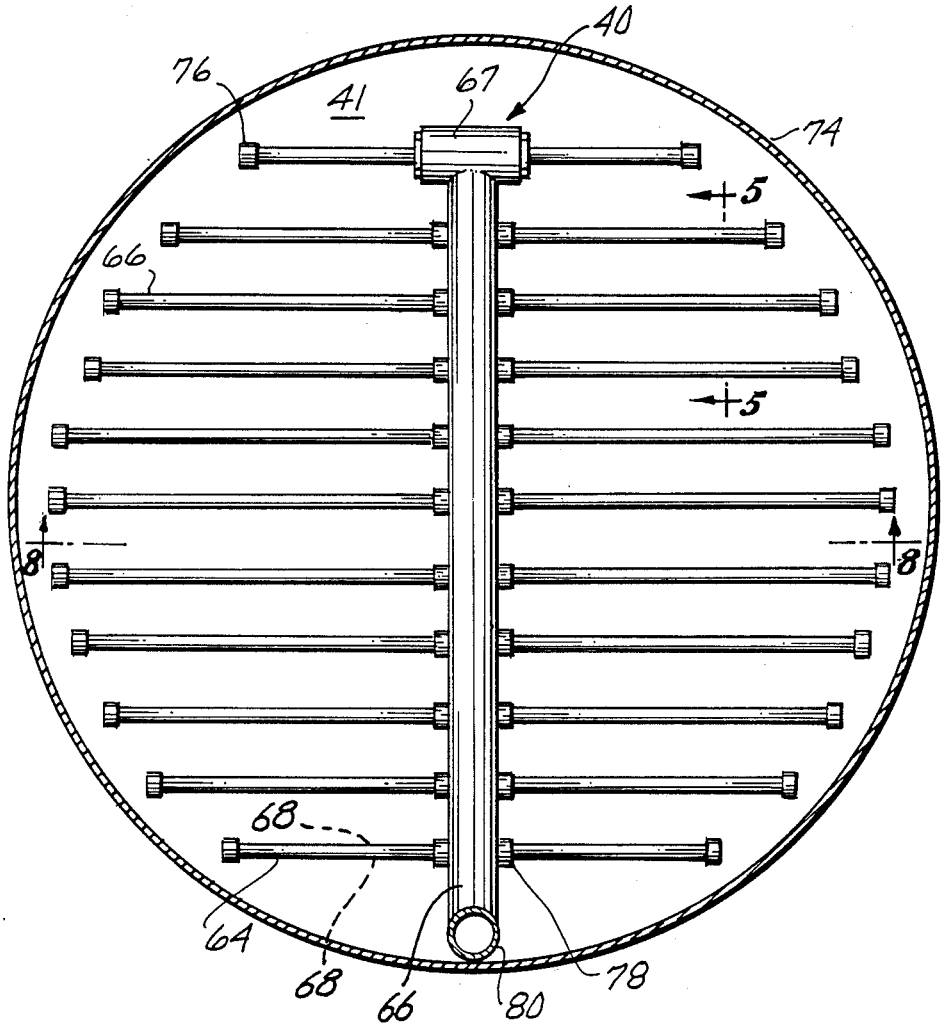
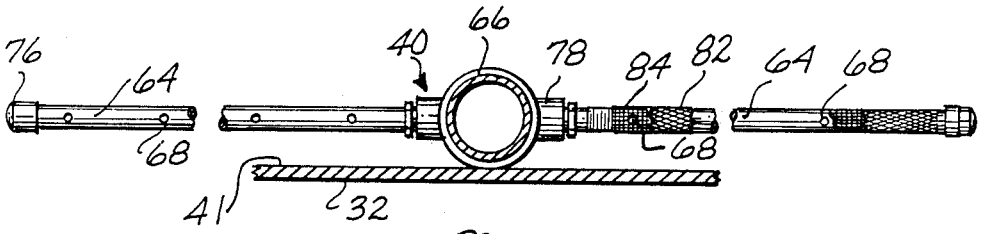
Fig. 8.

Fig. 10.
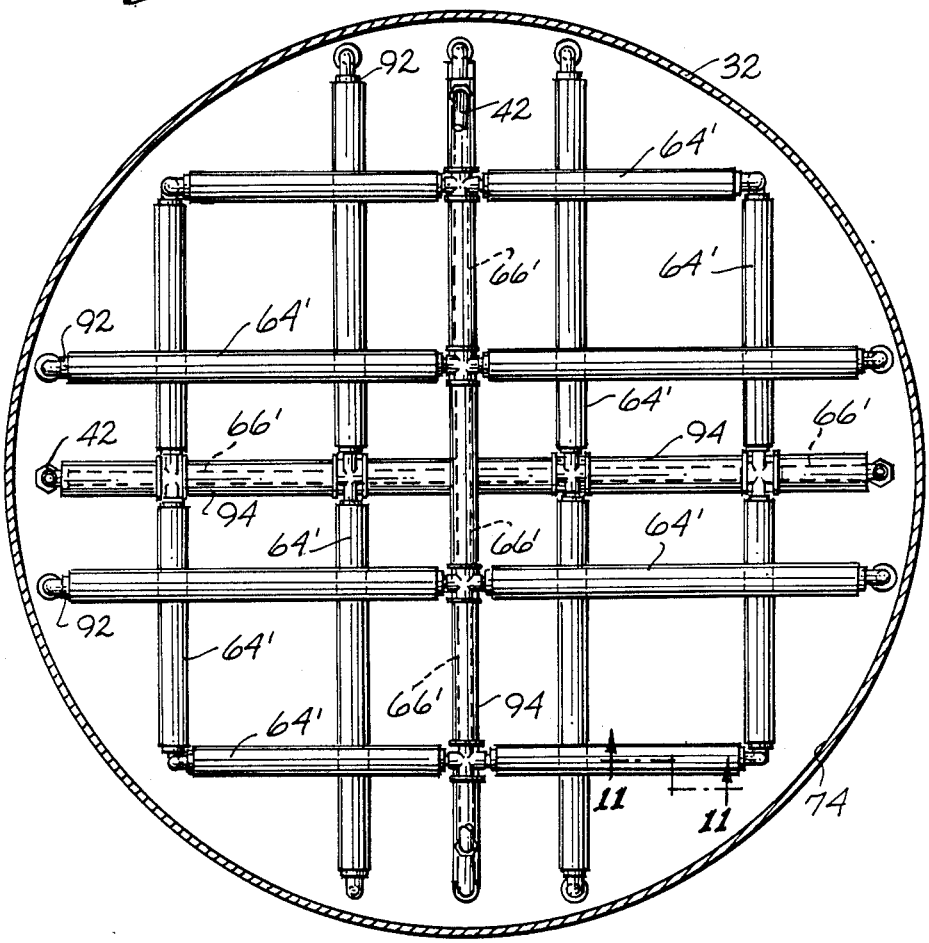
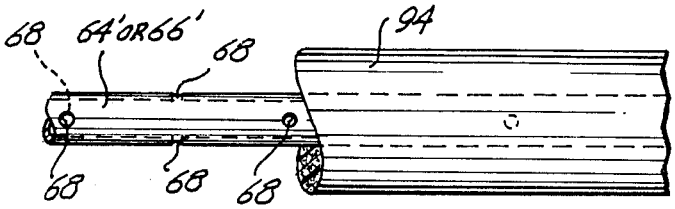
Fig. 11.

PARTICLE DIAMETER, FEET
0.0015
0.00175
0.002135
0.003
0.004
0.00125
0.001
0.0008
0.0005
0.0003
TEST CURVE
110
106
104
102
108
A
B
C
D
E
F
FLOW RATE, SCFM
LB/SEC·FT² X 10² @ STP
OPERATING PRESSURE, IN Hg
FT. OF AIR @ STP X 10⁻³

BEGINNING WASTE TEMPERATURE, °F
115
105
95
85
75
65
55
100
99
98
97
96
95
94
93
92
RELATIVE HUMIDITY ENDPOINT
118
120
122

DEWATERING NUCLEAR WASTES

This application is a continuation application based on prior copending application Ser. No. 178,870, filed on Mar. 25, 1988, which is a continuation application based on prior application Ser. No. 899,426, filed Aug. 22, 1986, which was a continuation-in-part of application Ser. No. 715,006, filed Mar. 22, 1985, all now abandoned.

TECHNICAL AREA

The present invention relates to processing wet radioactive wastes for permanent storage and particularly to dewatering radioactive liquid treatment media such as ion exchange resins, filter aid materials, zeolites, and other particulate wastes.

BACKGROUND OF THE INVENTION

The nuclear power industry generates a certain amount of wet radioactive wastes, and predominant among these radwastes are ion exchange resins and filter media that are used to scrub radioisotopes from reactor cooling and waste waters. The resulting suspensions or slurries of radioactive ion exchange resin, and in some cases filter media particles, must be dewatered for safe shipping and disposal. By dewatering is meant herein the removal of water from the waste particles such that the remaining free standing water, during long-term burial, constitutes no more than 1.0% of the waste volume. 10 C.F.R. Part 61. By free standing water is meant the drainable interstitial water that freely gravity drains from a bed of particles.

Bead-type and powdered-type ion exchange resins constitute the vast majority of the waste materials that must be dewatered. Such ion exchange resins average 3800 cubic feet per year per commercial power plant and represent nearly half of the total wet wastes generated by the utilities. Lesser amounts of activated carbon and inorganic zeolite particles from radwaste treatment systems must also be dewatered prior to disposal.

Prior to 1981, when the first large-scale dewatering containers were placed into service, the aforementioned types of wet wastes were mostly solidified by, for example, admixing them with dry cement powder in disposable steel drums. However, such solidification methods have unsolved problems, including achieving structural integrity, void spaces above the solidified block in a corrodible container, waste parts that are not fully encapsulated, and pasty or unsolidified materials. The pertinent relationships between waste media shape, size, chemical reactions, full-scale thermal effects, and waste media structure remain unsolved for the solidification of radioactive wastes in a container over the three hundred year design life of the storage regimen.

The driving factor behind the recent use of waste dewatering is economics. The availability of landfill disposal sites is clouded with political uncertainty, and the transportation costs to the few available disposal sites can be expected to increase with each new regulatory overlay. The result is the need for more waste-volume efficient methods of disposal or on-site storage, and in this regard dewatering processes are most attractive. Dewatered wastes need not undergo the volume expansion that solidification technologies require: instead of adding solid material to physically or chemically entrap or react with the water within the container, the water is removed from the container. Additionally, the dewatering process requires less plant floor space, capital investment, and no dusty, corrosive, or hazardous chemicals. The main mitigating circumstances against waste dewatering in the past have been changing regulations and operational uncertainty regarding the degree and amount of residual free standing water left in the container. Such free standing water is a potential vehicle for isotopic leaching, should the container fail or be punctured during transport, storage, or burial.

Prior to the free standing water criteria specified by the State of South Carolina in 1980, dewatering containers were simply thin gauge carbon steel liners with some cartridge filters unscientifically placed on the bottom. The 1980 free standing water criteria quickly illustrated a lack of understanding of the dewatering mechanisms because the containers, dewatering tests, and procedures changed rapidly. Bead resin containers were designed with conical bottoms and low point drains or suction configurations. A diaphragm pump was typically used to remove free standing water. Powdered resin containers were designed with several levels of cartridge filters.

It is expected that the use of resin dewatering will increase due to a number of reasons. Many plants are finding it is more cost effective to not regenerate their deep bed condensate polisher resins, and instead they directly dispose of the resins after one use. A significant increase in bead resin volumes per plant results. Bead resin volumes are also increasing due to the use of portable demineralizers in place of evaporators. The use of powdered resins is increasing due to closer attention to power plant water chemistry. Powdered ion exchange resins are increasingly being mixed with fibrous filter aids to help alleviate resin intrusion into the reactor cooling water.

Prior testing and certification procedures have been based upon representative waste media and have not considered the range of waste forms that occur in the field, nor the permanent storage conditions. Prior dewatering methods did not lend themselves to defined endpoints: the duration of the pumping cycle was simply extended until a subjective empirical endpoint, e.g., no apparent leakage from a punctured representative container, was observed. Thermodynamic considerations, such as condensing cycles within the container during transport, storage, or burial, have not previously been addressed. Nor have chemical form effects been addressed. An understanding of dewatering mechanisms leading to the production of consistent results has not been developed or achieved. In at least one case, an extrapolation of free standing water versus drainage time has been made using specific test results. This method was mathematically unsound and unrepresentative of the actual variety of waste forms. As a result, some of the liners punctured during field tests and at burial sites have been found with unacceptable amounts of free standing water. Moreover, an understanding of the interrelations between the waste characteristics and internal container piping was not developed. As a consequence, compliance with the free standing water requirements of 10 C.F.R. Part 61 for ion exchange resins and other liquid treatment media cannot be assured with prior art dewatering systems.

SUMMARY OF THE INVENTION

The invention provides a method of predictably dewatering a slurry that contains radioactive particles to a condition for safe permanent storage. Interstitial water is removed from the slurry, and then a sufficient quantity of adsorbed water is removed from the particles so that at the permanent storage temperature the particles will be just unsaturated with respect to adsorbed water. In other words, the dewatering endpoint is set to at least unsaturate the particles at the permanent storage temperature. This minimum volume of adsorbed water removal is necessary to assure the subsequent uptake of any condensed water that develops during storage in a sealed container. An upper dewatering endpoint is preferably set so that the volume of adsorbed water removed from the particles does not excessively unsaturate the particles, so that the sealed storage container that eventually confines the dewatered particles will not burst if the particles later become exposed to ambient water or water vapor. This upper dewatering limit is both particle- and container-specific and is set to assure that any increase in particle volume, if the particular particles become further hydrated at the permanent storage temperature, will not exceed the volume of compressible gas, typically air but alternatively an inert gas, in the particular container.

Liquid treatment media particles such as bead type ion exchange resins, powdered type ion exchange resins, filter aid materials, carbon particles, zeolites, filter sand, diatomaceous earth, anthracite particles, and sludges can be dewatered by the subject method, as can heterogeneous mixtures thereof. The slurry preferably includes particles ranging in diameter from about 0.1 to about 1000 microns, with an average diameter of greater than 20 microns. To unsaturate the particles at the permanent storage temperature, the volume of adsorbed water removed from the particles is at least equal to $$(Q_p/\Delta H)/\rho$$

wherein $Q_p$ is the difference in particle heat content between the dewatering temperature and the permanent storage temperature, $\Delta H$ is the average of the water heat of vaporization at the dewatering temperature and at the permanent storage temperature, and $\rho$ is the density of water. The total particle heat content, $Q_p$, available to produce condensate can be determined as follows:

$$Q_p = V_p \rho_p C_p (T_p - T_\infty)$$

wherein $V_p$ is the volume of the particles, $\rho_p$ is the density of the particles, $C_p$ is the heat capacity of the particles, $T_p$ is the temperature of the particles at the transition when substantially all interstitial water has been removed and the removal of adsorbed water commences, and $T_\infty$ is the ambient permanent storage temperature (typically 55° F. for underground disposal sites). The heat capacity of the particles, $C_p$, should be determined by considering molar fractions of the component heat capacities as follows:

$$C_p = X_{H20} C_{PH20} + X_{CHEM} C_{PCHEM} + X_{Sub} C_{PSub}$$

wherein the X terms represent the molar fractions of adsorbed water ($X_{H20}$), chemical salts ($X_{CHEM}$), and the particle substrate ($X_{Sub}$) in the particles, and the $C_p$ terms represent the heat capacities of the adsorbed water, chemical salts, and particle substrate, respectively.

A safe upper limit, in terms of volume of adsorbed water removed from the particles, is also provided for the dewatering process. By regulation the dewatered radioactive particles must be sealed in a disposable container for permanent storage lasting 300 or more years. Pursuant to this invention, the volume of adsorbed water removed from the particles should not excessively unsaturate the particles such that any swelling of the particles - should the container become breached during handling or storage, exposing the particles to ambient water or water vapor—will not exceed the volume of compressible gas provided in the disposal container.

The disclosed dewatering endpoints are applicable no matter how the removal of adsorbed water from the particles is effected. The subject method is illustrated by way of an embodiment in which the adsorbed water is evaporated by contacting the particles with low humidity air. The free standing component of the interstitial water is first pumped from the slurry, and then low humidity air is passed through the resulting particle bed to remove substantially all of the remaining interstitial water. The adsorbed water is preferably removed using a circulating air system. During this drying stage, low humidity air is passed uniformly through the particle bed. The air is humidified as it passes through the particle bed and removes adsorbed water from the particles. The air is thereafter dried, dehumidified, and circulated through the particle bed until the requisite volume of adsorbed water is removed from the particles.

The requisite container- and/or particle-specific endpoints can be monitored by measuring the volume of water separated from the circulating airstream once the drying stage has commenced. Preferably the volume of adsorbed water removed from the particle bed is monitored by measuring the relative humidity of the air exiting the particle bed, and particle-specific relative humidity endpoints are disclosed for that purpose. For a particular particle composition and container packing configuration the requisite dewatering upper limit can be achieved by setting the relative humidity endpoint (% R.H.$_2$) within the following constraints:

$$F_f = (\%\ \text{R.H.}_1 - \%\ \text{R.H.}_2)(1 - F_f)/(1.394 \times 62.36)$$

wherein $F_f$ represents the volume fraction of compressible gas in the container, % R.H.$_1$ is the defined relative humidity endpoint sufficient to just unsaturate the particles at the permanent storage temperature, % R.H.$_2$ is the operational dewatering endpoint designed to prevent burst containers, and the constant ($1.394 \times 62.36$) encompasses the swellable ion exchange resins of interest.

The particles can be dewatered to the requisite endpoint prior to transfer into a disposal container. Significant advantages are achieved by performing at least the drying stage (and preferably also the removal of interstitial water) within the disposal container. However, to operationally achieve the requisite endpoint the particles must be uniformly dewatered within the disposable container. The invention provides a system includes a vapor distributor for that purpose. The circulating stream of air or other drying gas can be directed through the particle bed and into the vapor distributor, or vice versa. The system performance and configuration of the disclosed vapor distributors are also prescribed in a particle- and container-specific manner in order to achieve uniform fluid flow through the container contents. For granular particles varying in diameter from about 150 to about 1000 microns, uniform airflow is used to dry the particles once the interstitial water has been substantially removed. For powdered particles varying in diameter from about 0.1 to about 150 microns, uniform water flow is used to remove substantially all interstitial water from the particles, and the water volume removed thereafter through the collector(s) is monitored to achieve the requisite dewatering endpoint. These embodiments of the subject method are precisely defined in terms of the operational parameters necessary to achieve the uniform gas or liquid flow through the respective particle beds.

Another advantage of the uniform airflow is that significant packing of the particles occurs within the container. At least some of the resulting container capacity can be utilized to advantage. For inelastic particles such as zeolites, additional radioactive particles can be introduced to substantially fill the disposal container prior to, during, or after the drying stage. For example, after moving substantially all free-standing water from the slurry to form a particle bed, and causing a low humidity gas to pass through the particle bed to remove at least some of the remaining interstitial water from the particle bed, additional radioactive particles may be introduced to fill the container top region, the introduced particles being either saturated or unsaturated with respect to adsorbed water at the storage temperature. Thereafter, substantially all interstitial water is removed from the particle bed. If introduced subsequent to the defined drying stage, the introduced particles must also be at least unsaturated with respect to adsorbed water at the permanent storage temperature. Shrinkable/swellable particles such as ion exchange resins will, in addition, undergo some volume reduction as they are dried to the point of being just unsaturated at the permanent storage temperature, particularly when the particle temperature at the commencement of the drying stage is significantly higher than the permanent storage temperature. In such circumstances, the particles dewatered within the container and any additional particles introduced therafter must not be excessively unsaturated, as defined above, and so the dewatering upper endpoint and the volume of container freeboard must be selected in concert to assure safe disposal.

In an alternative embodiment, many of the above advantages are achieved by simply bringing the slurry containing radioactive particles to or just below the permanent storage temperature prior to removing substantially all interstitial water from the slurry. Given a typical six-foot disposal container with one-half inch freeboard, the just unsaturated endpoint can be achieved by dropping the slurry temperature to no more than 4 to 5 degrees below the 55° F. permanent storage temperature prior to pumping, draining, or blowing out the interstitial water.

Systems and apparatuses for dewatering nuclear wastes are also provided. In one embodiment, a disposable container with a top region and a bottom region is provided with a waste influent port for introducing a slurry of radioactive particles into the container bottom region and with an air inlet port for introducing relatively dry air into the container top region. A vapor collector manifold is selectively disposed in the container bottom region to draw air uniformly through the particle bed. A vapor outlet port, connected to the vapor collector manifold, is provided to remove the humidified air that has passed through the particle bed from the container.

BRIEF DESCRIPTION OF THE DRAWINGS

FIG. 7 is a section taken along section line 7—7 in FIG. 6;

FIG. 8 is a section taken along section line 8—8 in FIG. 7;

FIG. 10 is a section taken along section lines 10—10 in FIG. 9;

FIG. 11 is a partially cutaway view taken along section line 11—11 in FIG. 10;

DETAILED DESCRIPTION OF THE PREFERRED EMBODIMENTS

Figure 1:
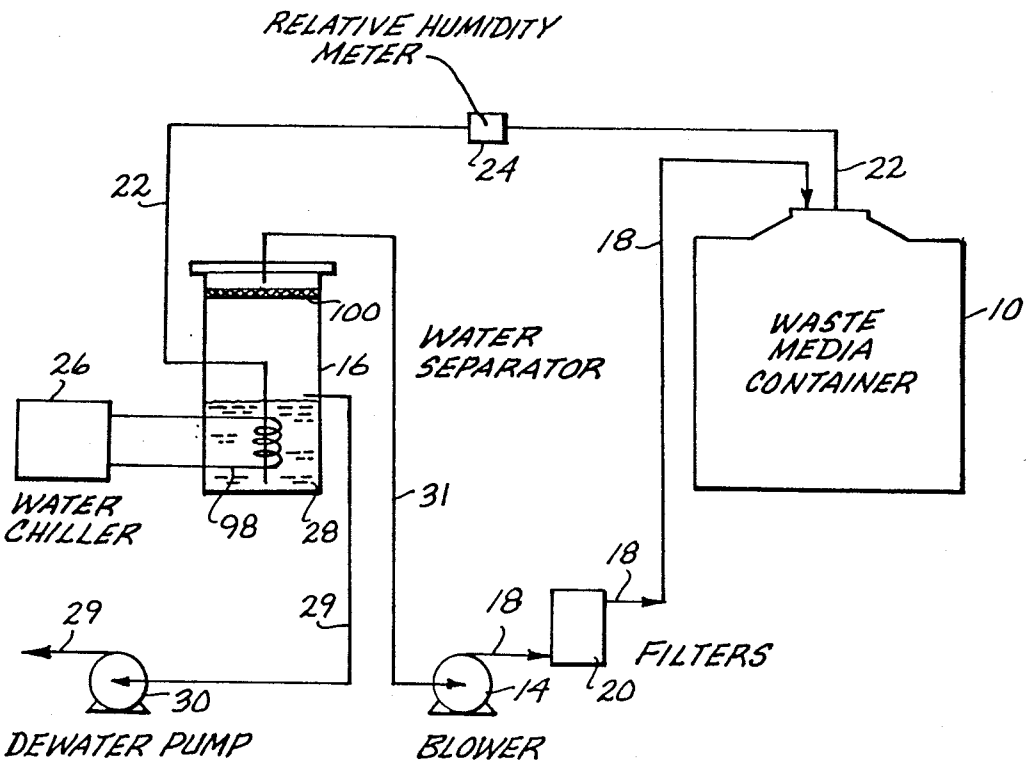
FIG. 1 is a schematic diagram showing a preferred embodiment of the dewatering system of the present invention that employs a recirculating airstream.

Referring to FIG. 1, the dewatering process of the present invention preferably incorporates a circulating air system. In this representative embodiment, a disposable container 10 is provided for dewatering a slurry of radioactive particles to a condition for permanent storage. Air is continuously circulated in a loop from a blower 14, to and through the container 10 that houses the radioactive particles, through a water separator 16, and back to the blower 14.

The blower 14 supplies air at a temperature selected to facilitate drying of the radioactive particles in the container 10. The blower 14 is the source of heat input to the circulating air. The blower's transmitted heat necessarily follows from its work of pulling a suction on the container 10 and then compressing the air. The heat of compression transmitted to the air is used to benefit since the air entering the blower 14 is water saturated, having been cooled to the dewpoint in the water separator 16. The blower 14 heats the airstream and thereby dehumidifies and raises its water carrying capacity. The blower 14 is equipped with temperature instrumentation, not shown, so that the blower 14 will shut down automatically at high temperatures. This automatic shutoff is provided because the polymers that may be used in and within the container 10 will lose their integrity at high temperatures, e.g., above 170° F. for polyethylene. Also, anion resins will tend to degrade at temperatures above 170° F., e.g., at 200° F. for several hours. Furthermore, duplex steels that may be used in the container 10 tend to lose their corrosion resistance at temperatures above 170° F.

Heated, dehumidified air is discharged from the blower 14 through a conduit 18 to a filter 20 and thence through another conduit 18 into the container 10. The filter 20 includes a series of oil separators, not shown, that remove any oil that was injected into the dehumidified airstream by the blower 14. The filter 20 is provided because oil is incompatible with polyethylene and other polymers that may be used in the container 10.

The container 10 contains an apparatus, described in detail below, for causing the airstream to pass uniformly through the slurry. The air is humidified as it passes through and removes water from the slurry. The humidified air is exhausted from the container 10 and circulated via conduit 22 through a relative humidity meter 24 to the water separator 16. A water chiller 26 associated with the water separator 16 cools the humidified airstream as it passes through the water separator 16. Water 28 that condenses from the chilled air is removed from the water separator 16 via conduit 29 by a dewater pump 30. The dried air that leaves the water separator 16 is drawn through conduit 31 into the blower 14, heated and thereby dehumidified, and recirculated through the bead resin container 10. When the meter 24 indicates that the relative humidity of the airstream leaving the container 10 has fallen to a preselected value (or another quantifiable process endpoint has been achieved as described below), the blower 14, dewater pump 30, and water chiller 26 are shut down. The container 10 is then sealed for transport and permanent disposal.

Figure 2:
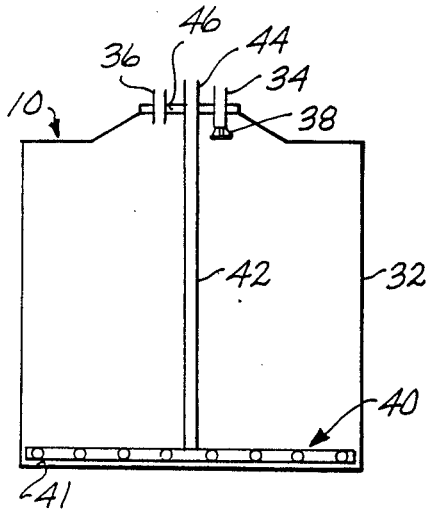
FIG. 2 is a schematic vertical section through a flat-bottomed disposable container showing the disposition of a dewatering apparatus suitable for dewatering bead type ion exchange resins.

Referring now to FIG. 2, a suitable disposable container 10 can be a disposable drum that has an outer shell 32 made of any conventional material. A waste influent port 34 is provided for introducing the wet radioactive particles into the container 10. A deflection plate 38 provides distribution. An air inlet port 36 is provided for introducing air from the blower 14, not shown in this view, into the top of the container 10. Uniform airflow across the top of the slurry bed can be facilitated by providing a deflection plate (not shown) at the delivery end of the air inlet port 36. A vapor collector manifold 40 is selectively disposed on the flat bottom 41 of the container 10. The vapor collector manifold 40 is connected by a duct 42 to a vapor outlet port 44. The waste influent port 34, air inlet port 36, and vapor outlet port 44 are preferably grouped together in a dewatering fill head 46 that can be reversibly inserted into the top of the container 10 to temporarily seal the container, and thereby facilitate the containment of radioactive particulates, during the dewatering process. The dewatering fill head 46 is removed and the duct 42 is uncoupled after dewatering is accomplished. The container 10 is then permanently sealed.

Figure 3:
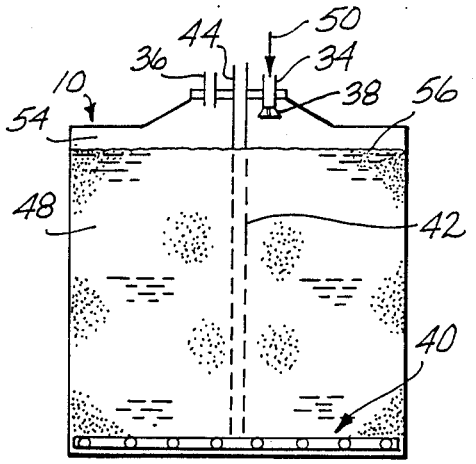
FIG. 3 is a view similar to FIG. 2, indicating the inflow of wet radioactive particles into the container.

Referring to FIG. 3, a sufficient volume of the radioactive waste media slurry 48 is introduced through the waste influent port 34, as indicated by arrow 50, to surround and cover the vapor collector manifold 40 at the bottom of the container 10. The bottom region of the container 10 can be almost completely filled with the slurry 48, leaving only an air space 54 in the top region of the container 10 sufficient for the air inlet port 36 to distribute pressurized air over the upper surface 56 of the slurry bed 48. The dewater pump 30 is then turned on, and the bulk of the free standing water is aspirated through the vapor collector manifold 40, duct 42, vapor outlet port 44, and thence to the dewater pump 30 as shown in FIG. 1. Thereafter the particle bed 48 is air dried in accordance with this disclosure.

Figure 4:
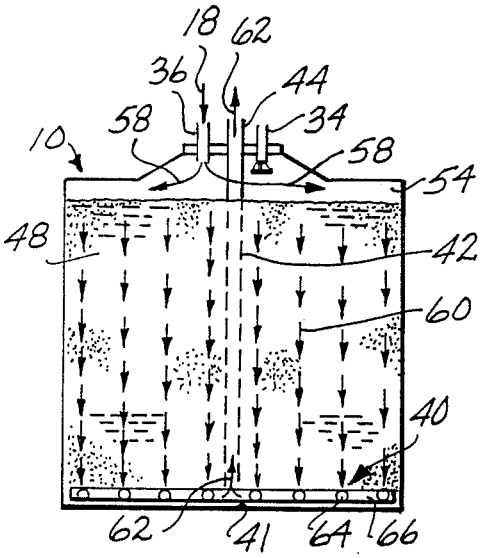
FIG. 4 is a view similar to FIG. 2, showing the circulation of air into the container, through the particle bed, into the vapor collector manifold, and out of the container.
Figure 5:
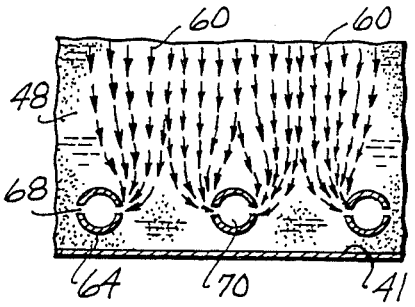
FIG. 5 is a sectional view taken along section line 5—5 in FIG. 8.

Referring to FIGS. 4 and 5, the circulation of air through the particle bed 48 should be uniform across the entire cross section of the container 10. Dehumidified air from the blower 14 (see FIG. 1) is discharged through the air inlet port 36 into the air space 54. A deflection plate on the delivery end of the air inlet port 36 can serve to radially distribute the incoming air, indicated by arrows 58, over the upper surface 56 of the waste media bed 48. The distributed air passes from the air space 54 through the particle bed 48 along paths generally indicated by arrows 60 and thence into the vapor collector manifold 40. The percolating air 60 is humidified as the slurry 48 gives up its interstitial and adsorbed waters to the relatively dry air 60. The now humidified air, indicated by arrows 62, is collected by the vapor collector manifold 40 and discharged via duct 42 through the vapor outlet port 44. A respresentative vapor collector manifold 40, as described below, has a plurality of conduits 64 that radiate in a planar fashion from a header 66 positioned diametrically across the floor 41 of the container 10. Air 60 passes from the waste media bed 48 into the vapor collector manifold 40 through a plurality of orifices 68 spaced along the lengths of the conduits 64. Freestanding water and water vapor are drawn through the orifices 68, into the channels 70 of the conduits 64, into the header 66, through a vertical duct 42 and thence through the vapor outlet port 44. The vapor collector manifold 40 is designed, as described below, so that when the waste media bed 48 is completely free of free standing water the flow of air 60 through the bed 48 will be uniform across the entire cross section of the container 10. If the airflow 60 is not uniform, pockets of interstitial water potentially remain in any region of the resin bed 48 that is not subjected to the airflow 60. The uniform airflow 60 must also have sufficient driving force to cause migration of the interstitial water to the container floor 41.

Figure 6:
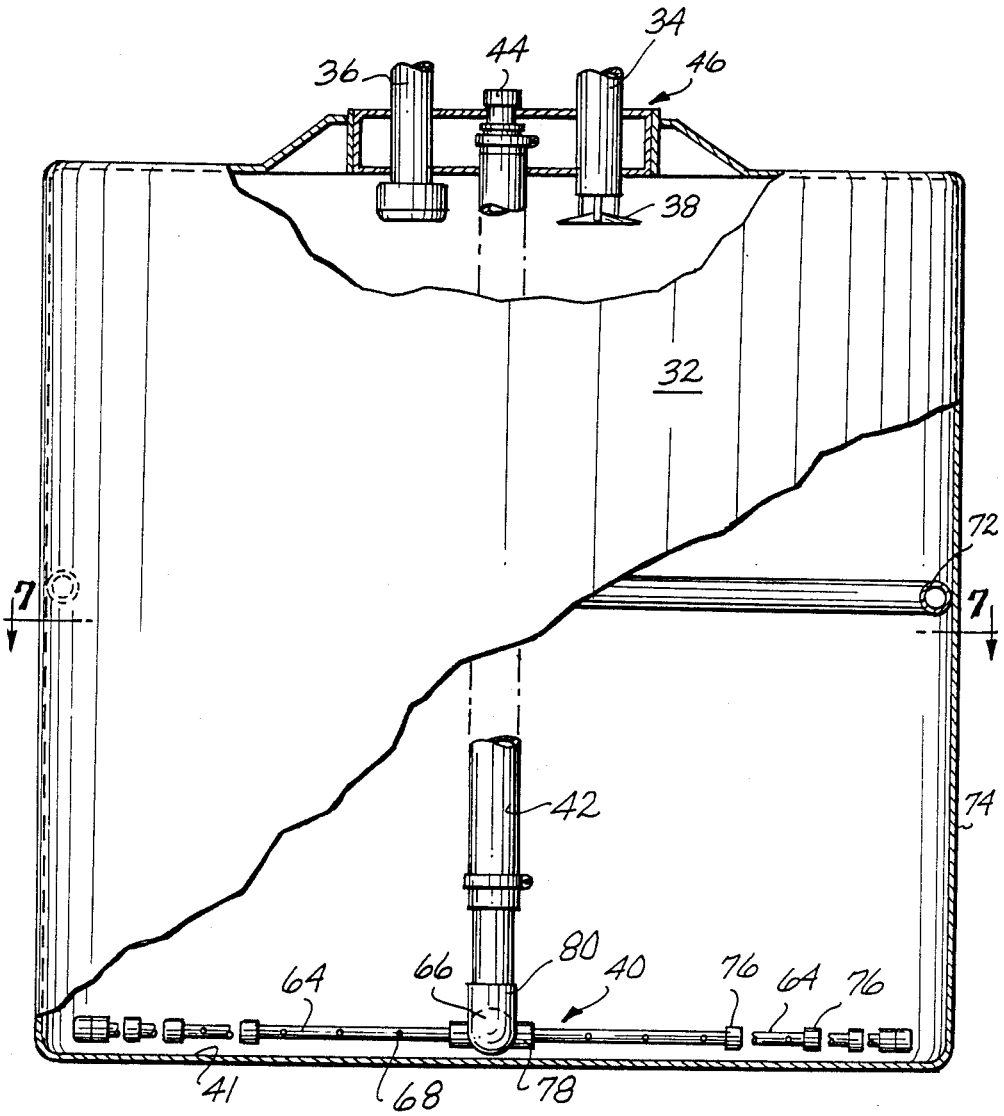
FIG. 6 is a detailed elevation view in partial cross section similar to FIG. 2 showing a disposable container fitted with a vapor collector manifold suitable for dewatering bead-type ion exchange resins.
Figure 12:
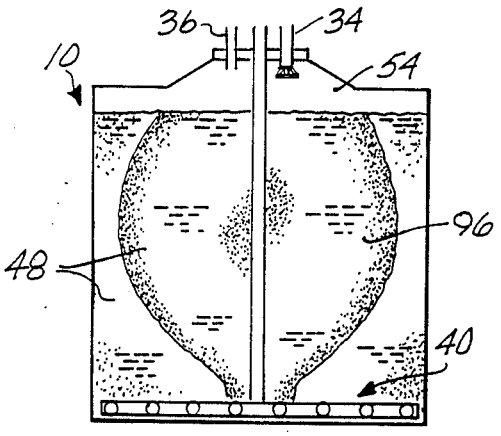
FIG. 12 is a view similar to FIG. 3, showing undesirable air channeling down the inner sidewalls of the container.

Referring now to FIG. 6, a flow interrupter 72 such as an annular ring is preferably mounted approximately midway down the inner sidewall 74 of container 10 in order to deflect into the media bed any airstream that preferentially channels down the sidewalls 74. If such an annular ring 72 is not provided the airstream will tend not to flow uniformly across the entire cross section of the resin bed 48, and a central pocket of interstitial water 96 may not be subjected to the drying airstream; (see FIG. 12).

Referring now to FIGS. 6 and 7, a suitable vapor collector manifold 40 for drying bead-type resins, zeolites, and other water-holding particles can have a central header 66 with a plurality of laterally offset conduits 64 disposed in planar array and resting on the floor 41 of the container 10. Suitable conduits 64 can be made of three-quarter inch plastic pipe that has been through-drilled to provide suitably sized orifices 68 at appropriate intervals, as described below, along both sides of each conduit 64. The distal end of each conduit 64 that lies adjacent to the container sidewall 74 is sealed with an end cap or plug 76. The other end of each conduit 64 communicates through a cross or tee fitting 78 with the header 66, which can suitably be made of three inch plastic pipe. One end 67 of the header 66 is sealed, and the other end communicates through an elbow 80 with a duct 42, which can be a flexible plastic tube, that leads to the vapor outlet port 44.

The vapor collector manifold 40 should be configured so that its orifices 68 are distributed in uniformly spaced array across the floor 41 of the bead resin container 10. The orifices 68 must be properly sized to achieve specific flow to pressure drop relationships with itself and the flow and pressure drop of the fluid in the pipes. Each vapor collector manifold 40 design has unique maximum and minimum distribution characteristics corresponding to specific maximum and minimum flow rates for specific types of waste medias as described below. During the initial stages of the dewatering process the vapor collector manifold 40 acts in an analogous fashion to the sump pumps of the prior art to remove free standing water from the slurry bed 48. Thereafter, the vapor collector manifold 40 serves to draw motive air 60 uniformly across the entire cross section of the resin bed 48 to remove any remaining unadsorbed, interstitial water. In the preferred embodiment the dewatering process is thereafter continued with dry air until a sufficient volume of adsorbed water is removed from the waste media so that the media bed will act as a desiccant at the permanent storage temperature. Most preferably, the endpoint of the dewatering process is selected to just unsaturate the particles with respect to absorbed water, as described below.

Referring to FIG. 8, the orifices 68 in the conduits 64 should be screened so that they will not become obstructed. Concentrically disposed screening members, for example, a coarse screen member 82 surrounding a fine screen member 84 of 100-mesh screen, are preferably wrapped around the conduits 64 to prevent occlusion of the orifices 68 by resin beads and other waste particles.

Figure 9:
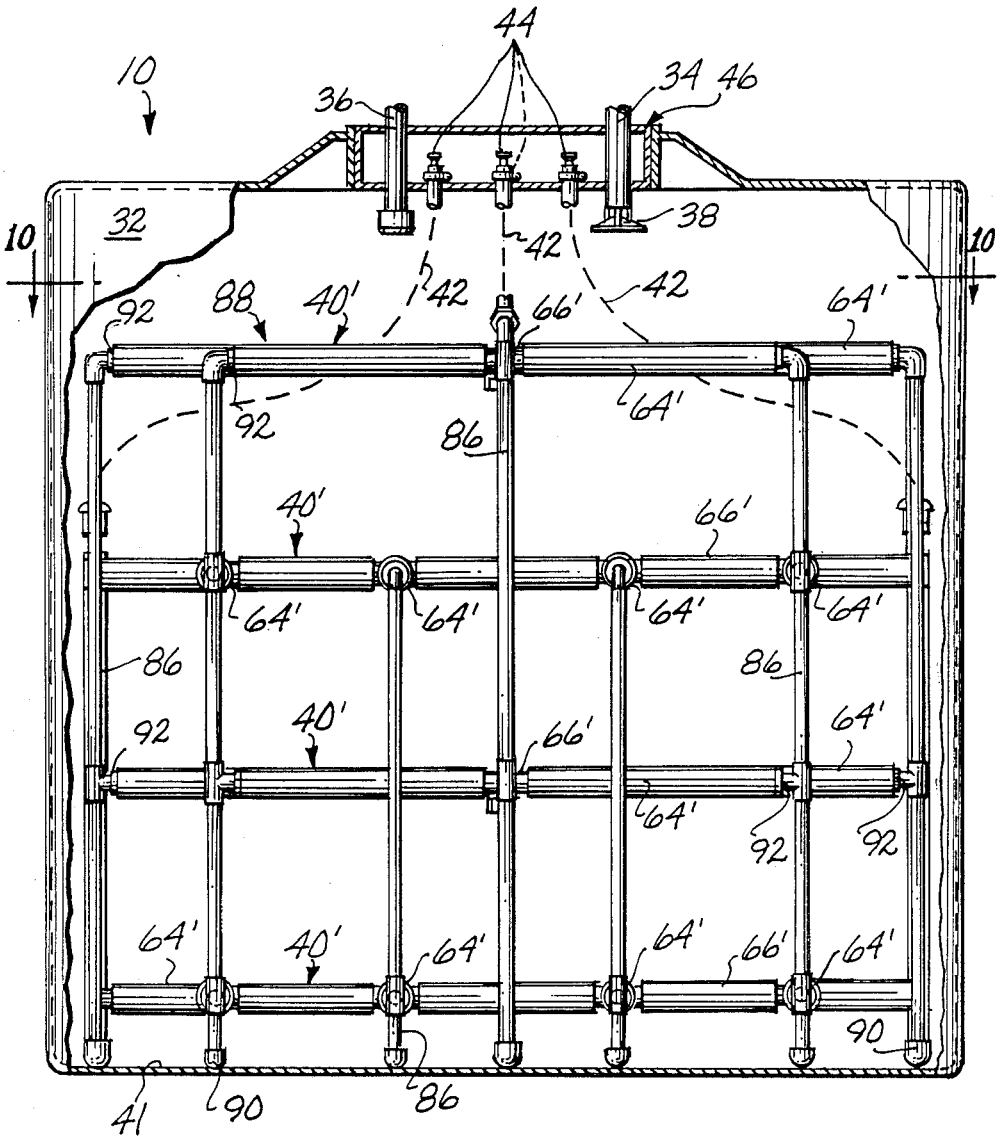
FIG. 9 is an elevation view in partial cross section of a disposable container showing the arrangement and disposition of a vapor collector assembly suitable for dewatering powdered-type ion exchange resins.

Referring now to FIG. 9, a container 10 for dewatering powdered resins and filter media must be provided with a tiered series of vapor collector manifolds 40' positioned one about the other in spaced horizontal array throughout the container bottom region. As described below, the number of vertically spaced vapor collector manifolds 40' is dependent on the required fluid pulling distance through the waste media. As the bed depth over the collector manifold 40' increases the total pressure differential across the bed also increases. Pulling nearly a full vacuum is the limiting situation before another collector manifold 40' would be required. Several tiers of vapor collector manifolds 40' can be interconnected by vertical supporting members 86 to form a self-supported vapor collector assembly 88 within the container 10. The vertical supports 86 can be made of three-quarter inch or one and one-half inch plastic pipes fitted with bottom caps 90 to prevent scoring the container floor 41. The shape and outer shell 32 construction of the powdered media container 10 can be essentially as described above. A plurality of vapor outlet ports 44, one for each of the several vapor collector manifolds 40', are provided in the dewatering fill head 46. In this embodiment four vapor collector manifolds 40' are positioned in tiered horizontal array within the container 10, one manifold 40' near the container floor 41 and the remaining three manifolds 40' at approximately equally spaced horizontal levels within the container bottom region. Each of the vapor collector manifolds 40' is an independent system of ducts that has a central header 66' with a plurality of laterally offset conduits 64'. The distal end of each conduit 64' is sealed by a plug 92 where it attaches to a vertical supporting member 86. One end of each header 66' is likewise sealed; the other end communicates with a duct 42 that leads to one of the vapor outlet ports 44. The conduits 64' and also the headers 66' have a multiplicity of spaced orifices, not shown in this view. The conduits 64' and headers 66' are wrapped with a filtering member 94 (shown in FIG. 11) that prevents the orifices from becoming occluded by fine waste particles. Humidified air is drawn through the filters 94 and orifices into and through conduits 64' and header 66', through a duct 42, and thence through a vapor outlet port 44.

Referring now to FIGS. 9 and 10, the alignments of the headers 66' and laterals 64' of the several vapor collector manifolds 40' are preferably offset by 90° in alternating tiers of the vapor collector assembly 88. Thus, in this embodiment the diagonal axis defined by the header 66' of each of the first, counting from top to bottom, and third vapor collector manifolds 40' is disposed perpendicularly with respect to the diagonal axes of the second and fourth vapor collector manifolds 40' in the vapor collector assembly 88. The offsetting alignments of the vapor collector manifolds 40' at successive tiers within the container bottom region facilitates uniform dewatering by minimizing cracking in the powdered media bed.

In operation, the bottom container region is filled with powdered media slurry through the waste influent port 34 so that the vapor collector assembly 88 is surrounded and covered by the slurry. A high water level is initially maintained in the container 10. As powdered media slurry is introduced into the container 10 excess water is removed via suction applied to the topmost collector manifold 40' by the dewater pump 30. When the container 10 is apparently full of solids the slurry feed is stopped. The bulk water is pumped out using the dewater pump 30 utilizing all of the vapor collector manifolds 40' in the container 10. As the system suction drops to a predetermined point the topmost collector 40' is shut off and suction is continued on the remaining collectors 40'. The next lower collector 40' is also shut off at a predetermined pressure, and so on until only the bottom collector 40' remains functioning. At the beginning of the water removal the powdered media will tend to shrink, and small amounts of slurry may be added to make up the volume. After the bulk water is removed and the suction pressure on the lowermost collector 40' drops to a predetermined level, then all collectors 40' are opened and the blower 14 is started. More of the interstitial water is quickly removed and the drying process begins. When nearly all of the interstitial water is removed the powdered media will begin to crack and slough away from the container sidewall 74 and vapor collector assembly 88. The air passing through these cracks removes water from the adjacent media. The entire process is stopped when the predetermined endpoint is reached.

Referring to FIG. 11, the conduits 64' and also the headers 66' are preferably through-drilled at suitable intervals to produce alternating side-to-side and top-to-bottom orifices 68. The conduits 64' and header 66' are wrapped with one micron filtering members 94 to prevent powdered media particles from occluding or passing through the orifices 68.

This dewatering system will meet or exceed all established free standing water criteria for shipment and disposal of radioactive ion exchange resins. More specifically, this dewatering system has been designed and tested to consistently meet the free standing water requirements of 10 C.F.R. Part 61 for ion exchange resins and other liquid treatment media. Predictable performance results are achieved using this system over the broad spectrum of waste characteristics possible with ion exchange resins and other liquid treatment media. Other current dewatering systems do not consistently meet these requirements.

This invention provides a method and apparatus for dewatering many types of particulate waste forms, including bead type ion exchange resins from sources such as deep bed condensate systems, radwaste treatment, borated water control, reactor water cleanup, and fuel pool cleaning. Powdered ion exchange resins (e.g., POWDEX) can also be dewatered with this system, as can filter aids such as those sold under the trademarks CELITE and FIBRA-CEL. Moreover, other liquid treatment media such as activated carbon particles, inorganic zeolites, filter sand, anthracite particles, and odd forms of ionic exchange resins that may occur from one-time site jobs can be dewatered using this method and apparatus. Furthermore, powdered mixtures of ion exchange resins, activated carbon particles, and filter aids (e.g., EPIFLOC, ENVIROSORB, and ECODEX) from condensate polishers and radwaste treatment systems can be dewatered in accordance with this disclosure, as can sludges from sump or pool bottoms, decon scale, and abrasive cleaners. By sludges is meant the heterogeneous particulate mixtures that settle out in receiving tanks, sumps, and other low velocity flow regions. All of the aforementioned liquid treatment media, as well as other particles whose physical properties meet the parameters described with respect to the computational models and test data disclosed below, can be dewatered using the method and apparatus of the present invention.

Some definitions are necessary for an understanding of the present dewatering method:

Interstitial water is the water that surrounds the particles in the void space of the particle bed.

Free standing water is the interstitial water that freely gravity drains from a bed of particles.

Adsorbed water includes the water bound, e.g., by chemical solvation or by weak charge interactions, to the surfaces of particles such as ion exchange resins, inorganic zeolites, and other medias with chemically reactive surfaces. For the purposes of this disclosure, the term adsorbed water also refers to the water held by pore diffusion within micropores in particles such as activated carbon particles.

Water vapor is the gaseous phase of water.

The method of the present invention applies a unique two-part approach to dewater particulate radwastes. Both fluid dynamic and thermodynamic analyses are applied to define operating parameters and endpoints of the dewatering process. The fluid dynamic methods apply to either, or both, liquid and gaseous water and air. Fluid dynamics does not apply to adsorbed water until the adsorbed water has been thermodynamically separated (evaporated) from the particles, except that air should be distributed uniformly through the media bed during the drying stage. Fluid dynamics applies to the various types of water as follows: The free standing water is simply pumped down, as it easily drains down from the particles. The interstitial water, which may be slowly draining or stuck up in the particles, is brought down by applying sufficient differential pressure of uniformly flowing air. At this point there is a two phase (gas and liquid) flow of air and water. Once the interstitial water has been substantially removed, then the adsorbed water begins to evaporate into the heated (dehumidified) airstream. The heated air is uniformly distributed through the particle bed pursuant to the fluid dynamic methodology of this invention.

Thermodynamics only applies to adsorbed water and water vapor. The thermodynamic applications can be considered in two parts: First, the mechanical system involving air and its capacity to transport water vapor through each part of the system must be considered with respect to fundamental mechanical heat input, heat transfer, and psychrometry. Then the chemical thermodynamics of the adsorbed water as it applies to various types of ion exchange resins and other media, and their varied chemistries, must be considered in order to determine the degree of particle drying required to meet the burial environment's free standing water criteria; in other words, finding the drying endpoint. The two parts interact where the humidity of the airstream is in equilibrium with the adsorbed water of the resin. A measurement of the air humidity flowing through a known resin type is a direct measure of that resin's water uptake capacity.

The actual physical characteristics of the waste media must be addressed in order to properly dewater waste treatment media. An overwhelming percentage of the wet wastes currently generated from nuclear reactors are bead and powdered ion exchange resins. These resin types are each relatively homogeneous when they are new. New resins have the following characteristics:

TABLE 1

| | Bead Type | Powdered Type |
|---|---|---|
| Particle Size, inches | 0.01–0.04 | 0.0013–0.0018 |
| Average Size, inches | 0.02 | 0.0015 |
| Average Shape | Nearly Spherical | Slivers |
| Moisture Content | 42–55% | 42–55% |

However, liquid treatment media may be subjected to forces that cause significant physical alteration during use, depending upon the system design and operation of a particular powerplant. For example, the ion exchange resin from a reactor coolant cleaning system can be in a much different condition than the same type of resin from a condensate polisher. Also, one waste type can be admixed with another significantly different type, for example, a combination of bead resins with powdered resins, thereby drastically changing the average effective size and shape of the waste particles to be dewatered. As another example, the transfer of waste media through high fluid shear pumps, long lengths of pipe, or tight fittings can considerably reduce the effective particle size and shape because of particle breakage. A change in the waste holdup tank, or a sump or pool draw point, can also change the waste characteristics. If the draw on a waste hold tank is switched from the side to the bottom, then finer settled particles could be introduced into the dewatering apparatus, thereby significantly altering the waste's dewatering characteristics. Chemical effects on the waste media can also seriously hinder the dewatering characteristics. For example, a powdered or bead-type ion exchange resin that has been severly decrosslinked from repeated regenerations or exposure to oxidizing decontamination solutions has extremely reduced structural properties. After such decrosslinking, the strength of bead resins can deteriorate from being able to bear the weight of a person to being easily crushable with one's fingers. Any such decrease in the structural strength of the resin particles must be considered because resin crushed under the weight of a six-foot deep solids bed could effectively block the passage of free standing water into the vapor collector manifold.

Considering the potential damaging effects resulting from the aforementioned plant operations, the on-site condition of the waste media can be significantly different from the ideal values of Table 1. By combining a knowledge of the standard fines content in new resins with an estimate of the fines generation rate from normal operations and from potential abberational operations, worst case scenarios can be generated, as shown in Table 2.

TABLE 2

| | Bead Type | Powdered Type |
|---|---|---|
| Size, inches | 0.001–0.04 | 0.0003–0.0018 |
| Average Size, inches | 0.01 | 0.001 |
| Average Shape | Partial Spheres | Slivers |
| Moisture Content | 48–65% | 42–55% |

The actual physical characteristics of the waste media are addressed in the appended Calculations section, wherein the waste characterization recited in Tables 1 and 2 are related to computational methods for determining appropriate vapor collector manifold or assembly configurations as well as processing parameters and endpoints in order to properly dewater waste treatment media.

The initial testing and design hypothesis was based on a nearly pure fluid dynamics approach, as the fundamentals of fluid flow under a differential pressure, gravity effects and fluid distribution are as applicable to a bed of solids as they are to pipe flow. Chemical, surface phenomena, and absorption/desorption effects were considered negligible or nonexistent at first because: (1) the surface chemical structure (mostly polystyrene) of ion exchange resin is hydrophobic, (2) ion exchange resins that are not fully oxidized are mechanically very stable, (3) the adsorbed water in the ion exchange resin is there due to chemical solution effects with fixed interior positive or negative charges that do not affect the exterior of the resin, and (4) if there were other hydration effects, they would not become obvious during the testing unless they were unmasked by the removal of all the unadsorbed, free standing and interstitial water. This initial hypothesis proved beneficial with regard to the aforementioned item 4. Several test and equipment modification iterations led to the result that all the free water was being removed by the fluid dynamics approach. The combination of a thermodynamic and resin water/water vapor sorption phenomena was then unmasked. At that point, the engineering methods shifted to a material drying approach on the premise that dewatered ion exchange resins contain adsorbed water and can behave like desiccants once that adsorbed water is removed.

With regard to fluid dynamics, using a purely fluid dynamics approach leads to two phase (liquid and gas) flow in the resin and the necessity of pulling out pockets of free standing and interstitial water. Under a fluid dynamics hypothesis, all of the free standing water is pulled out when subjected to sufficient uniform differential pressure across the resin. This is basically the mechanical portion of the process. Given the hydrophobic nature of the resin surface and the chemical solution effects of the adsorbed water, there should be a definite conclusion to the mechanical dewatering portion of the dewatering process. Any further dewatering would have to be a nonmechanical method such as evaporation, chemical enhancement, or solvent extraction; see the Thermodynamics discussion below.

Carrying the fluid dynamics hypothesis of dewatering to its conclusion leads to the design being based on two phase flow. Unfortunately, two phase flow in a bed of solids, particlarly in the size range of the subject media treatment particles, is not empirically well founded. Hence, the need for confirming test data. In fact, most single phase flow is empirically more well founded with larger sized solids and higher flow rates. The prior art has not used any engineering hypothesis and has instead relied on single point testing for conclusions to be applied to all field conditions. This approach has not worked well. On the other hand, testing all possible waste types and forms is unrealistic. Hence, the all encompassing analytical model set forth in the appended Calculations section was developed and proved by single point testing.

The flow of fluid through a bed of solids and then the residual free standing water is based on an interplay of the following resin characteristics: resin effective diameter; the shape of the resin; the packing or effective void volume of the resin; and the depth of the resin bed. The relative importance of each of these factors is discussed in the Calculations section. The different characteristics of the resin cannot be encompassed unless there is a good understanding of the hydraulic performance of the collector manifold and pumping system. The hydraulic factors to be considered are the following: a uniform minimum velocity through the bed of solids; the vapor collector manifold has design limits for achieving the uniform velocity via uniform collection; the losses in the pump and piping system external to the container; performance curve of the blower; and container design effect on flow paths. The factors cited above for both resin characteristics and hydraulic factors must also be combined with the state of the motive fluid that is applying the differential pressure to the free standing and interstitial water. Therefore, the following must also be considered: the temperature of the fluid moving through the bed of solids; the viscosity of the fluid; the molecular weight of the fluid; and the compressibility of the fluid. Thus, there are a total of thirteen major factors affecting the fluid dynamics hypothesis, and the relationships between all of these factors are defined in the appended Calculations section as they apply to field conditions. Full scale test data has been used to verify the model. The fluids dynamics hypothesis has proven to be substantially correct under field testing conditions.

With regard to thermodynamics, ion exchange resins contain a considerable amount of adsorbed water, on the order of 35 to 65 weight percent, even when they have no interstitial water. The adsorbed water has unique chemical solution characteristics since only one of the plus or minus charged ions in the solution is free to move while the other charged ion is fixed to the plastic bead. The plastic resin itself is hydrophobic and the adsorbed water is there due to chemical solution effect. Therefore the adsorbed water has evaporation properties unique to the chemical form of the waste's adsorbed water. Since the waste can be expected to undergo substantial temperature changes during processing, transport, and storage, the ability of the adsorbed water to leave the resin must be addressed.

The thermodynamic properties also apply to nonresinous particles with different water holding phenomena. While ion exchange resins hold water predominantly with an adsorption mechanism, other rigid, less chemical solution oriented particles, such as zeolites or activated carbon, hold water by pore diffusion and, to a much lesser extent, absorption. All such water holding mechanisms represent a thermodynamic resistance to releasing water. That resistance can be used to preclude the formation of free water in the burial condition despite the mechanism causing that resistance.

The thermodynamics and the flow of air/water vapor mixtures is known. The water uptake capabilities, or desiccant effects, of ion exchange resins are also generally known. The thermodynamic hypothesis has several points: Thermal and fluid dynamics are related only with respect to even distribution of the drying air for purpose of removing some of the adsorbed water. It is more efficient to remove free standing water by mechanical means (fluid flow) than by evaporation (thermodynamics). There is an air/water vapor to resin retained water equilibrium point that signals the desired drying endpoint. The dryness of the resin or other media should correspond to not generating free water in the burial environmental conditions.

The predictable drying of a material depends on the state of the drying fluid and the state of the fluid to be dried. Compared to the state of the solutions in the waste media slurry, the state of the drying air is relatively straightforward. Psychrometric charts and fundamental heat transfer relations can be applied to forecast the expected generation of free water from air and the drying capacity of the air flowing through the waste media. Specialty data must be applied to the removal of adsorbed water from ion exchange resins. From that data the following factors have been found to effect the drying of various resins: moisture content of the resins; chemistry of the retained water; capacity or number of functional exchange sites remaining on the resin; and degree of crosslinking of the resin's polymer structure. There are an infinite number of combinations of the factors listed above. It was recognized early in the testing that the thermodynamic aspects of the dewatering system would have to be oriented to the worst case scenario, as complicated resin analysis at a power plant is not economically feasible.

TESTING

Extensive testing has been conducted in order to qualify the dewatering system of this invention to the free standing water requirements of 10 C.F.R. 61 for both bead and powdered media. The regulatory limit for free standing water in a high integrity container has been established at 1.0% of the waste volume by 10 C.F.R. 61, which also establishes that the test methods contained in ANSI 55.1 are to be used to detect the presence of free water. The method and apparatus of this invention have performed well within these limits, particularly with regard to the absence of free water over the expected chemical and physical range of the waste processes. This range in properties of the resins has been considered in the testing program, the equipment design, and the operating parameters for this system.

The bead resins used in the test program were selected to be within the resin properties that are expected to be encountered in the field. The equipment design and the operating parameters which have been established for this equipment were selected to preclude the presence of free water for normal waste materials and to detect abnormal, or worst-case, materials prior to dewatering. In addition, in order to assure compliance with the regulatory limits with the waste stream variations which will be encountered in the field, an initial acceptance criteria of 0.1% free water was imposed for the qualification tests. As the testing progressed the solving of various fluids and thermodynamic phenomena led to the practical result of zero free water at the relatively cool burial temperature.

The bead resins used in the testing program were of two types, spent anion resins and new, off-specification cation resins. The anion resins were representative of bead resins which have been regenerated many times and fouled with large organic molecules. They tend to be oxidized with less crosslinking and are of a smaller average particle size. The cation resins on the other hand are representative of bead resins which have not been regenerated, are very spherical, and are on the upper end of the scale as far as size and shape. The cation resins are thus more representative of the bead resins which will be encountered in the field. With the possible exception of deep bed condensate polishers, most resins are not regenerated at nuclear power plants. For this reason, the cation resins were used extensively to establish system design and operating parameters, and because their physical and chemical characteristics were better known. Dewatering of the anion resins was subsequently solved as a worst case basis.

The powdered resins used in the testing program were spent and of the type sold under the trademarks ECODEX or EPIFLOC. The filter aid present in these materials tends to hold water more readily than the resin, making them the most difficult of the powdered resins to dewater. Powdered media (e.g., POWDEX, ECODEX, and EPIFLOC) have granule diameters averaging 0.0015 inches as compared to about 0.02 inches for bead type resins. Flow through a bed of powdered media is affected by the presence of fibrous material. The fiber is intended to enhance filterability of the precoat. The consequence in dewatering is a change from a rigid bed of solids to a spongy and compressible bed. With regard to powered media, the approach has been to do the best possible job removing the interstitial water, recognizing that shrinkage during dewatering will cause sloughing and random cracking. To compensate for the randomness of the media sloughing, water removal has been enhanced through the use of air drying techniques. The result of this approach has been shorter and more thorough dewatering than previously available.

The physical measurements which have been taken over the course of the testing program show good correlation to the analytical methods as presented in the Calculations section. Powdered resins have been successfully dewatered in the qualificational testing program. Bead resins have also been successfully dewatered. Cation resins were dewatered, producing no drainage of free water following an eight hour dewatering cycle. Regenerated anion bead resin beads took no more than 16 hours to dewater.

CALCULATIONS

Introduction

The method of the present invention employs a two-part approach to dewater radioactive particles to a condition satisfactory for permanent storage. Both fluid dynamic and thermodynamic engineering analyses must be considered in order to define the operating requirements of such a dewatering system. Fluid dynamic analyses are used to effect the complete removal of unadsorbed, free standing and interstitial water from the bed of radioactive particles and to uniformly air-dry the particles thereafter. Thermodynamic analyses are usedto insure that free standing water does not thereafter develop as a result of condensation cycles that result from temperature fluctuations during transport, storage, and disposal.

FLUID DYNAMICS

Solving the fluid dynamics problem involves three principal analyses: (1) the fluid performance through the bed of solids, (2) the fluid performance of the vapor collector manifold, and (3) the fluid performance of the mechanical equipment.

Flow Through a Bed of Solids

Standard fluid flow relationships have been developed for single phase (gas or liquid) flow in pipes, ducts, and beds of solids. Unfortunately, in the case of granular media the same relationships have not been developed for two phase (gas and liquid) flow in a bed of solids. Also, in the case of powdered media, the fluid flow through a randomly cracked bed of solids is not defined. Nevertheless, there are fundamental principles which can be drawn upon and verified through testing. The primary goal is to achieve plug flow through all of the particle bed at a sufficient rate to draw air through granular media and pull the interstitial water out. Therefore, two items must be established: (1) the criteria for even flow through the solids, and (2) the minimum fluid flow (gas for granular media and liquid for powdered media) required to move the interstitial water. All forms of liquid treatment media particles must be considered.

The flow of a fluid in a bed of solids depends on the characteristics of the solids. The pressure drop of a compressible fluid (gases) flowing through a bed of solids can be expressed as shown in Equation 1.

$$p^2_1 - p^2_2 = (2zRG^2T/g_cM)[2f_mL(1-e)^2]/s^2e^3D_p \qquad \text{Equation 1}$$

wherein:

p = the inlet and outlet pressures
z = compressibility factor
R = gas constant
G = gas superficial mass velocity
T = temperature
$g_c$ = gravitational constant
M = molecular weight
$f_m$ = modified friction factor
L = depth of solids
e = interstitial void fraction
s = solid shape factor
$D_p$ = equivalent diameter of the solids, average.

R. H. Perry & C. H. Chilton, *Chemical Engineers' Handbook*, 5th Ed., McGraw-Hill Book Co., pp. 5–52 to 5–54, 1973, expessly incorporated herein by reference.

Equation 1 has been found to be very accurate for beds of granular solids similar to ion exchange media, zeolites, and activated carbon particles where the free liquid is simply pumped out and sufficient gas flow substantially removes the remaining interstitial water. Testing has shown good correlation to Equation 1, with an error of less than 1 percent. It is important to note the significance of the media's physical characteristics in Equation 1. A change in the shape of the particles will affect the terms of sphericity (s), void fraction (e), effective diameter ($D_p$), and the modified friction factor ($f_m$). A small difference in one of these terms can lead to a rate of change in the pressure drop exceeding a square function.

It has been determined that the modified friction factor, $f_m$, is in the laminar flow region for all of the expected waste media forms. As in the case of fluid flow in a pipe, the modified friction factor is a function of the Reynolds number except that it must be modified for the flow in a bed of solids. The modified Reynolds number can be calculated, for gases or liquids, using Equation 2.

$$N'_{Re} = D_pG/\mu \qquad \text{Equation 2}$$

wherein:

$N'_{Re}$ = Modified Reynolds Number
$\mu$ = viscosity.

R. H. Perry & C. H. Chilton, *Chemical Engineers' Handbook*, 5th Ed., McGraw-Hill Book Co., pp. 5–52, 1973.

Figure 15:
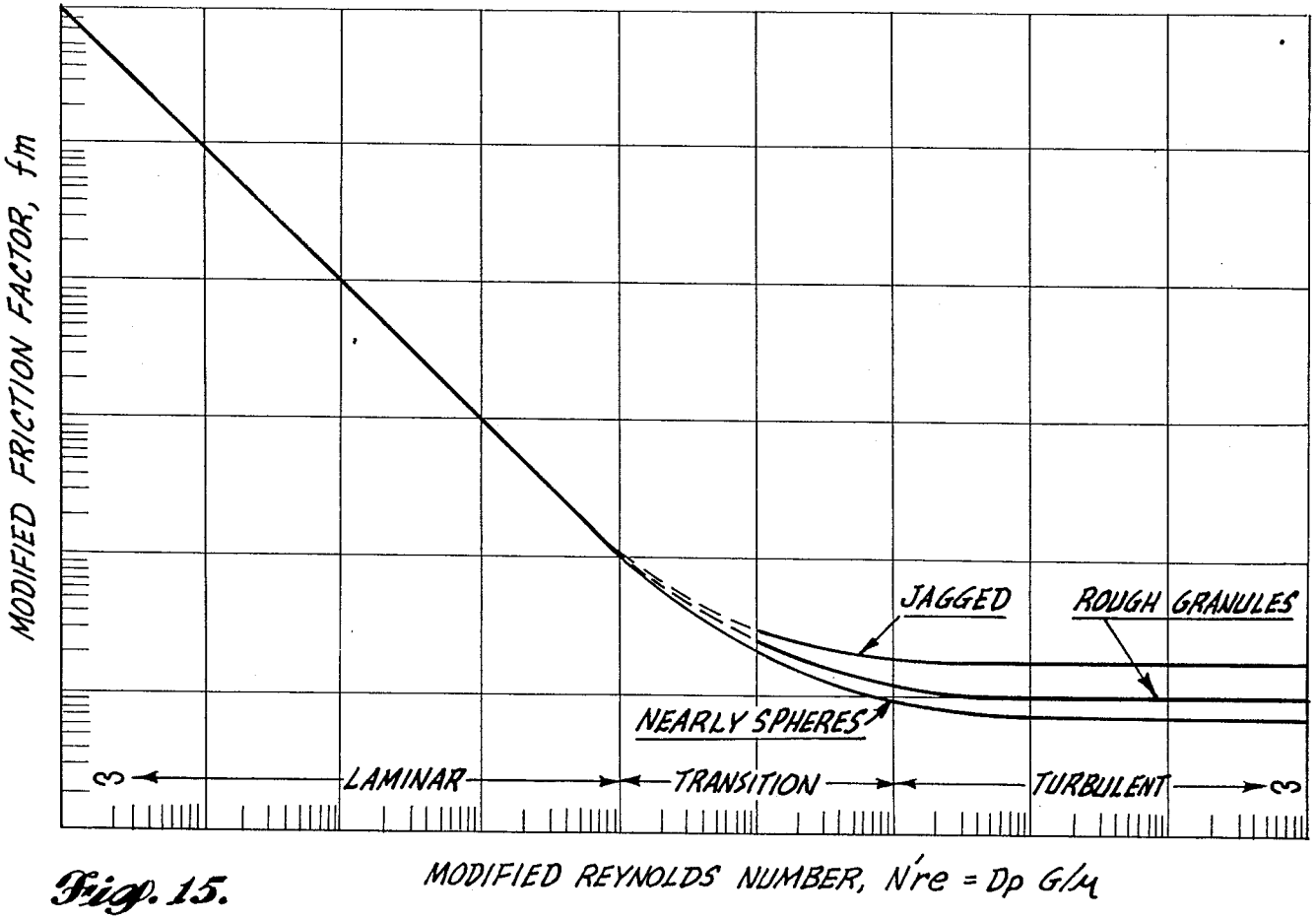
FIG. 15 is a graph of friction factor versus Reynold's number for a fluid passing through a bed of solids.

In the turbulent flow range, the friction factor is constant for a given material. Therefore, the pressure drop is proportional to the flow rate of the air through the bed of solids. In the laminar flow range, the friction factor is inversely proportional to a logarithmic relation to the Reynolds number. Therefore, in this case the solids pressure drop is more highly dependent on the gas flow rate and the gas viscosity. Since the gas viscosity is dependent on the temperature, the ambient air temperature in a field case must be considered. The modified friction factor $f_m$ is read off an experimentally determined plot of $N'_{Re}$ versus $f_m$ as shown in FIG. 15.

R. H. Perry & C. H. Chilton, *Chemical Engineers' Handbook*, 5th Ed., McGraw-Hill Book Co., pp 5–52, 1973.

The parameters for the physical characteristics of the solids are well founded. The void fraction and shape factor are tabulated or graphed for shapes varying from nearly perfect spheres to flakes and odd plastic shapes.

Flow Through Perforated Pipe Distributors

Perforated pipe distributors are used in water treatment and chemical manufacturing equipment. Experience has shown the empirical design methods available to be very accurate. Pressure readings taken during full scale testing have confirmed the accuracy of these methods. There is an economic trade-off between the capital equipment required to achieve a minimum velocity through the bed of solids and the extent of the disposable distributor required in the container.

The design of the distributors has involved standard orifice and pipe flow calculations. The key, however, is to determine the criteria for even distribution so as to avoid potential maldistribution problems that can occur in a bed of solids and around the pipe distributors. It should be noted that a bed of solids can itself be a means of distributing a fluid. Therefore, the bed of solids and the distributor are interrelated. Containers which have been used in the past have had maldistribution problems. It can take days for the free standing water to migrate to the bottom of a container of the prior art.

The vapor collector manifolds used in the representative dewatering containers shown in the Figures are commonly referred to as of the header and lateral type, with drilled and screened laterals. The header is the central backbone and the lateral conduits come out from it. The lateral conduits are designed such that the screen does not blank off or constrict the orifices when the resin is loaded on top and the fluid is flowing into them.

The calculated flow through a bed of solids can be incorporated with the distributor design calculations since the inlet pressure of the distributor is the bottom pressure of the bed of solids. The distributor designs for granular or powdered media are based on gas and liquid fluids, respectively. The orifice equation is summarized in Equation 3.

$$w = CYA_2\sqrt{2g_c(P_1 - P_2)\rho_1/(1 - B^4)} \qquad \text{Equation 3}$$

wherein:

w=flow rate
C=coefficient of discharge
Y=expansion factor
$A_2$=orifice cross section area
$g_c$=gravitational constant
P=upstream and downstream pressures
$\rho_1$=upstream density
B=orifice to pipe diameter ratio.

R. H. Perry & C. H. Chilton, *Chemical Engineers' Handbook,* 5th Ed., McGraw-Hill Book Co., pp. 5-11, 1973, expressly incorporated herein by reference.

The coefficient of discharge, C, is dependent on the orifice Reynolds number and the ratio of the orifice to pipe diameter. The discharge coefficient is essentially constant below certain diameter ratios and above certain Reynolds numbers. The expansion factor, Y, is a function of the ratio of upstream and downstream pressures and the specific heat ratio of the gas. In the expected operating conditions, Y is equal to one for both gases and liquids.

The criteria for the evenness of flow between the highest and lowest flow orifices in the distributor was arbitrarily set, by experience, at 5% maldistribution. The degree of distribution can be determined from the ratios of the fluid kinetic energy (Eq. 4) and friction loss in the lateral (due to fluid flow) (Eq. 5) to the orifice pressure drop. The actual percentage of maldistribution results in Equation 6. The applicable equations are:

$$K.E. = aV_i^2/2g_c \qquad \text{Equation 4}$$

$$h_p = [(4fL_c/3D) - 1](V_i^2/2g_c) \qquad \text{Equation 5}$$

$$\%\ \text{maldistribution} = 100\ [1 - \sqrt{(h_{o1} - h_p)/h_{o1}}\ ] \qquad \text{Equation 6}$$

wherein:

K.E.=Kinetic Energy
$L_c$=length of the longest conduit
$V_i$=velocity at the lateral inlet
a=average velocity correction factor
$h_p$=pressure loss across the lateral
f=friction factor of the pipe lateral
D=lateral diameter
$h_{ol}$=pressure loss across the first orifice.

R. H. Perry & C. H. Chilton, *Chemical Engineers' Handbook,* 5th Ed., McGraw-Hill Book Co., pp. 5-47 to 5-48, 1973.

The average velocity correction factor, a, is equal to 1.1 for long, straight pipes. The friction factor, f, is the standard value used for PVC pipe. Equation 6 is valid only when the orifice coefficient of discharge, C, is constant, as it is within the constraints stated above. The diameter term, D, in Equation 5 is for circular ducts or pipe. The hydraulic diameter, $D_H$, can be used in non-circular applications. An example would be if a plenum arrangement were used to distribute or collect the fluid. When the hydraulic diameter concept is used, the head loss equation appropriate to the duct shape is required. Such a head loss equation can be found in handbooks such as R. H. Perry & C. H. Chitton, "Chemical Engineers' Handbook," 5th Ed., McGraw-Hill, pp. 5-23 to 5-27, 1973, expressly incorporated herein by reference.

The fluid distribution methodology is also applicable to the collector header. The laterals represent the orifices. This technique can be used to insure a sufficiently large collector header. If the header is too small, the outer laterals will not receive a sufficient volume of fluid. The distance between lateral conduits and the distance between orifices has been established based on economic considerations. There is a limiting return on the addition of more orifices and laterals. An increase in pressure drop due to air flow becomes more cost effective. The spacing of the orifices and laterals are somewhat arbitrary. The main consideration in orifice spacing along the lateral is the distance between laterals. A balanced square pattern is achieved by placing the orifices along the lateral at less than one half of the lateral spacing. The geometry determination is mostly qualitative based on experience. The actual distribution effects are a combination of the orifice locations and the distribution effect of the bed of solids. This problem is addressed below.

Distribution Criteria

There are maximum and minimum effective flow rates for a given distributor design. If the flow is too low, the fluid will enter the distributor at the point of least resistance, the center collection point at the header and the vertical riser pipe. If the flow is too high, the fluid velocity in the lateral at the entrance to the header will be too great to allow flow in the center of the laterals, the flow would prefer to enter the outer perimeter of the laterals.

Most of the dewatering procedure occurs under the effect of two phase, gas and liquid, flow. The distribution criteria for the combination of the distributor and the solids can be achieved with single phase flow correlations since the end of the dewatering procedure is completely gas phase. Initially, the vapor collector manifold geometry was determined for gas flow through the largest sized bead ion exchange resin. Two phase flow distribution problems occurred directly above the distributor laterals. However, the solution was found to be simply to increase the minimum required pressure drop across the resin by increasing the gas flow rate in the case of granular media. That approach has been successful. Prior art has been based on water flow without consideration of any drying criteria.

Figure 13:
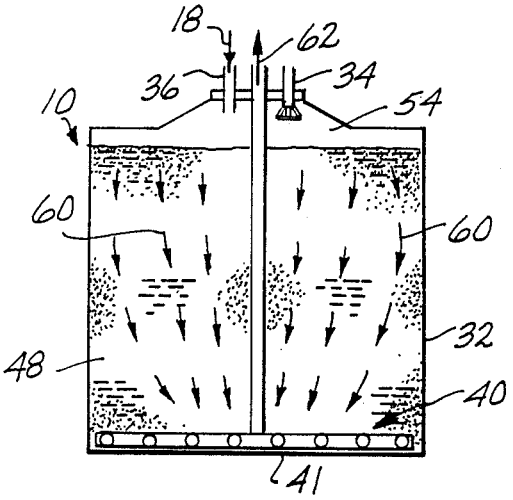
FIG. 13 is a view similar to FIG. 4, showing the nonuniform air circulation that results from insufficient pressure drop across the bed of solids and/or collector near the vapor collector manifold.
Figure 14:
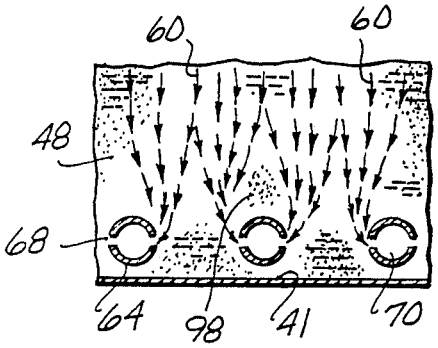
FIG. 14 is a view similar to FIG. 5, showing the blank areas that tend to develop above the vapor collector manifold where there is insufficient pressure drop across the bed of solids.

FIGS. 4 and 5 illustrate the desirable uniform, plug flow of drying air across the entire cross section of the container. By way of contrast, FIGS. 13 and 14 illustrate the effect of insufficient distribution, or pressure drop, across the bed of solids near the distributor. Blank areas 98 occur above and beside the lateral conduits 64 when there is insufficient pressure drop. The interstitial water in such blank regions 98 tends to increase the effective solids diameter, lower the effective void fraction, and alter the shape factor. When all of these values change in relation to each other it can be seen from Equation 1 that the pressure drop across the bed of solids goes up dramatically. The airstream 60 can preferentially flow around the blank areas 98 above the distributor 40 such that there is an equilibrium between the resistance to air flow 60 in the solids 48 and the resistance to flow due to the interstitial water in the blank pocket 98 above the lateral 64. This phenomena was observed during testing.

The only way to find the minimum pressure drop required to eliminate the two phase pockets 98 above the lateral 64 is experimentally. The minimum pressure drop experimentally measured from a successful test can be empirically extended to other solid diameters by the velocity head concept. A velocity head is defined in Equation 7.

$$\text{velocity head} = h_v = V^2/2g_c \qquad \text{Equation 7}$$

wherein:

$h_v$ = velocity head

V = media fluid velocity $g_c$ = gravitational constant.

R. H. Perry & C. H. Chilton, *Chemical Engineers' Handbook,* 5th Ed., McGraw-Hill Book Co., pp. 5-49, 1973.

It has been found in similar applications that it takes at least 10 velocity heads to achieve even distribution across a bed of solids with a single fluid phase. It has also been found that greater than 10 velocity heads is required to overcome the two phase pockets above the lateral conduits. The number of velocity heads has been extended to different solid sizes and characteristics. The minimum operating parameter for velocity heads, as applied to granular types of media, is conservatively fixed at 26 as the result of testing.

The velocity head concept is utilized to fix the minimum required fluid flow rate and collector configuration. The minimum velocity head concept consistently gives a flat bottom container thereby precluding the need for a suction low point in the container. Operation above the minimum flow rate insures sufficient vertical and horizontal differential pressure to bring the fluid to the collector. Free draining of the liquid in the container is not a significant factor as in prior art. The flat bottom container is less expensive, allows for packaging greater than 5% more waste volume over prior art containers and does not require excessive handling to carry out the dewatering process. Prior art requires a low point in the container to effect a spot to collect and remove free standing water. The low point can be achieved by making it a part of the container or by tipping the container to make the low point. Both methods have serious operating and economic disadvantages. The container low point that results from sloped or conical bottoms are more expensive to construct and result in more than a 5% loss in usable volume. Tipping the container requires additional handling of a radioactive container that usually is placed inside of a shield. The tipping technique results in added personnel radiation exposure and very difficult container handling.

Powdered Media

The dewatering container internals for powdered media are based on liquid flow. The calculations for liquid flow in powdered media are similar to those used in Equation 1 for gas flow through granular media. Equation 8 is the formula used for flow of an incompressible fluid through a bed of solids.

$$p_1 - p_2 = (2G^2/g_c\rho)[f_m L(1-e)^2/D_p s^2 e^3] \qquad \text{Equation 8}$$

wherein:

$\rho$ = density and the other parameters are as in Equation 1. R. H. Perry & C. H. Chilton, *Chemical Engineers' Handbook,* 5th Ed., McGraw-Hill Book Co., pp. 5-52 (1973). The factors representing the properties of a gas have been dropped out. The temperature term has also been dropped, but still plays an important role in correcting the viscosity term used in establishing the Reynolds number and the corresponding friction factor, $f_m$. The same friction factor plot as shown in FIG. 15 is used for liquids. The pressure drop of water flowing through ion exchange resins is well founded, and Equation 8 correlates to that data with less than a 1 percent error.

The shape factors and void fraction for powdered media are considerably different than for bead-type resins. Powdered media has more of a silver shape. Therefore, the shape factor will go down, simulating crushed glass or certain types of sand. The void fraction will go up since the packing efficiency will not be as good as for spheres.

The use of Equation 8 to establish the elevation of the filter banks and the spacing between filters represents a significant advance in water removal efficiency. The maximum distance that water can move to the filter can be determined based on pressure drop, with a perfect vacuum being the ideal upper limit. If the pressure drop is dissipated at a distance less than the distance between the filters, then the possibility of a water pocket exists. This concept combined with properly designed distributors provides an improvement over the prior art.

The powdered media dewatering relies on air drying to remove the tail of the free water that mostly occurs from thermal effects. Since the same dewatering system is used on granular media, it also receives the benefit of the air drying. The evaporation effects are calculated in the Thermodynamics discussion below.

Summary of Fluids Calculations

The foregoing fluids calculations can be integrated in a single software package. The logical calculation sequence follows the same path as the fluid flow through the actual system and as the calculations are ordered above.

Figure 17:
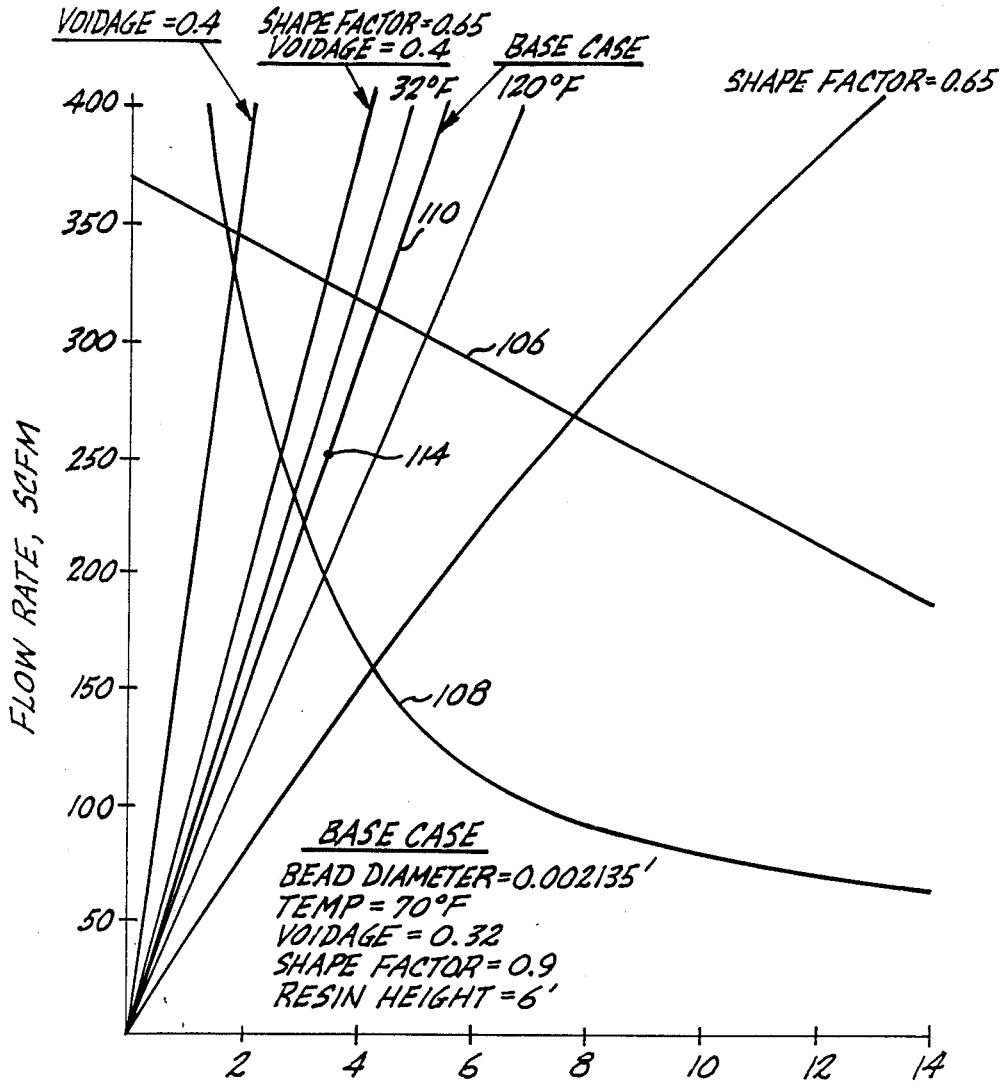
FIG. 17 is a graph similar to FIG. 16, showing a particular test result.

The calculations for determining the operating range for the dewatering system can be used to devise an operating region that is bounded by four curves: (1) the blower operating curve (2) the maximum possible flow out of the distributor (3) the minimum flow curve determined by the velocity head concept, and (4) the lower distributor performance curve determined by the distribution criteria. Such an operating region assumes that all other factors are held constant. Realistically, some of the factors will change in relation to each other, as illustrated in FIG. 17 below. However, the most important tie is between the voidage and the shape factor; as one changes, the other tends to compensate for it.

Figure 16:
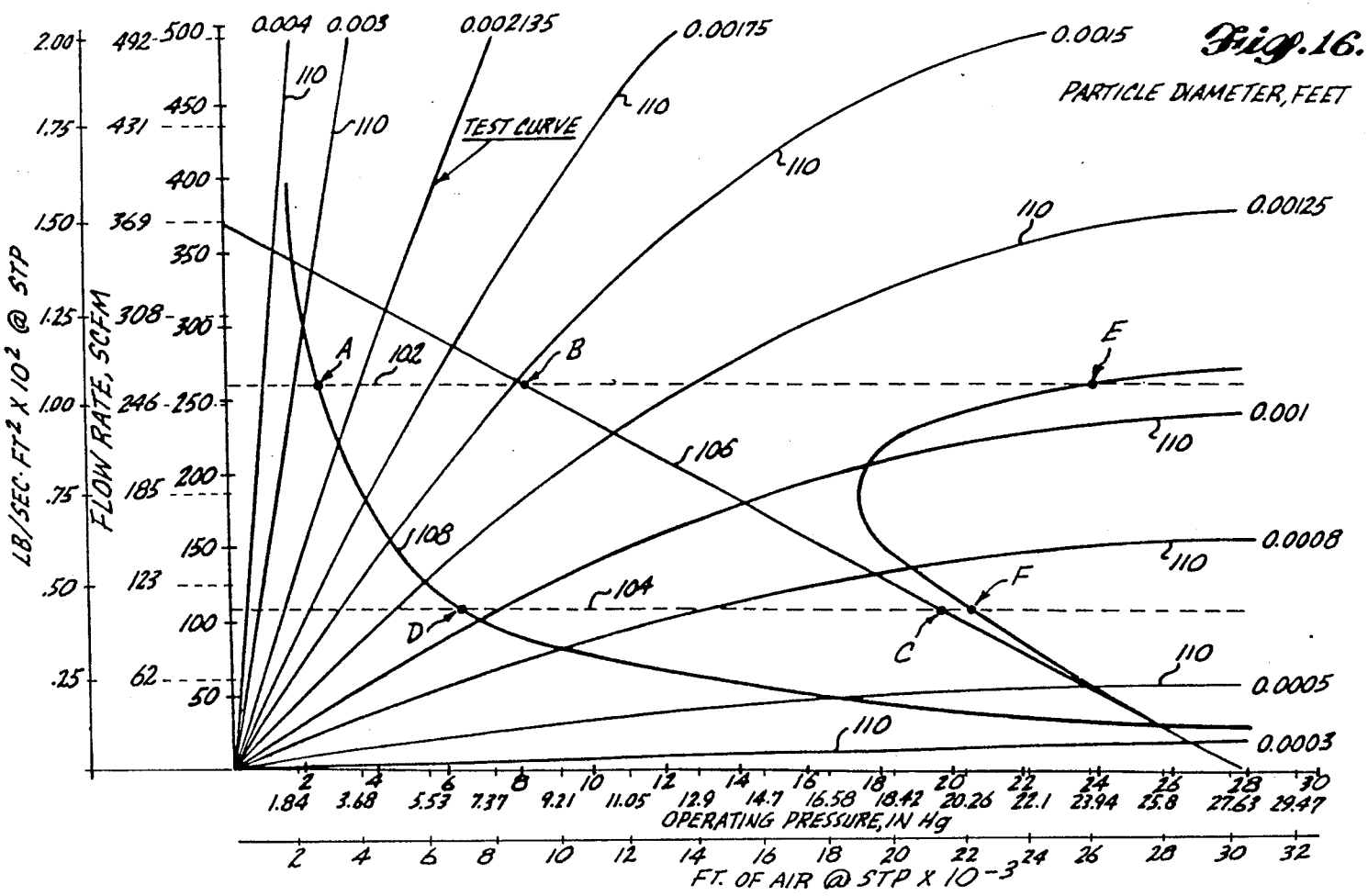
FIG. 16 is a multi-dimensional graph showing a typical operating region A-B-C-D from which a vapor collector manifold or assembly can be custom designed for specific applications.

The unique result is a region defining the operating parameters of the container and process system fluid flow as it directly relates to the waste characteristics. This operating region, as predicted by the aforementioned calculations, is summarized on FIG. 16 for the current production system. This operating region is bounded by the collector distribution criteria curves 102, 104, the blower operating curve 106, and the minimum velocity head flow rate curve 108, all as derived from the calculations above, that intersect at points A,B,C, and D on FIG. 16. Average particle diameter curves 110 on FIG. 16 are derived from Equations 1 and 2. The only curve not derived using the above-stated calculations is the blower performance curve 106. The blower curve 106 can be selected from equipment supplier data to overlay the other curves such that both powdered and bead resins are optimally processed by the same mechanical system.

This same set of curves can be expressed in other formats. For example, the curves could be normalized to flowrate versus pressure drop per foot of bed depth. The applications would be the same. It is important to note from the following summary the many concepts that have been assembled to determine the operating region (defined by points A-B-C-D of representative FIG. 16) necessary to properly meet the free standing water regulations on commercially available waste media.

The fluid mechanics design for the drying system is summarized on FIG. 16 as a bounded region defined by operating pressure versus fluid flow. FIG. 16 is a culmination of the fluid related design equations presented above. While FIG. 16 does not indicate any aspect of the system thermodynamics, proper fluid design is prerequisite to thorough, consistent and timely thermal conditioning of the particles.

Referring to FIG. 16, the operating region of the system is defined by four curves (A-B, B-C, C-D, and D-A). Each curve represents a specific application of different fluid mechanics concepts. The derived operating region is beneficial to real applications of the system and for quantitatively bounding the system's physical characteristics. Each new particle drying application would be tested with the analytic methods used for deriving the operating region. The resulting operating point would either fall within the existing operating region or a new system and a resultant operating region could be derived to encompass the new operating point(s).

Collector Distribution Boundary

Line A-B is derived from Equations 5 and 6 and represents the upper boundary of the system's performance. Line A-B is related to the evenness of flow along the collector laterals and indicates the points at which the distribution criteria of the longest collector lateral is exceeded. Line A-B gives the highest permissible flow rate for that collector's configuration. It is important to note that the collector maldistribution criteria applies to the flow along the collector lateral. It does not apply to the distance between the collector laterals or to the flow pattern of fluid as it enters the lateral, both of which are related to the minimum required flow through the particles as discussed below.

Equation 6 determines the degree of maldistribution across a collector lateral, and the factors $h_p$ and $h_{o1}$ are derived from Equations 3 and 5. The maximum acceptable maldistribution value is based on a judgement of the economics derived from experience, collector size and blower capacity test correlations. Less than 5% maldistribution was selected as satisfactory for applications where the minimum velocity head ($H_{MV}$) was about 26. We found that the collector maldistribution (% maldistribution) is directly related to the minimum velocity head ($H_{MV}$) as follows:

| % maldistribution | $H_{MV}$ |
|---|---|
| 1-10 | 10-50 |
| ~5 | ~26 |
| <1 | <10 |

Thus, by using a plenum or screen as the distributor a relatively small blower can be employed, as a relatively small $H_{MV}$ would be required.

If the flow through the collector is too high, then the kinetic energy term of Equation 5, $V_l^2/2g_c$, will predominate. The kinetic energy factor increases at a rate greater than the other applicable terms in Equations 5 and 6. Therefore, in Equation 6, the pressure loss across the lateral ($h_p$) will rise faster than the pressure loss ($h_{o1}$) across the first lateral orifice, meaning the orifice adjacent to the closed end of the lateral. Starting at the closed end of the lateral, a decreasing amount of fluid will enter the orifices as the flow travels to the central header. At flow rates above line A-B, more fluid will enter the outer orifices of the lateral than the inner orifices, and the maldistribution value will exceed the allowable 5% difference between the maximum and minimum lateral orifice flow. Fixing the maldistribution criteria and then defining the minimum number of velocity heads assures the proper fluid distribution relationship between the collector and the bed of solids.

Line C-D is analogous to line A-B and is also derived from Equations 5 and 6. Line C-D represents the lower boundary of the system's collector performance and indicates the points at which the distribution criteria of the collector is exceeded. Line C-D gives the lowest permissible flow rate for a particular collector's configuration.

If the flow through the collector is too low, then the lateral friction factor, f, in Equation 5 will predominate over the kinetic energy term, $V_l^2/2g_c$. The lateral friction factor does not decrease the same rate as other applicable terms in Equations 5 and 6. As the flow is reduced, the orifice pressure drop falls at a greater rate than the pressure drop, due to fluid friction in the lateral. Starting at the closed end of the lateral, an increasing amount of fluid will enter the orifices as the flow travels to the central header. Below line C-D, more fluid is entering the inner orifices than the outer orifices, and the 5% maldistribution criteria will be exceeded.

Lines A-B and C-D are constant flow lines extended from the operating points on curve 112 corresponding to the 5% maldistribution criteria. Curves A-B and C-D are defined by Equation 6. The pressure loss across the first orifice, $h_{o1}$, can be defined in terms of the pressure at the bottom of the bed of particles. First, Equation 1 must be written to give the particle bed bottom operating pressure. The fluid head at the bottom of the particle bed, in feet of fluid, and as plotted on FIG. 16 as curves 110 for various particle diameters, is as follows:

$$h_2 = 1/\rho_2 \sqrt{p_1^2 - (2zRG^2T/g_cM)\,[2f_mL(1-e)^2]/s^2e^3D_p} \qquad \text{Eq. 1A}$$

wherein:

$\rho_2$=gas density at bottom of particle bed, and where $p_1$ in an actual operating system is usually atmospheric pressure.

The conversion of pressure from pounds per square foot, p, to feet of fluid or head, h, is accomplished by simply dividing p by the density of the fluid at that temperature and pressure.

The selected orifice pressure drop, $h_{o1}$, (for a desired flow rate and particle size) is subtracted from the pressure at the bottom of the bed of particles, $h_2$, to give the pressure inside the pipe at the first orifice, $h_{p1}$. This is shown as Equation 2A and plotted as curve 112 on FIG. 16.

$$h_{p1}=h_2-h_{p1} \qquad \text{Eq. 2A}$$

Of course, for a suction system the particle bed plus orifice pressure drop, and therefore $h_p$, cannot exceed a full vacuum.

Now the distributor maldistribution criteria can be written in terms of Equation 1 by substituting Equation 2A into Equation 6 to give Equation 3A, and then Equation 1A into Equation 3A to give Equation 4A. The maldistribution equation becomes:

$$\%\ \text{maldistribution} = 100[1 - \sqrt{((h_2 - h_{p1}) - h_p)/(h_2 - h_{p1})}\,] \qquad \text{Eq. 3A}$$

$$5\% = 100\left[1 - 1/\rho_2\sqrt{\frac{(((p_1^2 - (2zRG^2T/g_cM)\,[2f_mL(1-e)^2]/s^2e^3D_p) - h_{p1}) - h_p)}{1/\rho_2\sqrt{((p_1^2 - (2zRG^2T/g_cM)[2f_mL(1-e)^2]/s^2e^3D_p) - h_{p1})}\,]}}\right] \qquad \text{Eq. 4A}$$

The lines containing segments A-B and C-D correspond to the points on curve 112 where the maldistribution criteria is equal to 5%. The lines containing segments A-B and C-D are run through those two points on curve 112 at constant flow rates. Note that Equations 3A and 4A give two solutions, as shown by the parabolic shape of the distributor performance plot (curve 112) and the resultant two points on the curve giving segments A-B and C-D. The resultant two solutions are consistent with the concept of two roots of a quadratic equation. The distance from points B to E and C to F are consistent with maximum and minimum allowable orifice pressure drops in relation to the lateral's friction loss.

Collector maldistribution due to low flow rate can occur when there is an excessive pressure loss in the system. The excessive pressure loss can be attributed to (1) the slurry bed particles are too small, (2) fluid line losses external to the collector are too great, (3) excessive pressure drop in the water separator, and (4) the blower is throttled, worn or malfunctioning. Lines C-D and A-B can be altered vertically by increasing the lateral diameter, using smoother pipe, or changing the number and/or diameter of the orifices (altering the pressure drop across the orifice). The described powdered media application is an example of altering the collector lateral design to place the operating point within an appropriate operating region.

Excessive kinetic energy and lateral friction losses due to excessive lateral flow rates can originate from two sources: (1) the economic selection of the smallest practical pipe diameter, and (2) the desire to have a maximum number of laterals in the container to promote greater and quicker flow distribution through the slurry bed. There is a trade-off between the smallest lateral's performance and the number of laterals that can fit into the container.

Slurry Bed Flow Boundary

Curve A-D specifies a third boundary of the operating region. Simply being within the other three boundaries insures good collector distribution but does not insure good distribution through the slurry bed and collector. The even flow of the fluid down the slurry bed and into the collector orifices is dependent on several factors. Direct factors are the characteristics of the slurry bed itself and collector geometry. Equation 1 summarizes the applicable physical factors of the slurry bed affecting the flow through the slurry bed. Indirect factors are the way the fluid moves down the slurry bed and preferentially enters the collector orifices, two phase flow resistance, and container design effects (wall effects, bottom geometry, installation clearances, etc.).

Because of the many factors affecting the uniform flow through the slurry bed, the fluid maldistribution through the slurry bed and into the collectory cannot be directly quantified as it can for the collector. Instead, the velocity head concept (see Equation 7) is used to characterize the minimum flow required to give proper fluid distribution through the slurry bed and into the collector. A velocity head is a unit measure of the fluid's kinetic energy. Fixing a minimum number of velocity heads, or fluid kinetic energy, across the slurry bed as an indicator of even flow has a basis in fundamental equations of fluid motion.

The square of the fluid velocity is a fundamental part of any representation of fluid motion. Equation 5A is Bernoulli's equation:

$$V^2/2g_c+p/v+z=\text{constant} \qquad \text{Eq. 5A}$$

wherein:

V=media fluid velocity p=fluid pressure v=specific weight z=position change along the z axis.

O. W. Eshbach, *Handbook of Engineering Fundamentals*, 2nd Ed., John Wiley & Sons, Inc., p. 6-35, 1966.

Equation 5A is the basic energy equation of fluid motion for a non-viscous effect, incompressible fluid flowing in the direction of a streamline. The first term denotes the kinetic energy, the second is the work performed by the fluid, and the third term is the position change along the z axis or the potential energy due to gravitational effects. A real fluid would include terms for the heat generated due to viscous drag and compressibility effects. Heat, work, potential energy, and compressibility effects are negligible in this case. The result is Equation 7 which is equivalent to the velocity head relationship.

The attraction of using the velocity head concept stems from a velocity of 8 ft./sec. is equal to a velocity head of 1 ft. of any fluid. The result is a specific velocity head value can be applied across different fluids and bed depths to achieve the same particle bed fluid distribution. It is convenient, but not necessary, that the velocity head value for particle bed flow be nearly equivalent to the pipe flow values. This convenience is achieved by simply using a factor in the head loss equation. Equation 1 is rearranged to get a velocity head term like that found in Equation 7.

$$h_p = \sqrt{8zRTf_mL(1-e)^2/Ms^2e^3D_pp^2(V^2/2g_c)} \qquad \text{Eq. 6A}$$

$h_p$=particle bed head loss.

The velocity head friction constant is then found from Equation 7A.

$$H_{MV}=C_hh_p/h_v \qquad \text{Eq. 7A}$$

wherein:

$H_{MV}$=constant number of velocity heads $C_h$=velocity head friction constant $h_v$=velocity head term from Equation 7.

For a velocity head value of 26 and using the operating data from the test case, the velocity head friction constant ($C_h$) is $1.1\times10^{-7}$, which is considered suitable for most applications.

The scale for the friction factor on FIG. 15 was selected by its developers to give a value of 1 for nearly spherical particles in the turbulent range. The result is simplified correlations for turbulent range calculations. Additionally, the value is a function of the empty vessel specific flow rate. This methodology differs from the fluid dynamics of pipe flow. The difference is only important when a correlation is made between flow through a bed of particles and pipe flow. Such a difference occurs with the velocity head concept of minimum flow through a bed of particles.

The friction factor for pipe flow results from a bulk flow having a resistance at the pipe wall. The friction factor for a bed of particles results from tortuous flow through very small channels. The friction factor for pipe flow (about 0.000005) is 7 to 9 orders of magnitude lower than for particle bed flow (about 10 to 1000). The gas velocity experienced in particle bed flow (about 0.1 ft./sec.) is more than 2 orders of magnitude less than usually found in pipe flows. Nevertheless, the velocity head friction constant, $C_h$, correctly adjusts the velocity head value to the same order as used in pipe flow.

The square of the fluid velocity is a direct relation to the minimum energy required for distributing the fluid across the slurry bed's cross section. The container's minimum number of velocity heads can be viewed as a minimum total energy of the fluid flowing through the slurry bed. If the fluid has sufficient energy, the resistance imparted by the slurry bed will even out the flow along the slurry bed's cross section. The minimum number of velocity heads required for even flow is determined experimentally and is unique to each slurry bed and collector configuration. However, since the number of velocity heads is dependent on the factors presented in Equation 1, the minimum number of velocity heads can be upper bounded for a range of slurry characteristics and collector geometries.

Curve A-D is a portion of line 108. Line 108 is a plot of Equation 7 where the number of velocity heads, $H_{MV}$, is equal to 26 for the test configuration. The fluid velocity is also a function of Equation 1. The velocity of the fluid, as the units are converted from empty vessel mass flow to SCFM, is $$V = 60\,\rho/A\sqrt{(p_1^2-p_2^2)(g_cMs^2e^3D_p)/[4zRTf_mL(1-e)^2]} \qquad \text{Eq. 8A}$$

where $f_m$ is a function of the fluid velocity, $$f_m=f(G) \text{ per Equation 2.} \qquad \text{Eq. 9A}$$

Curve A-D is the flow to pressure relationship at which the value of Equation 7A, or the number of velocity heads across the slurry bed, is equal to 26. Curve A-D is experimentally determined via a minimum number of velocity heads for a specific system. The minimum number of velocity heads was determined from the evenness of pressure measurements over the vessel cross section at several vertical levels. Below curve A-D, the fluid will excessively follow preferential flow paths. This phenomena is commonly known as fluid channeling. Curve A-D can be moved on the plot (in a velocity squared to pressure relationship) for other container configurations, different slurry bed heights, slurry characteristics, or as improvements are made in the collector and container efficiencies. The change in curve A-D for different applications is demonstrated below in an example of a real calculation sequence.

Blower Flow Boundary

Line B-C is the portion of the blower operating curve that falls on one edge of the operating region. Within certain mechanical constraints, the blower operating curve is selected to encompass the desired operating range of average particle diameters. Ideally, point B would coincide with point A. However, that condition would assume operation occurs on the blower operating curve with constant particle and fluid characteristics. Actual container operation occurs to the left of the operating curve because of system pressure losses, aging of the blower, and variations in the particle and fluid characteristics. The shape and location of line B-C can be altered for specific applications by selecting a different blower by customizing the blower system to a very narrow set of media and container characteristics.

Definition of Operating Region

To provide a definition of the operating region, the equations must coincide with the flow and pressure of operation as indicated by the FIG. 16 ordinates. In other words, the equations must be arranged to give the values on the ordinates on FIG. 16. Mathematical statements of the operating region follow:

For air flow:

The uniform flow of the relatively dry gas through the particle bed and into the collector is defined by the following head ($h_2$) to flow (G) relationship:

(i) the gas head at the bottom of the particle bed, $h_2$, is as follows:

$$h_2 = 1/\rho_2 \sqrt{p_1^2 - (2zRG^2T/g_cM)[2f_mL(1-e)^2]/s^2e^3D_p}$$

wherein $h_2$=gas head at the bottom of the particle bed,
$\rho_2$=density of the gas at the bottom of the bed,
$p_1$=pressure of the gas at the top of the bed,
z=gas compressibility factor,
R=the gas constant,
T=gas temperature,
$g_c$=the gravitational constant,
M=gas molecular weight,
$f_m$=fluid flow friction factor defined by the function=$f(D_pG/\mu)$ and determined by reference to FIG. 15,
L=height of the particle bed,
e=particle interstitial void fraction,
s=particle solid shape factor, and
$D_p$=average particle equivalent diameter;

(ii) the minimum flow (G) is as follows:

$$G = \sqrt{\frac{C_h h_2 2 g_c \rho_1^2}{H_{MV}}}$$

wherein $C_h$=the velocity head friction constant=$1.1\times10^{-7}$,
$\rho_1$=density of the gas at the top of the bed, and
$H_{MV}$=a stated minimum number of velocity heads ranging from less than ten to about fifty;

(iii) given (i) and (ii), the flow to head loss relationship must fall within the two roots of the following equation:

$$\%\ \text{maldistribution} = 100\ [1 - \sqrt{((h_2 - h_{p1}) - h_p)/(h_2 - h_{p1})}\ ]$$

wherein

% maldistribution=a stated positive integer or fraction ranging from less than one to about ten,
$h_{p1}$=the fluid head inside the collector at the orifice where the conduit flow is highest, as defined by $$h_{p1} = 1/\rho_3[h_2\rho_2 - (w/CYA)^2(1-\beta)^4/2g_c\rho_1]$$

wherein $\rho_3$=density of the gas inside the conduit,
w=the average orifice flow rate,
C=the orifice coefficient of discharge, and
Y=the expansion factor,
A=particle bed cross-sectional area, and
$\beta$=orifice to conduit diameter, and
$h_p$=is the head loss due to the flow in the conduit as defined by $$h_p = [(4FL_c/3D_H) - 1](V_i^2/2g_c)$$

wherein

F=conduit friction factor,
$L_c$=length of the conduit,
$D_H$=conduit diameter, and
$V_i$=the maximum velocity inside the conduit;

and the uniform flow being caused by a blower having a pressure to flow performance rating at least equal to that determined in (i) and (ii) and at least equal to the lower of the rates determined in (iii).

For water flow:

The uniform flow of water through the particle bed and into the collector is defined by the following head ($h_2$) to flow (G) relationship:

(i) the water head at the bottom of the particle bed, $h_2$, is as follows:

$$h_2 = 1/\rho[p_1 - (2G^2/g_c\rho)(f_mL(1-e)^2/D_ps^2e^3)]$$

wherein $h_2$=water head at bottom of particle bed,
$\rho$=density of the water,
$p_1$=atmospheric pressure,
G=mass flow rate of the water,
$g_c$=the gravitational constant,
$f_m$=water flow friction factor defined by the function= $f(D_pG/\mu)$ and determined by reference to FIG. 15,
L=height of the particle bed,
e=particle interstitial void fraction,
$D_p$=average particle equivalent diameter, and
s=particle solid shape factor; and (ii) given (i), the flow rate to head loss relationship must fall within the two roots of the following equation:

$$\%\ \text{maldistribution} = 100\ [1 - \sqrt{((h_2 - h_{p1}) - h_p)/(h_2 - h_{p1})}\ ]$$

wherein

% maldistribution=an integer or fraction ranging from about 0.25 to about 20,
$h_{p1}$=the water head inside the collector at the orifice where the conduit flow is highest, as defined by $$h_{p1} = 1/\rho[h_2\rho - (w/CYA)^2(1-\beta)^4/2g_c\rho]$$

wherein w=the average orifice water flow rate,
C=the orifice coefficient of discharge,
Y=the expansion factor,
A=the particle bed cross-sectional area,
$\beta$=the orifice to conduit diameter ratio, and
$h_p$=the head loss due to the water flow in the conduit, as defined by $$h_p = [(4FL_c/3D_H) - 1](V_i^2/2g_c)$$

wherein

F=conduit friction factor,
$L_c$=length of conduit,
$D_H$=conduit diameter, and
$V_i$=the maximum water velocity inside the conduit;

and the uniform water flow being caused by a blower having a pressure to flow performance rating at least equal to that determined in (i) and at least equal to the lower of the rates determined in (ii).

As noted above, all four operating region boundaries are dependent on fluid flow and its resultant pressure drop; hence, the selected x-y coordinate units as illustrated on FIG. 16, the representative region graph. These coordinate units (volume flow rate and pressure drop) are convenient for real applications since they are directly measurable on an operating system.

The operating region indicated on FIG. 16 represents a unique tie between the collector, the blower, and the flow through the slurry bed in the container. Different system designs would have an operating region following the same concepts outlined above. However, the shape may change as the absolute values of the collector and velocity head curves change or a different blower is selected. In other words, one or all of the defined curves can diminish to a single operating line or point, or can be plotted in different locations. It is not required that the operating region have the characteristic shape shown on FIG. 16, though it will in nearly all practical cases.

All of the curves on FIG. 16 were verified by actual test data and found to be accurate with less than 1% error. A representative test point 114 is shown on FIG. 17 and the relevant test data is disclosed thereon and discussed below with reference to Example 1. The unique capabilities of this method are supported by an actual power plant application. Many plants currently solidify their mixtures of ion exchange resins because they cannot be properly separated before dewatering by prior art systems. The calculation methods of the present invention allow for determining if the characteristics of the resin mixture will fall within the prescribed operating region. The appropriate fluid collector design and number of collector levels can be designed to fit with the existing mechanical equipment and still maintain certainty of meeting the regulatory limits on free standing water. Hence, the existing liquid treatment medias mixtures found in actual applications can benefit from the economics of volume reduction and the simplicity of this invention.

While FIG. 16 represents the operating region of a specific existing system, the operating region can be altered to fit unique economic or operating requirements. The same basic analytical methodology could be used to move, shrink, or expand the operating region. A realistic example would involve an application where only small containers, say 50 cubic feet instead of 200 cubic feet, are to be used and/or short processing times are not required. A smaller mechanical processing system could be utilized in proportion to the waste volume size and the time necessary to process the waste. Then the operating region could represent a lower flow rate area for smaller containers or it could be shifted down and to the left by using more collector levels than otherwise required in the container. The ability to uniformly flow the fluids through the container by the analytical methods and the specific mechanical equipment design allow for such collector flexibility in meeting field conditions.

The fluids calculations can also accurately perform a parametric study on the waste form, as shown for example by FIG. 17, to determine the effect of other waste variables such as particle depth, fluid temperature, particle shape, and particle bed void volume. This unique capability allows for custom designing the container internals. The custom designed container internals in effect match the waste form to the mechanical processing equipment. For example, the same basic design techniques are used on the layered powdered material internals as in the bead materials but the result is a "four containers in series" design (the tiered levels) for the powdered material because of the limiting effect of pulling a vacuum through the finer media. If such a mixture were processed in an unheated building in a cold climate, then the fluid temperature would be of concern since the location in the operating region can be altered by up to 30% by the change in the fluid viscosity with temperature.

The calculations presented herein give minimum parameters that must be incorporated in the final physical equipment. Examples are the minimum flow rate and the distributor's distribution criteria. The transition from the analytical minimums to the final physical design involves many practical design decisions. Many of those decisions revolve around the velocity head concept. It should be remembered the minimum number of velocity heads value is a characteristic of a specific container geometry and collector configuration. However, a new collector's configuration can be conservatively selected below that indicated by a container with a known number of velocity heads. Examples of such design considerations follow: (i) the lateral horizontal spacing can be closer than that indicated by a successful container with a known number of velocity heads; (ii) the orifice velocity must be greater than that indicated in the known container; (iii) the orifice spacing along the lateral must be equal to or less than that in the known container; and (iv) the screen around the laterals that keep particles in the container must be offset from the orifice to preclude diminishing the orifice flow. If the screen is not offset from the orifices, then the reduction in the orifice's open cross section must be considered.

There are two alternate applications of the foregoing analytic techniques that aid in determining custom internal configurations. The result of those alternate applications are (1) determination of the number and placement of multiple vertical levels of collectors and (2) the maximum distance between laterals (conduits). The system is based on the suction of the fluid through the solids in the direction of gravity. Since it is a suction system, the maximum pressure drop across the solids that will still effect fluid flow, at the greatest distance from the lateral, is a near perfect vacuum.

Equations 1–6 and 8 can be used to determine the distance from the lateral (conduit) at which a perfect vacuum occurs. That distance is determined above, below and horizontal to the distributor by appropriately altering the effect of the gravitational constants in the applicable equations. The vertical distance between the collector levels is the sum of the distance down from an upper collector at which a perfect vacuum occurs and the distance up from the next lowest collector at which a perfect vacuum occurs. Similarly, the horizontal distance between laterals can be determined.

Certain lateral design considerations must be followed to insure the practical application closely approximates the analytic determinations. An example occurs in the screening of the laterals to preclude entry of the particles into the orifices. The lateral screen is preferably off-set from the orifice to preclude diminishing the orifices' area available for fluid flow. However, if the screen were placed against the orifice, allowance for the closed area of the screen could be made by increasing the orifice diameter.

The vertical spacing of multi-collector containers and the horizontal spacing of the laterals can be determined using Equations 1 and 8. As written, Equations 1 and 8 are for a fluid flowing down through a bed of solids. The gravitational constant can be altered to account for upflow or horizontal flow of the fluid. The distance that a collector can pull the fluid upwards is determined by letting the gravitational constant go to zero and then increasing the bed depth until the total pressure drop (orifice, piping, system and across the particles) nearly reaches a full vacuum. The vertical distance between any two horizontally oriented collectors would be the sum of the up flow distance and the similarly determined down flow distance. The distance between laterals is twice that similarly determined for vertical distances except the gravitational constant is multiplied by the cosine of 90 degrees.

The design calculations for water and air flow provide a unique opportunity in nuclear water treatment applications. A disposable container can be loaded with new granular water treatment media (ion exchange resins, zeolites, activated carbon, etc.) and radioactive water treated through the media within that disposable container. When the treatment media is exhausted, the dewatering sequence is initiated. The container internals can be designed for the air flow required for dewatering and then the acceptable water flow range through those same collectors can be determined for the water treatment sequence. The results over the current art are more efficient water processing, negligible transfer of radioactive media, reduced personnel exposure, less process times (water treatment and dewatering), and lower costs.

THERMODYNAMICS

Approach

The dewatering system of the present invention uses convective evaporation with air for two purposes: (1) to enhance the removal of any residual free standing water, and (2) to slightly dry the resin such that it provides a desiccant-like effect with respect to condensate generation. The difference between the granular and powdered media, as far as evaporative effect, is the difference in the composite structure of the entire media bed towards the end of free water removal. The granular media maintains a rigid structure that is very conducive to fundamental fluid dynamics and subsequent drying. The powdered media exhibits a somewhat random creviced structure when the unadsorbed water is nearly all drawn out of the media. Evaporative water removal compensates for the randomness of the crevices by drying the exposed faces of the cracked powdered media. The dried media absorbs excess moisture from the interior of the bed as described below.

Mechanical Equipment Thermodynamics

Psychrometric operating curves can be developed that represent the heat, dewpoint, and water vapor operating curves of the dewatering system after free water removal but prior to the complete drying of the resin. The curves can be drawn on the applicable portion of a standard psychrometric chart wherein water content, dry bulb temperature, and constant enthalpy form the axes. R. H. Perry & C. H. Chilton, *Chemical Engineers' Handbook*, 5th Ed., McGraw-Hill Book Co., pp. 12-4 and 12-5, 1973.

Figure 18:
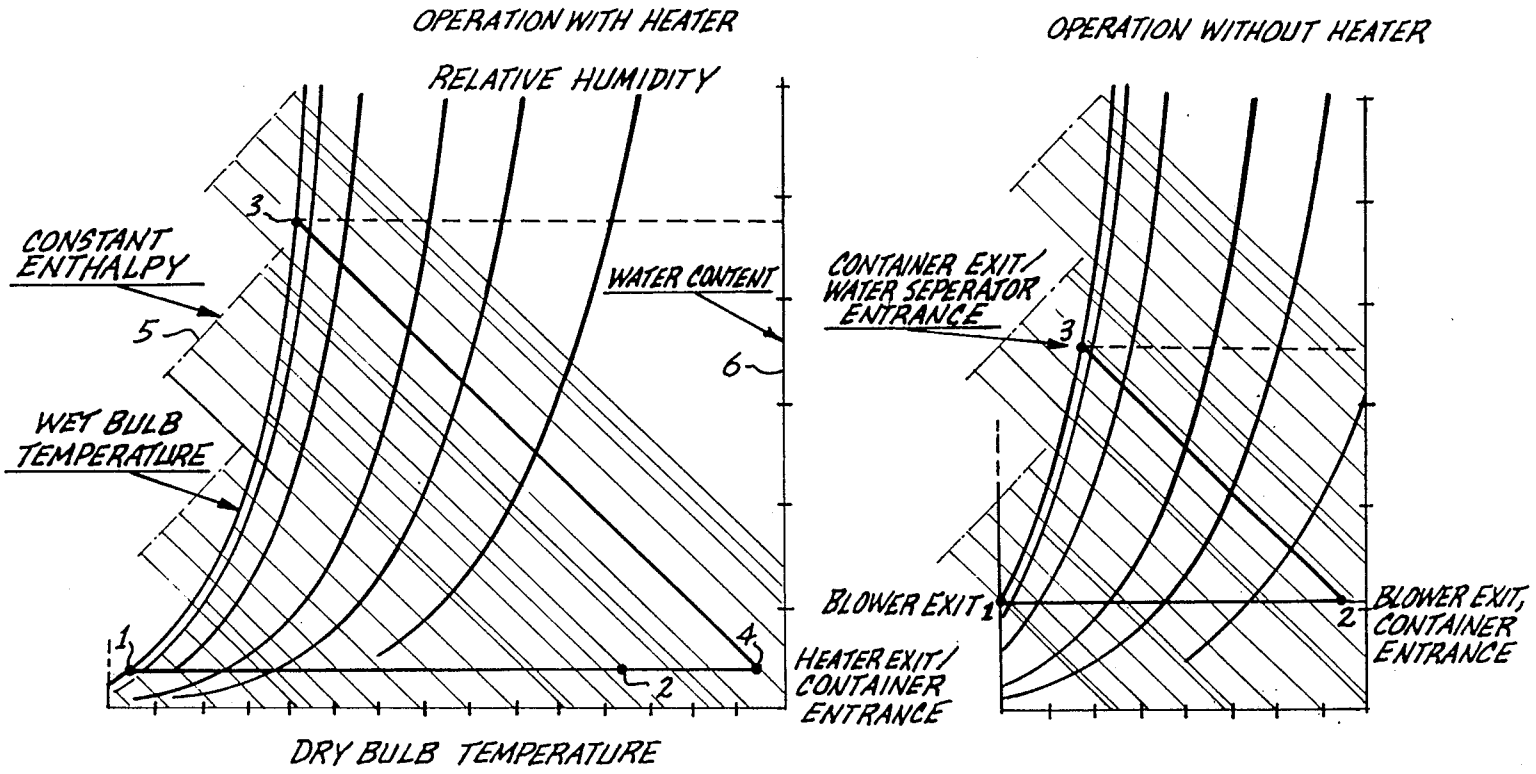
FIG. 18 presents two typical psychrometric operating curves along with numerical coordinates as discussed in the specification.

FIG. 18 represents the heat, water, and water vapor operating curves of the dewatering system after free water removal but prior to the complete drying of the resin. The curves are drawn on the applicable portion of a standard psychrometric chart. Points 1, 2, and 3 on FIG. 18 represent the input to the blower (or exit from the water separator), heat rise seen at the exit of the blower, and the saturated condition at the exit of the container, respectively. Moving along the dew point line from point 3 back to point 1 represents the condensation of water in the water separator. Extension of the horizontal line to point 4 on FIG. 18 is due to adding heat via an outside source or heater. The fixed temperature in the water separator represents a constant saturated air reference point from which to work from. The prototype testing used a conservative 60° F. air exiting the water separator. The production system utilizes a water chiller that can maintain a lower air temperature.

The amount of water removed from the system is determined from the right-hand side of the psychrometric chart. The distributor limiting flow rate of 260 standard cubic feet per minute is used, and the minimum and maximum water removals as determined by the two charts on FIG. 18 are 26 and 50 gallons, respectively, over an 8-hour cycle. This illustrates that a further advantage can be attained by adding an auxiliary heater to superdehumidify the airstream 18 after it leaves the blower. It is interesting to note that testing and previous experience indicates drained residual free water, without evaporative drying assistance, has been in the range of 10 to 25 gallons. However, that testing did not allow for the entire waste contents to reach the burial condition temperature of approximately 55° F. At the burial condition up to 60 gallons of water could be produced from condensation alone in prior art systems in which the media is not dried.

Since the dewatering system preferably operates in a recycle mode, it is essentially closed with respect to the atmosphere. Therefore, on FIG. 18, the water content when going from point 1 to points 2 and 4 is constant and the change is due only to heat input as the air passes through the blower (and heater, if applicable). The line from point 2 to 4 represents the heat added by the heater. When the air is passing through the container there is no appreciable change in the heat content of the air and water vapor mixture. Therefore, the line from point 2 or 4 follows the constant enthalpy line up to the saturated air line at point 3, gaining moisture along the way. From point 3 to 1, the water separator drops the air temperature and much of the water content as it moves down the saturated air line.

The detailed design has taken into account heat losses out of the container walls and in the filter and piping. The effect of heat losses on the curves shown in FIG. 18 is that they slightly deviate from the constant value lines. When the resins are dried below their saturation point, point 3 will begin to move down line 2–3 and show a lower relative humidity at the container exit. The other operating lines will remain the same.

The accuracy of using psychrometric charts to characterize the operating parameters of the dewatering system were verified with temperature, humidity, and water removal measurements. Even when pressure and heat loss deviations are ignored, the results are within good design practices.

Ion Exchange Resins

Ion exchange resins represent the worst thermodynamic case because they contain 35 to 65 percent bound water after all of the interstitial water has been removed. The bound water remains available, to varying degrees, for vaporization within the resin bed and subsequent condensation around the container wall when the container is exposed to a lower temperature at burial conditions relative to the temperature of the waste during the dewater processing. Bead-type resins represent a worst case for condensation because of their much greater ability to move air and water vapor within the resin bed. Prior art dewatering systems have not addressed the operating and burial condensation problem.

The approach of the present invention to the condensation problem follows these steps: (1) determine the credible worst volume of water that may be present due to condensation in the buried condition; (2) find the degree of resin dryness that must be achieved to allow for reabsorption of any condensation that may be generated in the burial condition; and (3) determine a finite end point for the dewatering process. Two parameters unique to ion exchange resins are critical to solving the aforementioned three steps. First, the heat capacity of the polystyrene, water, and chemicals that make up the resin must be determined. Second, a resin drying relationship must be found.

The heat capacity values for various chemical forms of ion exchange resins are not well tabulated. However, a relation to the material properties was found that closely matches experimental results. Equation 9 is the method used to determine the heat capacity values for various resin forms.

$$C_{PR}=X_{H2O}C_{PH2O}+X_{Chem}C_{PChem}+X_{Poly}C_{PPoly} \quad \text{Equation 9}$$

wherein:

$C_P$=Heat capacity of the resin (R), water ($H_2O$), pure liquid chemical (Chem), and polystyrene (Poly), respectively, Btu/lb.—°F.

X=Molar fraction of the water, pure liquid chemical, and polystyrene, respectively.

J. M. Smith & H. C. Van Ness, *Introduction to Chemical Engineering Thermodynamics,* 2nd Ed., McGraw-Hill Book Company, pp. 128–130, 1959. The reference indicates that Equation 9 should only be used when no other methods are available. Heat capacity values for pure components were derived from standard chemical thermodynamic tables. The results of Equation 9 were checked against values derived from actual testing temperature data and an equation analogous to Equation 10, below. The deviation between calculated and test values has been less than 0.1 Btu/lb.—°F.

Since the heat capacity is dependent on the type of resin and its chemical form, Equation 9 allows for finding the worst case, largest heat capacity value that may be encountered in field conditions. Actual calculations on a range of chemical compositions show the water content to be the overriding factor since its heat capacity is several times greater than the other components and has a significant molar fraction. Therefore, the range of possible heat capacity values is not great in absolute value, but has a significant impact on large volumes of resin. Heat capacity data for the pure chemical solutions in the resin were derived from sulfate salts for the cation and sodium salts for the anion.

The highest temperature the waste media is expected to be is 110° F. The burial condition is 55° F. A conservative assumption is that all of the heat content of the waste media spanning 55° to 110° F. is capable of vaporizing water adsorbed in the resin and then condensing at the container wall. The total heat available to produce condensate is given by Equation 10.

$$Q_R=V_R\rho_R C_{PR}(T_R-T_\infty) \quad \text{Equation 10}$$

wherein:

$Q_R$=total heat content of the resin, Btu $V_R$=volume of the resin, $ft^3$ $\rho_R$=density of the resin, lbs./$ft^3$ $C_{PR}$=heat capacity of the resin, Btu/lb—°F.

$T_R$=temperature of the waste, °F.

$T_\infty$=ambient temperature of the container, °F.

J. M. Smith & H. C. Van Ness, *Introduction to Chemical Engineering Thermodynamics,* 2nd Ed., McGraw-Hill Book Company, pp. 56–57, 1959.

For design purposes, the maximum heat capacity, volume, and density values can be used to size equipment. Equations 9 and 10 were used to help distinguish if there were significant differences between various types of resins. At this point there are not large differences between resins but there are when it comes to adding sensible heat to the resin to achieve the desired dryness endpoint, as explained below.

Once the total heat content is derived from Equation 10, the maximum water volume that can be derived from condensation is determined from the psychrometric chart. Assuming the temperatures, 55° to 110° F., the enthalpy change and the change in water content can be read from the chart. The total heat content divided by the enthalpy change per pound of air gives the total pounds of air required to cool the resin. The total pounds of air times the water content of the air gives the maximum total poundage of water expected to condense from the resin. This calculation can be eliminated by maintaining the media slurry at the expected storage temperature of, e.g., 55° F. during the course of the dewatering treatment, as described below, as $T_R$ would then approach $T_\infty$.

In this system, condensation never forms in the burial condition because the dried resin readsorbs the water before it can form. At the worst case, the dewatered and dried resin in these containers has a saturated water/water vapor equilibrium equivalent to 55° F., or the burial condition. When the temperature drops from the maximum waste temperature of 110° F. to 55° F., the dried resin acts as a very efficient desiccant to adsorb the additional moisture in the air.

Figure 19:
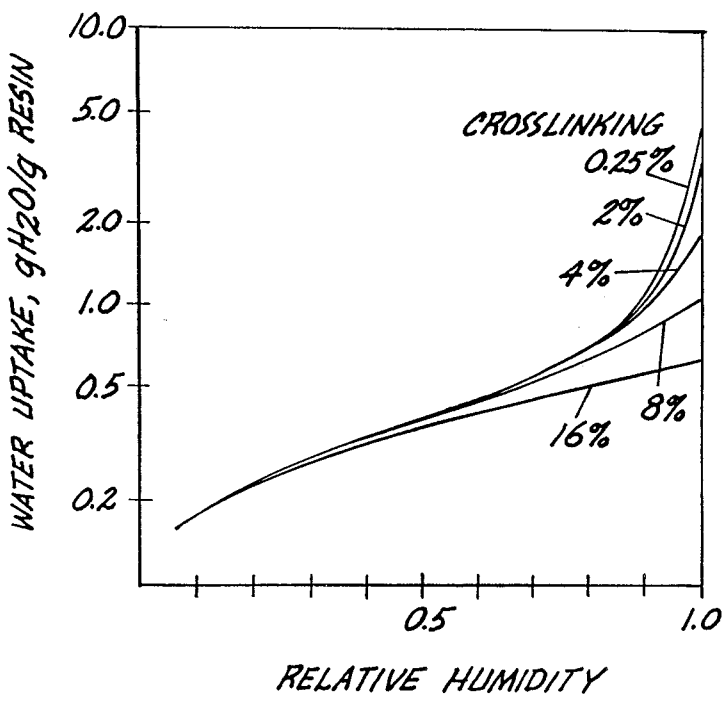
FIG. 19 is a graph showing cation resin water vapor/vapor sorption to crosslinking curves.

Once the maximum volume of water for resin reabsorption is determined, the next step requires data outlining the water uptake performance of various resins. The water uptake performance of ion exchange resin is complicated by three main characteristics of the resin: (1) the capacity of the resin, (2) the degree of crosslinking, and (3) the nature of the chemical solution in the resin. Items 1 and 2 can be conservatively quantified at the maximum published capacity for any strong cation or anion (2.1 and 1.4, eq./l., respectively) and at a maximum of 10% (divinylbenzene, DVB) crosslinking for each resin type, respectively. FIG. 19 illustrates the effect of resin crosslinking on the ability of the resin to hold water. F. Helferich, *Ion Exchange,* McGraw-Hill, p. 107, 1962. Oxidation and repeated regeneration can affect the crosslinking.

Figure 20:
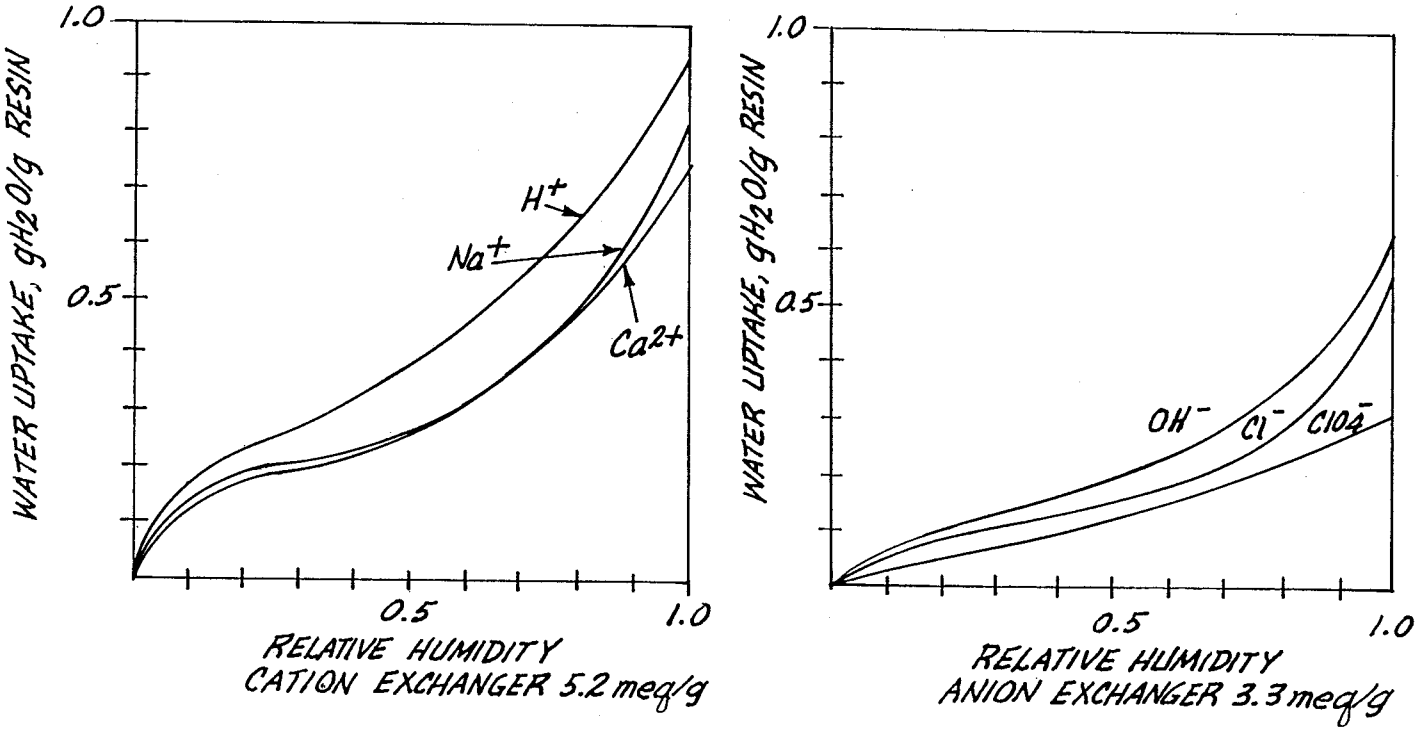
FIG. 20 presents additional water/vapor sorption curves, for different constituents of the ion exchange resin's adsorbed water.

The nature of the resin's aqueous phase is analogous to vapor pressure equilibriums of aqueous solution thermodynamics. As the concentration of the solution increases, the liquid vapor pressure decreases. At some point, there is an equilibrium with the surrounding gas. Equilibrium water/vapor sorption curves can therefore be prepared for the worst expected case cation and anion resins. F. Helfferich, *Ion Exchange*, McGraw-Hill, pp. 100–109, 1962, expressly incorporated herein by reference. FIG. 20 presents the equilibrium curves for the expected case cation and anion resins. Note the dependence on the chemical form of the resin. If the resin is severely fouled, or the ion in the slurry water is a large molecule like that found in decontamination solutions, the curve tends to be nearly flat and lower on the vertical scale. Such a curve would be the worst expected case since it indicates the relative humidity endpoint must be much lower.

The weight of the maximum expected water to be generated, as explained above, can be divided by the weight of the resin. The result can be applied to the curves of FIG. 20, and the corresponding relative humidity becomes the process endpoint. Then as the temperature of the resin drops from the process ambient to the burial condition, the humidity in the container increases and the resin will take up the added moisture in the air. As the bulk resin temperature approaches the burial condition temperature, the previously unsaturated resin approaches saturation. As the gas moisture content increases and/or the relative humidity endpoint decreases, more gas sensible heat is required to achieve the endpoint.

From the rationale described above, a worst case dewatering endpoint curve can be developed, and the ordinates of the curve that is best suited to field operations can be determined. For example, the waste beginning temperature is one ordinate but the other may be humidity, processing time, dry and wet bulb temperature, or volume of water removal from the container after the beginning of the drying cycle. Possibly several waste specific endpoint curves may be required. The worst case would be one each for cation and anion resins in the once used or regenerated state for each chemical form. Such an approach would encompass the major field differences in moisture retention, chemistry, capacity, and crosslinking. The ability to determine the effectiveness of the dewatering system across the full spectrum of waste forms has very good promise since the analytic projections have shown excellent correlation to the single point derived from field tests.

Process Endpoint Derivation

The purpose of the endpoint method or methods used with this invention is to come to a definite point where the process may be stopped and still assure that enough adsorbed water has been removed to preclude the generation of free standing water by the condensing cycle described above. Many endpoint methods can be developed out of the aforementioned thermodynamic calculations. However, the methods apply to either the properties of the air or the amount of adsorbed water removed from the waste. Either method stems from the chemical or physical characteristics of the adsorbed water and waste media, respectively, as described in the calculations section on thermodynamics. With respect to the properties of the drying air, the endpoint methods can include, but not be limited to, the humidity, wet bulb and dry bulb temperature, flow rate to wet bulb temperature relations that relate to the adsorbed water removed, etc. With respect to the adsorbed water removed, it could be simply measuring the amount of water coming out of the water separator, a time versus water removal rate relationship, container weight loss, etc.

Our field tests have proven many new concepts in radwaste dewatering technology. The invention's analytical and testing results represent the first time the free standing water question has been practically addressed and solved with respect to the container's burial condition. It is also the first time full scale testing has been used to confirm single data points within a predetermined operating region. The prior art relies on measurement of the pumped or drained free standing water to determine the processing endpoint. This type of endpoint can at best be treated statistically and not in direct relation to any of the waste's properties or with respect to the generation of free standing water in the burial condition. The invention uniquely utilizes a process endpoint that (a) is directly related to the waste's free standing water generation characteristics and (b) is oriented towards meeting the free standing water regulations in the burial condition.

The significance of the waste media's pre-dewatering temperature was outlined with reference to the foregoing thermodynamic calculations. Simply stated, the waste media's heat content can provide the energy for evaporating water from the waste. The water vapor subsequently condenses due to the lower temperature at or near the container wall during burial conditions.

The waste media, when in the radwaste hold up tank, is typically in the 80 to 90 degree Farenheit range. Temperatures in the nineties are not uncommon and occasionally occur up to 110° F. After the waste leaves its hold up tank, other factors usually act to lower its bulk temperature. The sluice water is often at a temperature less than the waste. Also, the locations used for dewatering are typically very similar to a warehouse's transportation area, having cold concrete slabs, high ceilings and large, uninsulated transportation doors.

Other than a waste temperature change due to the sluice water, the only other way to affect the waste temperature is by ambient conditions. The waste media, as it sits in the container, has very good self-insulating qualities. Therefore, the ambient conditions can lower the waste temperature only when (a) they differ significantly from the sluiced waste temperature and (b) the waste sluicing flowrate is low and/or in long pipe runs. The ambient conditions obviously can be extreme. Radwaste areas in U.S. nuclear plants in the upper midwest can fall below freezing while in the southeast and southwest temperatures can be above 110° F. The burial temperature is a constant temperature, typically 55° F.

Two entirely different types of bead resins were selected for the qualification test program and processing endpoint determination: a new, unused cation resin of known chemical form that is very commonly used in the industry, and a used anion resin in a fouled and regenerated state. See the following Examples 1 and 2. The new cation resin provided a base data point since all of the chemical and physical characteristics of the new resin were known. The used anion resin represented a worst thermodynamic case. It was fouled with organics and had been subjected to repeated chemical regenerations. The use of the two types of resins provided the following testing/verification advantages: (1) the analytical methods could be verified on a media of known physical and chemical characteristics, and (2) the analytical predictions and process equipment could be proven on a worste case unknown waste form.

The method of this invention preferably utilizes the humidity of container exhaust air and the waste's temperature prior to dewatering as the endpoint parameters. The impact of the waste temperature has been described above in conjunction with Equation 10, and that of the exhaust air humidity in the discussion of vapor pressure equilibriums following thereafter. The system operators will preferably use a direct reading humidity meter 24 (see FIG. 1) to determine the endpoint of processing. Other methods for determining the humidity could also be used. An example would be wet and dry bulb temperature measurements.

The exhaust air humidity versus waste temperature curves for the processing endpoints depend on the specific chemical nature of the resin's adsorbed water solution and the chemical form of the resin itself. This fundamental discovery is a significant advance in the art. FIG. 20 illustrates this interdependence. These curves explain the observed difference in time required to reach the same effective dewatered state in resins that otherwise have the same physical structure. For example, in the testing program it took up to 16 hours to dewater organically fouled anion resins but less than eight hours to dewater hydrogen form cation resin. Similar curves can also be developed for non-ion exchange waste medias as described above.

However, it is not practical to have an endpoint curve for every possible resin chemical form. The expected resin chemical forms can be conservatively simplified into broad categories as suggested by the water uptake curves of FIG. 20 and the above-incorporated Helfferich reference. From that reference, for monoelemental ions the curve shapes are nearly identical within the range of humidity values of concern (90–100%). When multi-elemental ions are considered, the curves are much flatter, and consequently a much lower humidity must be achieved in order to remove the same amount of water. The worst case multi-elemental curve can be selected. Therefore, the general classifications of bead resins are the following:

Group 1: Non-regenerated, or once used, cation or anion resins loaded with or having been treating waters with over 90% of the total water analysis as monoelemental or simple oxide ions. Examples of such ions are the cations Na, Ca, H, Ba, Cu, Mg, Cs, Fe, and the anions Cl, OH, Br, F, I, $NO_3$, $SO_4$, $HCO_3$.

Group 2: Cation resins that have either been repeatedly regenerated or have been treating water with over 10% of the total water analysis as multi-elemental ions, especially detergents and decontamination solutions.

Group 3: Anion resins that have either been repeatedly regenerated or have been treating water with over 10% of the total water analysis as multi-elemental ions (except simple oxides as listed under Group 1, above), especially detergents and decontamination solutions.

Figure 21:
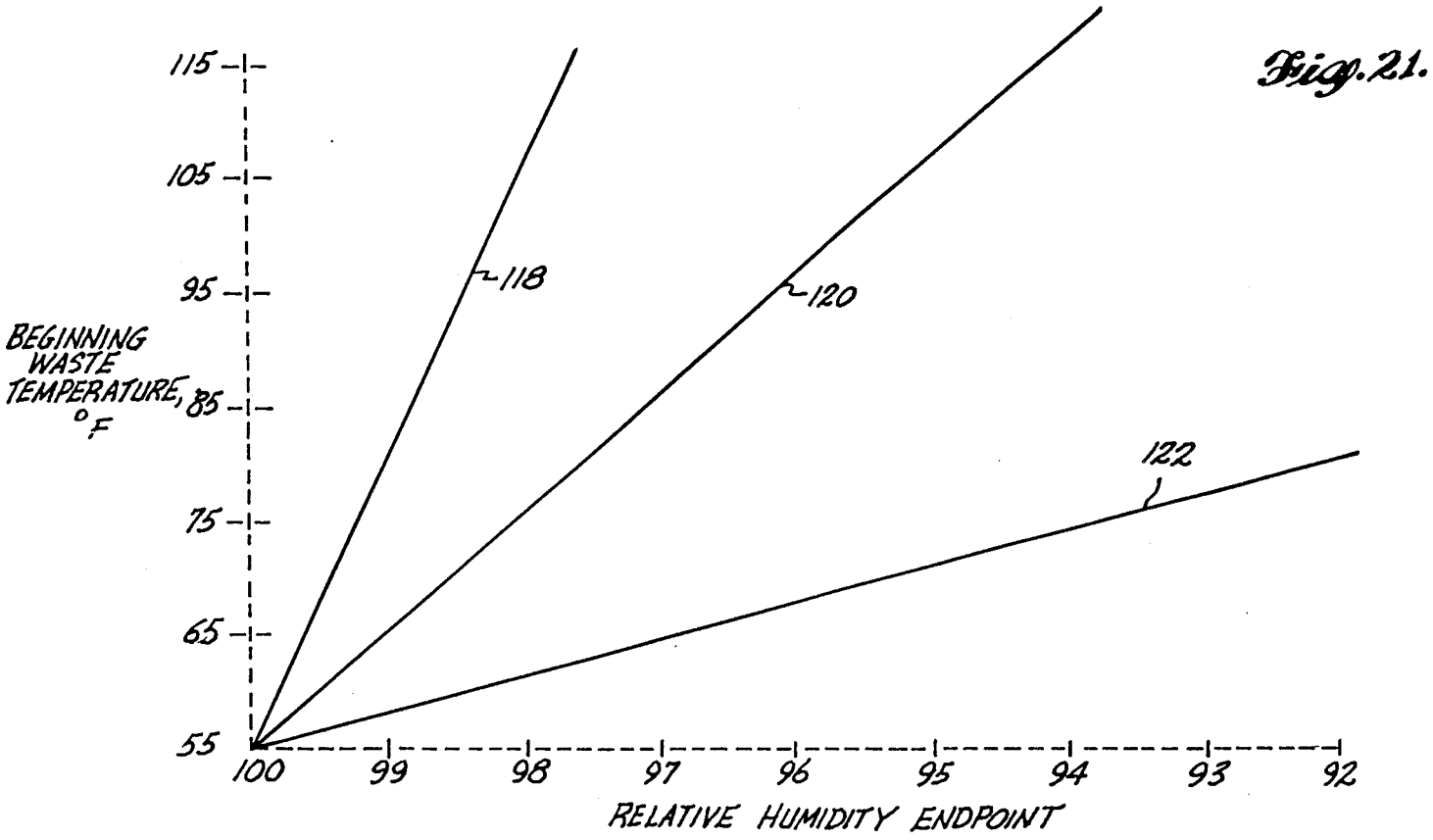
FIG. 21 is a graph that presents typical processing endpoint curves of the present invention.

FIG. 21 presents process endpoint curves that have been derived for the groupings described above, and specifically for those resins that are normally encountered in field conditions: cation capacity less than 2.1 eq./l., anion capacity less than 1.4 eq./l., and all having less than 10% DVB crosslinking. On FIG. 21, the dewatering endpoint curve 118 is applicable to the above-stated Group 1 resins; curve 120 to the Group 2 resins; and curve 122 to the Group 3 resins. It has been conservatively assumed that regenerated resins will accumulate large molecules over their processing time because of the tendency for incomplete regeneration effects and long term organic fouling. The processing endpoints for Groups 1, 2, and 3 resins are stated as functions of beginning waste temperature versus relative humidity of the exhaust air from the container. Knowing the general resin type and the beginning waste temperature one can simply read the relative humidity endpoint from the appropriate curve.

The application of the resin groupings to specific plant processes will be primarily by experience. The nuclear utilities do not have the analytical equipment for determining the full water or resin chemical analysis. Usually the chemical composition of the resin must be determined by the normal operating parameters of the specific process or from a knowledge of the chemicals put into the batch to be treated by the liquid treatment media. When there is uncertainty, then the worst case endpoint curve can be used with certainty. FIG. 21 thus serves as an example of the means to group the waste media's possible characteristics within the limited capabilities of the power plant.

The foregoing discussion on direct humidity endpoints is directly applicable to any fixed bed of rigid solids. In the case of powdered media, the particles are currently not necessarily a fixed and rigid bed, though advances in the art may lead to that condition. For powdered media the humidity readings are used to indicate the end of the saturation point of the media. This is realistic since the interstitial water is removed prior to the media's cracking and sloughing. After that point is reached, the amount of water removed from the media can be measured as it comes out of the water separator. From a knowledge of the proportion of ion exchange resin and the pore diffusion capabilities of the waste structure and the waste particles themselves, the water uptake capabilities of the powdered media can be determined as described above and that water volume then set as the post-drying water separator effluent endpoint.

Drying Effects On Particles

Shrinkage

The drying system depends on water being mechanically or chemically bound on the particles. If the particle has sufficient elasticity, it will shrink when the water is removed. Ion exchange resins are the only liquid treatment media with sufficient elasticity and water volume to provide noticeable shrinkage. Other types of particles (zeolites, activated or nonactivated carbon, diatamaceous earth, etc.) are relatively rigid and do not noticeably shrink upon drying.

Ion exchange resins are long chain polymers crosslinked with other polymers. The pores between those polymers contain the effective chemical groups and strongly desire large scale hydration. FIG. 20 indicates those particular types of cation and anion exchange resins that contain up to 50% and 40% water, respectively. Uncommon new resins or severly damaged resins could contain 75% water. The hydration effect is sufficient to push open the pores between the polymers thereby expanding the particles. This fluid pressure due to chemical density effects is known as osmotic pressure.

The osmotic pressure of ion exchange resins is often above 1300 psi. When ion exchange resins are completely dried, the resins will shrink to about half their fully hydrated size. If the fully dried resins are confined in a standard disposable container, the container's burst pressure is typically less than the resin's osmotic pressure. If sufficient water enters the container the resin volume will increase, and the container may swell or burst. Such a condition may be a personnel, operational or environmental hazard.

A burst container is obviously a personnel hazard. Additionally, a swelled container may not fit into the transport cask. The buried resin may come in contact with trench leach water, swell and then may crack the protective burial trench cap. The electrostatic surface properties of very dry resins create a sticking and conveyance problem. Container swelling is a very real concern when a vent is required on such containers. Very dry resins would adsorb the moisture from the air and swell.

Resinous particles must not be dried too far past their burial equilibrium endpoint. If the ion exchange resins are too dry, then they will excessively shrink. Should burial trench liquids enter the shrunken, unsaturated resins, the resin will swell with great osmotic pressure and potentially crack the burial trench cap. Additionally, if the beginning resin temperature is very high, the conditioning of the resin to the burial condition will significantly shrink the resin. Should the burial container corrode away, the filling of the container void volume with collapsing soil may cause the burial cap to crack. Given these two scenarios, the optimum solution is to just condition the resin to the burial conditions and have the container completely filled.

The drying system only needs to remove sufficient water from the resin to equal the saturated condition experienced by the resin at the burial temperature. Waste volume reduction has a very significant, positive economic and radiation exposure impact. Pursuant to this disclosure, advantages of volume reduction can be realized without incurring unwanted excessive swelling of ion exchange resins. Since the resins are conditioned to be nearly saturated in the burial condition, they cannot swell any further in the burial condition should the container be breached and burial trench leachate reach the resin. The drying system preferably incorporates a very accurate humidity monitor capable of closely resolving the resin water removal to the burial saturation condition. Such resolution precludes overdrying to an extent where volume reduction could be a hazard.

Volume Relation to Moisture Content—The volume change of an ion exchanger with a change in its moisture content is founded in chemical equilibrium reactions and the particle structure. The sources of the volume change are the chemical characteristics found at the adsorption site and the elasticity of the particle matrix. The particle volume will reach equilibrium when the chemical solvation effects are offset by the elastic pressure of the particle.

The strong ion charge of a molecule will attract the polar molecules of the surrounding solvent (in this case the solvent is water). Close to the ion is the water of hydration and sufficiently far from the ion is free water. The distinction is not well defined but it helps explain many phenomena. Ion exchange resins are the only liquid waste treatment particles that exhibit this truly electrolytic solution behavior. The key difference between the solution chemistry of ion exchange resins and an electrolytic solution is that half the resin's ions are in a fixed location. Zeolites, carbon materials, filter aids and the like do not exhibit this solution chemistry and elastic particle behavior.

The literature treats the ion exchange resin expansion effects in two ways. From the overall particle view, the difference in the chemical concentration at the resin interior (near the resin's functional sites) versus the free water at the outside of the resin results in an osmotic pressure effect. The osmotic pressure due to the chemical concentration gradient is offset by the elasticity of the polymer matrix. From the chemical hydration view, water molecules are packed in shells around the resins functional site. The stronger the functional site, the more densely packed the shells of water around the site. The water's desire to densely pack around the functional site then pushes out the elastic polymer until there is an equilibrium between the chemical push and the mechanical restraint.

There are relationships between an ion exchange resin's water content and its volume. Fortunately the relationship is not as dependent on the various chemical and physical characteristics of the resin as are the water uptake curves. The resin volume to water content relationship is independent of the cross-linking of the resin and the hydrogen and sodium form of the resins. The resin volume change with water content is mostly dependent on the electrolytic strength of the functional groups on the resin.

As noted from the endpoint curves shown in FIG. 21, a typical Group 2 resin at 95° F. would have to be dryed until the effluent air is as low as 96% relative humidity. This could result in a volume reduction of up to 7.3%. K. W. Pepper, D. Reichenberg, D. K. Hale, "Properties of Ion-exchange Resins in Relation to Their Structure. Part IV. Swelling and Shrinkage of Sulphonated Polystyrenes of Different Cross-linking," J. Amer. Chem. Soc., p. 3129, 1952. It is important to note this condition is more important when the waste is at a high ambient temperature and has a reasonably steep water uptake curve. This is a considerable economic advantage to the waste generator, as more waste can be potentially added per container. However, not all of the 7.3% shrinkage can be realized since the water from any additional slurry will reswell the part of the container's shrunken resin it contacts. Nevertheless, a few percent change in the resin volume would be significant to the user if it could be utilized. However, if the resin is dryed significantly below the saturated burial condition, the excessive volume reduction of the resin would lead to excessive swelling and resultant environmental hazards in the burial trench.

Pursuant to this aspect of the invention, the processing endpoint is selected to achieve saturated resin in the burial condition without excessive drying/shrinkage. The humidity monitor is accurate to 0.5%, and the waste is preferably not dryed more than 4% below that indicated by the endpoint curves. Up to a maximum of 4% relative humidity below the indicated endpoint curves would result in a potentially swellable resin that is within container freeboard tolerances and waste form discrepancies. Swelling beyond the container volume in the burial condition is precluded. Should the resin be dryed more than 4% below the endpoint corresponding to the saturated burial condition, the swelling volume could exceed 7% of the container volume and that corresponding volume of compressible air in the container freeboard. Swelling in the burial condition (due to the introduction of trench leach water or surface water intrusion into a corroded container or a container vent) would then be excessive. The volume reduction experienced after processing but prior to burial would present a hazard if water (or water vapor more than 4% over the processing endpoint relative humidity) were able to enter the container and the resin was not able to escape.

The resin volume to resin water content relation is well founded. See, for example, K. W. Pepper, D. Reichenberg, D. K. Hale, "Properties of Ion-exchange Resins in Relation to Their Structure. Part IV. Swelling and Shrinkage of Sulphonated Polystyrenes of Different Cross-Linking," J. Amer. Chem. Soc., p. 3129, 1952, expressly incorporated herein by reference. The relation is good across all forms of stored electrolyte resins. The combination of the relative humidity to water uptake relation of the relatively constant slope portion of the curves (above 80% relative humidity) shown in FIG. 20 and the resin volume to resin water content relation gives Equation 10A where the waste volume is in terms of the total container volume and the container's freeboard volume.

$$V_S=(100-\%\ R.H._1)(V_C-V_F)/(1.394\times 62.36) \qquad \text{Eq. 10A}$$

wherein:

$V_S$=additional volume available after shrinkage due to drying, or shrink volume $V_C$=total container volume $V_F$=container freeboard volume % R.H.$_1$=analytic relative humidity endpoint (1.394×62.36)=a constant applicable for resins with strong electrolytic effects, which encompasses the liquid treatment resins of interest.

Equation 10A can be used to determine the tolerance of the relative humidity endpoint in relation to the minimum practical freeboard in any container. The freeboard volume can be considered as a fraction of the container volume. The remaining shrink volume in the container, after completely filling the container with at least saturated resin, must be less than or equal to the freeboard volume. Therefore, the remaining shrink volume can also be considered as a fraction of the container volume. Then Equation 10A takes the form of Equation 11A.

$$F_fV_C = (\%\ R.H._1 - \%\ R.H._2)(V_C - F_fV_C)/(1.394 \times 62.36), \qquad \text{Eq. 11A}$$

or $$F_f = (\%\ R.H._1 - \%\ R.H._2)(1 - F_f)/(1.394 \times 62.36)$$

wherein:

$F_f$=freeboard volume fraction of container volume

% R.H.$_2$=minimum relative humidity endpoint.

The term % R.H.$_1$ is determined from FIG. 21, and $F_f$ is the practical minimum freeboard for the particular container and operating procedures. Then % R.H.$_2$ can be directly calculated. With a realistic freeboard of 3 inches out of a 6-foot bed depth and a mixed cation and anion resin at 95° F., the relative humidity endpoint tolerance, % R.H.$_1$−% R.H.$_2$, is 3.6%. The humidity monitor tolerance of 0.5% is well within this permissible value. For example, if the relative humidity endpoint tolerance, % R.H.$_1$−% R.H.$_2$, is fixed at the monitor tolerance, then the freeboard volume fraction, $F_f$, for a 6-foot bed depth is 0.0057. This freeboard fraction represents less than ½ inch in the largest container. Therefore, it is well under what is practically achievable in real operations. In other words, the humidity monitor (e.g., No. 1100DP, General Eastern, Watertown, MA) has a greater sensitivity than necessary to meet the practical freeboard tolerance.

The added container volume due to shrinkage of the resin during processing can be utilized. Additional resin cannot be simply slurred into the vessel after processing, as the slurry water would bring the conditioned resin back to saturation at the waste temperature. However, a batch of resin, without interstitial water, can be added to the top of the conditioned resin in the container. This batch of resin would usually be less than 7% of the container waste volume, a significant economic benefit but it has little consequential impact on the state of the processed resin.

Packing Efficiency—The users of the drying system report a greater waste volume per container than obtained by competitive art. As demonstrated above, the volume reduction is partially from drying effects. The differences in particle packing between random and ordered structures would account for the remaining volume differences. A theoretical maximum volume difference occurs when spheres are packed in a tetragonal versus cubic arrangement. The percent void volume is 30.19 versus 47.64, respectively, for a nonexpanded bed. Therefore, it is theoretically possible to achieve up to 17.5% volume reduction by going from a cubic to tetragonal arrangement.

The real bed of particles does not consist of uniform size and shape spheres. The ion exchange resins will consist of broken spheres and varying diameters. Zeolites are oblong shaped and consist of dust size up to 800 microns. In practice, the arrangement of a randomly dumped bed of spheres will typically fall somewhere between the cubic and tetragonal arrangements with up to 10% of the particles broken. It is a common practice in packed beds to tap the side of the column while filling. The literature indicates that practice produces a 3 to 5 percent denser particle bed. M. Leva, "Fluidization," McGraw-Hill Book Co., p. 55, 1959. Other literature relates the sphericity of the particles to the void fraction for varying degrees of packing density. D. Kunii, O. Levenspiel, "Fluidization Engineering," John Wiley & Sons, p. 66, 1969. That relation indicates the difference in void fraction, given a typical sphericity for ion exchange resins (0.9), for loosely packed versus dense packed would result in a volume difference up to 7.5%.

After the bulk free water is pumped out, there remains considerable free draining water in the particle bed. That water effectively reduces the void fraction in the bed. As noted in Equation 1, the void fraction term will drastically alter the pressure drop across the particle bed. Therefore, when the blower is turned on, after the free water has been pumped down, nearly a full vacuum is experienced across the particle bed. Current art uses simple pumping that does not effect significant differential pressure resulting in any packing.

It is reasonable that the force applied by the blower to the top of the particle bed will cause the particles to move to a more ordered geometry and also force broken or particle fines into some of the interstices. The result would be a volume reduction greater than the reported 3 to 5 percent. Up to a 15 percent volume reduction has been observed with this drying system, again, without overdrying the resin. The combination of resin shrinkage due to controlled drying and shrinkage due to more dense packing account for this significant volume reduction. The packing efficiency would be greater for oblong or silver shaped particles like powdered resins or zeolites because they would pack alongside of each other. Even a few percent increase in waste volume per disposable container has a significant economic impact.

Conclusion

Thermodynamically, the typical operating region for the dewatering system will easily allow for drying most of the expected resins, and in fact for overdrying them unless the dewatering endpoint is carefully selected pursuant to this disclosure. Tracing the origins and specifications of the plant resins will assure operations within the system's thermal capabilities. The method of the present invention has addressed "atmospheric" conditions within the waste media bed because it has been found to definitely contribute to free standing water. Prior art test programs have incorrectly concluded that atmospheric factors (thermal/vapor/condensation effects) are not significant. The effect can be easily masked by fluid dynamic problems and the very low thermal conductivity of the resin and air.

Powdered media follows the same principles of fluid dynamics and thermodynamics as granular media. However, the dewatering design purpose is different since powdered media structurally differs from granular media but does not significantly differ within the specific waste type like granular media. For example, ECODEX does not get as beat up as condensate polisher bead resins and there are relatively not as many different types of powdered treatment media. An initial water flow design is used prior to an evaporative drying step. The consistency of the waste form is counterbalanced by the randomness of the cracking of the resin after free water removal. The residual free water which may be present after the initial water flow removal, or generated by condensation, is successfully evaporated or reabsorbed by the same mechanism as in bead resins.

The design and testing was based on ion exchange resins since they are the primary market. For example, the representative endpoint curves in FIG. 21 were derived for ion exchange resins as stated above. However, the calculations and methodology described herein also apply to other treatment media such as activated carbon and inorganic zeolites. The fluid dynamic factors used for ion exchange resins, including flow, voidage, solids, size, and shape are also applicable to other treatment media. The thermal methodology and endpoint determination process described above are also directly applicable to other forms of treatment media. The test techniques used on the ion exchange resins can be duplicated on other media such as carbon, zeolites, and sludges.

It should also be emphasized that the aforementioned liquid treatment media can be successfully dewatered by cooling the waste slurry to the expected burial temperature prior to applying the above-stated fluid dynamic principles and methodology. For example, the media could be contacted with chilled water or with refrigerant coils prior to mechanical dewatering as described above. In this way, the wastes can be preconditioned so that the condensing cycle—as defined and quantified for the first time herein—will be inhibited down to the burial temperature.

In summary, the method and apparatus of this invention are based upon a multiplicity of innovations that significantly advance the art. These innovations include the following:

1. The application of fluid flow calculations through a bed of solids. The physical characteristics of the solids are taken into account.
2. The use of item 1 to determine the number and arrangement of collectors in the container.
3. The use of item 1 to define the inlet conditions of the collectors.
4. The determination of the minimum fluid flow through a bed of solids to effect full removal of interstitial water.
5. The design of the collectors to effect uniform flow through the cross section of the particle bed. The precise size and pressure drop of the orifices and the flow in the conduits are balanced together.
6. The use of a flow interrupter at the container wall to preclude preferential channeling of the drying airstream down the container walls.
7. The waste media is dried below its water saturation point such that it will readsorb any generated free water.
8. Item 7 is precisely achieved to correspond to the waste media's long term burial conditions.
9. The processing endpoint for items 7 and 8 can be determined from direct readings of the container exhaust air humidity. Alternatively, the volume of water removed from the media after the drying cycle begins can be used to precisely define the processing endpoint.
10. The processing system is a closed loop. The water separator simultaneously keeps the air below temperature limits, condenses water from the air, and removes the entrained water from the airstream.
11. The blower circulates and heats (dehumidifies) the air. The dehumidified air dries the waste particles. While airflow from the container top region through the container bottom region has been described herein, the drying airstream can alternatively be passed through the manifold into the slurry, and the humidified air that has passed through the slurry can be exhausted from the container top region.
12. The waste chemical form to dewatering endpoint relationship is defined.

Various adaptations can be made without departing from the scope of this disclosure to streamline the calculation sequence and concurrently increase the efficiency of the system. Such an improvement in the system efficiency would necessarily change the position and/or shape of the operating region. Representative of such adaptations are the following:

1. Add an upper distributor such as manifold 40 to the container. Plug flow would be initiated by the upper distributor rather than sufficient pressure drop at the particle upper surface.
2. Determine the fluid pattern around a distributor orifice, and then directly calculate the lateral spacing, orifice spacing, and the orifice pressure drop.
3. Precisely calculate the orifice coefficient of discharge from the orifice Reynolds number by curve fitting the relationship.
4. Directly calculate the minimum required airflow from the velocity head relationship.
5. Eliminate the inefficiency due to air flowing laterally to the collector laterals by using a full cross-sectional distributor such as perforated plates or screens.
6. Directly calculate the lateral diameter that corresponds to the maldistribution criteria and then directly calculate the lateral to orifice diameter ratio.

7. Generate water uptake versus relative humidity curves for all liquid treatment media, thereby obviating the less convenient water removal measurements.

The result of such adaptations would be a direct calculation of a specific collector configuration and a substantial increase in the effectiveness of the drying air. The disclosed system size and cost can thereby be reduced concurrently with less processing time.

The following examples are presented to illustrate the dewatering method and apparatus of the present invention and to assist one of ordinary skill in making and using the same. The following examples are not intended in any way to otherwise limit the scope of this disclosure or the protection granted by Letters Patent hereon.

EXAMPLES

Numerous small scale tests were conducted in order to determine the initial full scale design and operating parameters. Such tests were made to determine maximum conduit spacing, particle size distribution, drying effects, and column tests. Many full scale tests were conducted using prototype equipment in order to establish the design and operating parameters that have been described above.

There are several procedural steps prior to the processing of waste or testing materials. The first step is to conduct a preliminary waste characterization. Most often this is conducted prior to the equipment arriving at a power plant, and it consists of a questionnaire. The questionnaire insures that the waste to be processed is within the operating bounds of the container piping and the processing equipment. If it is not within those bounds, then the system is modified as described in the Calculations section to accommodate the abnormal waste conditions. Once the equipment is at a power plant, it is thoroughly inspected for damage, especially the container's internal dewatering apparatus. Shortly after the equipment has been set up, it is functionally tested without waste for the purpose of discovering any operating problems. The last pre-processing step is to confirm the nature of the waste, the expected radioactive fields, coordinate the waste transfer methods, and confirm all mechanical and personnel safety features and valve settings.

EXAMPLE 1

Unregenerated cation ion exchange resins with monoelemental chemistry were processed. The resin was known to be of relatively undamaged and, therefore, nearly uniform spheres of 0.0256 inches average size, in the sodium form, with 8% crosslinking and 45% water content.

A 200 cubic foot capacity container with a six-foot particle bed depth was used. An air space of approximately six inches was left above the top of the slurry bed. Structural steel skids containing the water separator, blower with filter, and control valves were situated near the waste container. Four-inch diameter hoses were used to interconnect the container, water separator, and blower. One hose was connected from the container vapor outlet port to carry the container water and exhaust air to the inlet on the water separator. Another hose was connected from the water separator outlet to carry the dried air to the inlet of the blower. A third hose was run from the blower outlet filters to the container air inlet port.

The water separator was a two-foot diameter by five-foot high stainless steel vessel with a flanged top. The water separator contained a heat exchanger evaporating a compressed refrigerant for cooling the air. As shown in FIG. 1, the coil 98 was located under the water level at the separator bottom. The exhaust air from the waste container entered underneath the chilled water level. The cooled air rose to the top of the separator after passing through a demister pad 100. The demister pad 100 is stainless steel wool that drops the entrained water out of the air by impingement. A two-inch hose drained surplus water from the water separator, under suction from a three-inch diaphragm dewater pump, to a nearby floor drain.

A stand alone, five ton refrigeration unit on the order of 30,000 B.T.U. was located next to the water separator. Inlet and outlet refrigerant lines recirculated the refrigerant from the refrigeration unit through the water separator.

The blower was a 30 horsepower rotary vane blower (average 250 SCFM).

The hose connections at the waste container were on a fillhead that rested on the container opening. The fillhead was fabricated from stainless steel plate and sheetmetal and contained all of the connections between the exterior and the interior of the container. The fillhead also contained waste shut off valves, a TV camera, radiation sensors, and container waste level instrumentation connections, all conventional.

The flat-bottomed container used to dewater these bead resins had a single level vapor collector manifold at the container bottom, as shown in FIGS. 6 and 7. The header was a three-inch plastic pipe, and the lateral conduits were three-quarter inch plastic pipe that had been through-drilled to provide one-quarter inch orifices at approximately four-inch intervals along both sides of each lateral conduit. The orifices were screened with a coarse screen (Naltex Flex Guard III) surrounding a 100-mesh screen (McMaster-Carr). The lengths of the conduits on each side of the header, listed moving away from the open end of the header were: 17.75, 23.75, 27.75, 30.00, 31.50, 32.00, 31.50, 30.00, 27.75, 23.75, and 16.00 inches, with the conduits spaced 5.62 inches apart. This container also had an annular ring 72, in this case made of one and one-half inch pipe, affixed approximately midway down the inner sidewall.

Power, air, water and instrumentation connections were made prior to receiving waste into the container. These connections included water high level switch in the water separator, temperature sensor at the blower, camera cables, waste level sensor lines, and blower and refrigeration unit power cables, and dewater pump air line.

The cables with control or monitoring functions led to a free standing control panel. It is advantageous to have the control panel free standing such that it can be located outside of high radiation zones thereby reducing the operator's exposure. The panel contains ON/-OFF switches with or without an AUTO function for the blower and refrigeration units. The panel also includes blower exit and container inlet temperature indicators with high limit switches, emergency shut off switch, radiation monitor, status lights, and the television monitor. After all of the preliminary check offs, the system is ready to receive the waste.

Once the operator received the go-ahead to prepare to receive the ion exchange resins the fillhead TV, radiation monitor, level switch circuitry, and the dewater pump were turned on and their-performance double checked. Plant personnel were notified that waste transfer is going to begin. The operator remotely opened the waste influent port in the fillhead. The waste entering the container was observed on the TV monitor. The waste was a slurry of water and ion exchange resin of the above-stated composition. This slurry was at 80° F. as it entered the container. The dewater pump removed the slurry water through the bottom vapor collector manifold at a rate faster than it entered. The pile of resin easily flattened out across the container bottom. As the resin level rose toward the top of the container, a high level switch indicated a warning at the panel. The operator could also notice the level via the TV monitor. At this point a waste inlet valve in the waste influent port was open and shut, in coordination with the plant personnel, to allow the last increments of waste into the container bottom region. The operator had the option of turning down the dewater pump to allow water to rise to the top of the resin in the container to aid in letting the resin bed flatten out under the container top region. When the container was as full as possible, leaving only an airspace of approximately six inches in the container top region, the waste influent port was secured shut after draining the line.

The dewater pump continued to operate after waste transfer was completed. The dewater pump then removed the bulk of the interstitial water in less than 25 minutes. Thereafter the water eminating out of the dewater pump hose tapered off to a small trickle. The refrigeration unit was turned on and the blower shortly thereafter. As soon as the blower was turned on the dewater pump discharge hose was flooded with water. (The sudden draw on the residual interstitial water is occasionally so sudden that the high level switch in the water separator kicks off the blower.) In five to ten minutes the dewater pump discharge hose effluent tapered off to a trickle. At this point less than 35 minutes had elapsed, and the waste was already at the equivalent dewatered point of several days processing with prior art systems.

After about 45 minutes elapsed time the differential pressure across the resin bed had tapered off to a steady state value (within a few hundredths of a PSI predicted by the analytical methods summarized above with reference to the curves on FIG. 16 and the test point 114 on FIG. 17) corresponding to all air flow through the resin. This point corresponds to the prior art's ideal capabilities. Actual drying (removal of adsorbed water) of the resin had begun. The trickle of water leaving the dewater pump discharge hose thereafter was condensed water originating from the resin. Within one hour from the beginning it was noticed on the TV monitor that the ion exchange beads on the top of the resin bed were significantly smaller, lighter, and tending to swirl around the inside top of the container. From the testing program it is known that the light resin at the top is a result of contact with less than 10% relative humidity air. The resin only an inch below the light resin was still nearly saturated with water at this beginning of the drying cycle.

The operating conditions were maintained nearly constant from the one hour point to the five to six hour point. The trickle of water out of the dewater pump discharge hose and the air's differential pressure across the resin were observed to be nearly constant. Wet and dry bulb measurements or direct humidity readings showed 100% relative humidity in the exhaust air from the container. Near the six hour mark the relative humidity readings started to gradually drop below 100%. The appropriate process endpoint curve 118 on FIG. 21 indicated, as explained above, that the humidity should read below 99% for such unregenerated cation resins containing more than 90% monoelemental ions and at 80° F. This endpoint was reached during the seventh hour and the system was shut down at the end of the eighth hour.

An overhead crane removed the fill head from the container. A permanent lid was immediately installed on the container opening to prevent the possibility of air at greater than the endpoint relative humidity from resaturating the resin. Once the permanent lid was affixed, the container was ready for shipment to an approved landfill for permanent storage.

As a test, the dewatered resin in this Example was allowed to cool until its core temperature was less than the normal burial temperature of 55° F. To effect a core temperature of less than 55° F., the outside of the container was necessarily less than 55° F. No free standing water generated from the container until a core temperature of less than 45° F. was attained. The fact that the threshold temperature was 10° F. less than predicted is due to the conservative nature of the Calculations and equalization with the super dry resin at the top of the resin bed.

EXAMPLE 2

Anion ion exchange resins were dewatered. These resins had been regenerated, with slight degree of resin breakage, and had an average diameter of 0.02463 inches, about 55% adsorbed water, plus a high visible degree of large organic molecule fouling its adsorbed water. This resin represents the worst type of resin to be encountered.

The waste prescreening, equipment set up, equipment check out, functional testing, preoperational coordination with power plant personnel, and start up were as described in Example 1. This anion resin was processed identically as the cation resin in Example 1. As with the cation resin, the pressure drop through the resin was predicted by the analytically derived performance curves to within a few hundredths of a PSI. The resin was dewatered at 80° F. The relative humidity endpoint predicted by the appropriate processing endpoint curve 122 on FIG. 21 was about 92%. It took about 15 hours of drying to reach the endpoint for this anion resin. After the humidity endpoint had been achieved, the generation of free standing water was similar in nature to the cation resin cited above. Here again, the regulatory limits set by 10 C.F.R. Part 61 were met.

EXAMPLE 3

Powdered media was dewatered. This media was a mixture of combined cation and anion powdered ion exchange resins with a cellulose-based filter aid. The effective size of the media was 0.002 inches. All powdered media is unregenerated, typically containing monoelemental ions in the absorbed water, and of consistent, uniform size. The narrow and consistent physical characteristics of powdered media simplify the application, but the nonuniform structural nature of the media bed in the container complicate the application with respect to its cracking after interstitial water is removed.

The waste prescreening, equipment check out, functional testing, preoperational coordination with power plant personnel, and start up were the same as described in Examples 1 and 2. The only difference in the equipment set-up was that a tiered series of vapor collector manifolds as shown in FIG. 9 was provided in the container bottom region. The four vapor collector manifolds were positioned 6.0, 23.25, 40.5, and 57.75 inches, listed lowermost to uppermost, above the container floor. An annular ring was not provided. The conduits and headers were through-drilled at two-inch intervals to produce alternating side-to-side and top-to-bottom orifices. The orifices were screened with one micron filters (Hytrex). Four one and one-half inch hoses interconnected the vapor collector manifolds and the water separator.

As the waste media was sluiced into the container the dewater pump removed the excess water through the uppermost vapor collector manifold. This method allowed for maximum compaction of the waste into the bottom of the container. After the media bed reached the top collector, additional waste was introduced in an intermittent fashion until the container was apparently completely filled. The waste influent port was then secured shut.

Valves to the vapor collector manifolds were opened sequentially, from the uppermost to the lowermost, as the vacuum at each manifold reached approximately 25 inches of mercury. This point was selected as a reasonable maximum vacuum capability of the dewater pump. The valves to the manifolds were then closed sequentially from uppermost to lowermost as the vacuum at each manifold fell to approximately five inches of mercury, at which point the vacuum drop off was observed to plateau. During this process most of the interstitial water was removed. Observation of the TV monitor showed that the surface of the particle bed had begun to crack. At this point approximately 40 minutes had elapsed since the dewatering process was initiated.

Then the blower was turned on. A momentary rush of water entered the water separator and thence exited from the dewater pump discharge hose. Within 30 minutes, the vacuum level at the water separator stabilized at approximately 11 inches of mercury. Over the course of the eight-hour test the vacuum level at the water separator gradually dropped to ten inches of mercury. System operating parameters were monitored over the full course of the test. After eight hours of continuous operation the system was shut down. The container was sealed, a low point drain valve opened, and the container was allowed to cool. The container was monitored for drainage of free standing water over the period of the next ten days as it was allowed to cool to burial condition or below. No free standing water developed.

EXAMPLE 4

A comparative test with the best prior art system and procedures was conducted using the cation resin of Example 1. The container was of the same type and configuration as used in Example 1, except that it was fitted with a conical bottom and a hub and lateral type water collection system, similar in all aspects to prior art systems.

The resin bed was heated to a temperature of approximately 95° F. in order to duplicate typical power plant conditions. Temperature sensors were placed at the center of the resin bed and along the resin perimeter.

Following the standard operating procedures for prior art systems, suction was maintained on the container water collection system eight hours a day for a period of three days until the volume of water pumped from the container over the course of eight hours was less than five gallons. The container was then allowed to cool to a core temperature of less than 55° F. in order to duplicate burial conditions. A total of approximately 40,000 ml (10.5 gallons) of free water drained from the container. This volume of water represents approximately 0.75% of the total container contents, exceeding the one-gallon criteria for disposal at the Hanford disposal site, the 0.5% by volume free standing water requirements for carbon steel containers at the Barnwell disposal site, and nearly exceeding the 1.0% criteria for high integrity containers at the Barnwell facility.

It should be noted that the comparison test was conducted using resins which were the easiest to dewater. Had the tests been conducted using spent, regenerated resins the 1.0% criteria would probably have been exceeded as well.

EXAMPLE 5

The invention can be practically applied across a wide variation of particle characteristics and container configurations. Those variables can be within or outside of the representative operating region presented in FIG. 16. A practical application of applying the calculation sequence to functional equipment follows.

Design Calculation Sequence

Fixing the particle characteristics, or range of characteristics, is prerequisite to the design of a system. Referring to Equation 1, the following particle, container, and fluid characteristics are fixed for the granular media application:

$D_p$=average particle diameter
e=interstitial void fraction
s=solid shape factor
L=depth of solids
T=air temperature.

The average particle diameter, $D_p$, is determined from original vendor data, a sieve analysis, or a direct particle size count. It is required, and typically achievable, that the utility's particle storage tank deliver the particles to the dewatering container in a manner such that the particle size distribution is homogeneous. Even pressure drop and, therefore, even air distribution are dependent on a homogeneous distribution of the particle size. The interstitial void fraction, e, and solid shape factor, s, are determined from published data for analogous particles of similar shape. An example of such published data can be found in the reference for Equation 1.

The selection of the solids depth, L, is dependent on the container size. The selected air temperature, T, is usually the beginning solids temperature. The heated air from the blower, at the start of the operation, is rapidly cooled nearly to the particle temperature. In fact, some evaporative cooling effects may be noticeable. A maximum temperature of 120° F. is checked since the maximum air viscosity and, therefore, the maximum pressure drop occurs at that maximum temperature. The container inlet air pressure is typically held constant at slightly below atmospheric pressure (for containment of airborne radioactive particles within the system).

Several other items are specified at the start of the calculation sequence:

1. The container diameter.
2. The inlet airflow rate at standard conditions.

3. The number of collector branches (lateral connection points).

4. The spacing between lateral orifices.

The air molecular weight, M, the gravitational constant, $g_c$, and the gas constant, R, are constants. The compressibility factor, z, is essentially equal to one (1) at near atmospheric pressures. Now all the factors are given for determining the particle bed pressure drop, or more precisely the absolute pressure at the bottom of the particle bed.

The vessel cross-sectional area, empty vessel cross-sectional air velocity, and the air viscosity at temperature T are determined. Then the modified Reynolds number per Equation 2 can be calculated. The modified Reynolds number and the plot shown on FIG. 15 are used to read off the modified friction factor, $f_m$. Only the laminar flow range of FIG. 15 is used in virtually all applications. However, if operation were to take place in the transition or turbulent range, then the exponents to the (1−e) and s terms of Equation 1 would need to be modified according to the reference.

Now all of the variables in Equation 1 are known, and the absolute pressure at the bottom of the particle bed can be determined. The particle bed pressure drop is divided by one velocity head, $V^2 2g_c$, to give $h_v$ (see Eq. 7) and determine if the airflow has a sufficient number of velocity heads to achieve the minimum requisite fluid flow through the particle bed; that is, $h_v$ must be greater than or equal to $H_{MV}$.

Given the number of collector branches, the container diameter, and assumptions on installation clearances (e.g., provision for endcaps 76) the total container length of laterals can be determined. Since the orifice spacing is specified, the total lateral length divided by the orifice spacing will give the total number of orifices on the collector. The airflow rate divided by the total number of orifices will give the airflow, w, for one orifice. Now the orifice diameter to pressure drop relationship can be determined.

Referring to Equation 3, the orifice flow rate, w, and the gravitational constant are known. The orifice coefficient of discharge, C, is virtually constant (0.63) for most applications and varies by less than 10% for orifice to lateral diameter ratios less than 0.5. The expansion factor, Y, is equal to one (1) for virtually all real applications. The full determination of the expansion factor can be found in the reference for Equation 3. The orifice upstream pressure, $p_2$, is equal to the pressure at the bottom of the particle bed. The air density at the orifice entrance, $\rho_1$, is corrected for the reduced pressure at the bottom of the slurry bed. The orifice to pipe lateral diameter ratio, $\beta$, is raised to the fourth power and has little effect for a ratio less than 0.5. Therefore, the ratio can be arbitrarily fixed at 0.25.

All variables are given, or derived, for Equation 3 except the orifice downstream pressure, $p_1$, and the orifice cross-sectional area, $A_2$. A set of orifice areas, and thereby the orifice diameters, are found for a set of orifice pressure drops. The orifice diameter can be selected that corresponds to an orifice pressure drop that is compatible with the overall mechanical system. The set of orifice diameters, lateral diameter and pressure drops can be altered to suit the overall mechanical system by changing the number of collector branches and/or the orifice spacing. However, the distribution criteria cannot be altered. The number of branches and orifice spacing cannot result in a greater open area between orifices than the test configuration used to find the minimum number of velocity heads.

The selection of the proper orifice diameter and pressure drop is aided by the maldistribution criteria. If it is greater than 5%, another orifice configuration is required. The maldistribution number for each orifice to pressure drop relationship is derived from Equations 4, 5, and 6. If the maldistribution criteria exceeds the minimum, then the collector can be altered as described above.

Design Application Example

Given—The media to be dryed is a zeolite with an average diameter of 450 microns. The particles are oblong with a rough surface; therefore a shape factor of 0.8 is selected. The container is 48 inches in diameter and the same in height. Six collector branches are subjectively selected in relation to the test case, with drilled through orifices on 2 inch centers. The collector lateral's inside diameter is 0.5 inches. The inlet airflow is 100 SCFM based on a ratio of the vessel cross-sectional area between the test vessel and the new vessel application. The air temperature is 70° F.

Calculation—The calculation sequence follows the rationale outlined above. The key results are the following:

1. The number of particle bed velocity heads is 57.9.
2. The total number of orifices on the collector is 209.
3. The pressure at the bottom of the particle bed is 11.44 psia; therefore, the bed pressure drop is 3.23 psi.
4. To achieve less than 5% maldistribution along the collector laterals, the orifice pressure drop must be greater than 0.2 psi and less than the difference between atmospheric pressure and the sum of the pressure drop across the bed of solids and the orifice pressure drop; e.g., less than (14.7−3.23−0.2)=11.24 psi.
5. The orifice diameters vary from 0.08 to 0.058 inches as the orifice pressure drop varies from 1 to 5 psi.
6. If a 2 psi pressure drop were selected, the maximum and minimum collector flow would be 254 and 43 SCFM, respectively, for 0.112 inch diameter orifices.

Conclusion—The calculated system is a conservative approach to drying the zeolite. The flow rate could be reduced to the minimum number of velocity heads. A simple ratio of the vessel cross-sectional area and flow rate in the test case to a new application does not take into account the different characteristics of the air and particle bed. However, because the test case used particles on the upper end of the expected size range, a ratio method is conservative.

The thermodynamic section of the application is applicable to ion exchange resins. To this example using inorganic zeolites the water uptake curves, FIGS. 19 and 20, and the resultant operating curves, FIG. 21, do not apply, as the water in the zeolite is held in its pores by a mechanism that is less chemical and more due to capilary action. Nevertheless, the attraction of water to the zeolite is amenable to measuring the zeolite's water uptake for various relative humidities. That water uptake test can be completed or the full size container (with the zeolite in its worst thermodynamic case) can be repetitively dryed, while noting the humidity endpoint, and cooled to the permanent storage temperature until there is no water drainage. The latter method is more economical for specific applications on materials for which water uptake curves do not exist.

EXAMPLE 6

Zeolite Heat Capacity Determination

An aluminosilicate zeolite similar to the mineral chazabite (e.g., Linde IE-95, Union Carbide) is frequently used for selective removal of cesium and strontium from water. The zeolite is oblong shaped and around 20 by 40 mesh or an effective diameter of 450 microns. The porosity of the zeolite is about 45 percent of the particle volume, and the bulk dry density is 42 pounds per cubic foot. The molecular weight of water ($MW_{H2O}$) is 18, and for the applicable aluminosilicate zeolite ($MW_{Zeo}$) it is 380. The heat capacities for water and the dry zeolite are 1 and 0.2 Btu/Lb.F°. It is assumed the entire pore volume of the zeolite is filled with water. Therefore, for a one cubic foot basis, Equation 21A (see below) is used and the variables are found as follows:

$$\text{Dry Particle Density} = (\text{Dry Bulk Density})(1 - \text{Void Fraction}) \qquad \text{Eq. 12A}$$
$$26 = 42(1 - 0.38)$$

$$\text{Zeolite Weight} = (\text{Zeolite Volume})(\text{Dry Particle Density}) \qquad \text{Eq. 13A}$$
$$26 = 1 \times 26$$

$$\text{Particle Volume} = (\text{Bulk Particle Volume})(1 - \text{Void Fraction}) \qquad \text{Eq. 14A}$$
$$0.62 = 1(1 - 0.38)$$

$$\text{Particle Water Weight} = (\text{Particle Volume})(\text{Pore Fraction}) \times (\text{Water Density}) \qquad \text{Eq. 15A}$$

$$17.38 = 0.62 \times 0.45 \times 62.3$$

$$\text{Moles Water} = M_{H20} = \text{Particle Water Weight}/MW_{H20} = 17.38/18 = 0.96 \qquad \text{Eq. 16A}$$
$$\text{Moles Zeolite} = M_{Zeo} = \text{Zeolite Weight}/MW_{Zeo} = 26/380 = 0.068$$

$$\text{Total Moles} = M_{H20} + M_{Zeo} \qquad \text{Eq. 17A}$$
$$1.03 = 0.96 + 0.068$$

$$\text{Water Mole Fraction} = X_{H20} = \text{Moles Water/Total Moles} \qquad \text{Eq. 18A}$$
$$0.93 = 0.96/1.03$$
$$\text{Zeolite Mole Fraction} = X_{Zeo} = \text{Moles Zeolite/Total Moles}$$
$$0.066 = 0.068/1.03$$

Referring to Equation 21A below, note the terms relating to the chemical salts in the adsorbed water. Since only ion exchange resins possess a nearly true electrolytic solution in the adsorbed water, the terms $X_{Chem}$ and $C_{PChem}$ do not apply to zeolites. This assumes the zeolites have been treating water that is very dilute in disolved solids; otherwise the dissolved solids would have to be accounted for in the absorbed water's head capacity, $C_{PH2O}$. Inserting the values outlined above into Equation 21A gives the following results:

$$C_{PPart} = (0.93 \times 1) + (0.066 \times 0.2) = 0.943 \text{ Btu/lb.-°F.} \qquad \text{Eq. 19A}$$

EXAMPLE 7

Zeolite Water Uptake

The object of the foregoing heat capacity calculations is to determine how much adsorbed water is available for condensation in the disposable container in the burial condition. Ideally, there would be a plot of relative humidity versus the zeolite water content over various adsorbed water chemical compositions. Then the humidity process endpoint can be determined directly. This cannot be accomplished for most non-ion exchange particles.

If an ion exchange resin were the object of the heat capacity determination, there are several methods for determining the solution chemistry. The methods for determining the mole fraction and mixture heat capacity would be the same. The chemical molar fraction can be determined from the concentration of functional sites on the resin and the number of hydratation shells around those sites. If the number of hydration shells is not known, then a judgement of the chemical concentration in the adsorbed water can be made from the functional site concentration. The judgement can be based on experience, analogous corrosion potential, equilibrium chemistry, the consistency of the heat capacity over varying chemical concentrations, or other methods. The heat capacity of the resultant chemical solution can be found in tabulated data.

However, a zeolite does not have the electrolytic solution characteristics of ion exchange resins, but to a much lesser extent possesses hydrated layers. The hydrated layers of a zeolite are at the particle matrix surface, as compared with being much more tightly located at the functional sites of an ion exchange resin. Because of the profound chemical differences of zeolite hydration versus functional site hydration, it is not expected that chemical composition differences would be significant for the vast majority of waste zeolites. While zeolites possess some chemical hydration characteristics, like other non-ion exchange particles, the majority of the adsorbed water is present due to pore diffusion.

The first step of determining the process endpoint is the same for all particles. That step is finding the total amount of water that must be removed from the slurry bed. The volume of water is found from Equation 10 and generalized as follows:

$$Q_{Part} = V_{Part}\rho_{Part}C_{PPart}(T_{Part} - T_{\infty}) \qquad \text{Eq. 20A}$$

where the variables are the same as for Equation 10 but generalized for any type of particle. The variable $T_{\infty}$ is the ultimate ambient temperature, which is typically the burial temperature of 55° F.

The process endpoint is simply when the total amount of adsorbed water is collected from the discharge of the water separator. The invention provides a method of determining when to start the measurement of that water, i.e., when the system has finished removing the interstitial water and beginning to remove adsorbed water. When the mechanical resistance of removing the interstitial water has ended, thermal energy is then required to remove the adsorbed water as indicated by the humidity monitor. When the humidity monitor begins to fall below 100 percent relative humidity, then the humidity/water vapor energy gradient from the drying air to the surface of the adsorbed water is the signal that a thermal energy difference has begun and the mechanical actions ceased.

Determining the total amount of water to be removed is a basic psychrometry problem. The conductive heat loss of the container in the burial condition is assumed to be negligible. While such a heat loss would be measurable, it is not a large factor at the time of burial for most waste form temperatures. The insulating capabilities of the particles was qualitatively observed during the system tests. The enthalpy of evaporating the adsorbed water into the container of air is assumed equal to the enthalpy of condensing that water on or near the container wall.

The dry bulb air temperature in the container, prior to processing, is equal to the beginning bulk waste temperature. The beginning bulk waste humidity is at saturation. Those two conditions of the bulk waste represent a point on the psychrometric chart (see FIG. 18) termed the container exit/water separator entrance. That point moves down and to the left of the saturation line or processing progresses. The condition of the disposable container, when buried after sufficient time, is preferably near the burial temperature on the saturated air line.

The beginning and ending enthalpies of the air/water mixture can be read off of the diagonal lines 5 on the left side of the chart. Each point also corresponds to a water content value that can be read off of the vertical axis 6 found on the right of the chart. The water content difference divided by the enthalpy difference gives the number of pounds of water per Btu. Note the pounds of dry air terms cancel each other. This value multiplied by the heat content of the particles, as found in Equation 20A, results in the poundage of water potentially available for condensation if it were not removed from the particles.

For example, if in the disposable container there are 100 cubic feet of zeolites that are saturated at 80° F., from Equation 20A the calculated heat content of the zeolite in the disposable container is:

$$Q_{Part}=100\times[42\times(1-0.38)]\times0.943\times(80-55)=61,389 \text{ Btu.}$$

The enthalpy of the vapor at 80° and 55° F. is respectively 43.7 and 23.2 Btu per pound of dry air. The corresponding water content of the vapor at those points is 0.022 and 0.0093 pounds of water per pound of dry air. Then the number of pounds of water available for condensation is the following:

$$61,389\times[(0.022-0.0093)/(43.7-23.2)]=38 \text{ pounds.}$$

This is equivalent to about 4.5 gallons of water. This amount of adsorbed water would, if it were not removed from the particles, condense in the burial condition and exceed the regulatory limits for certain container types and burial sites. The amount of water exiting the water separator would be measured. The beginning waste humidity reading would be just below 100% relative humidity and noted at the time the 4.5 gallons began collection. The entire container could be cooled to 55° F. to verify that no free water is generated. Several of these points would lead to processing endpoint curves like those derived for ion exchange resins.

EXAMPLE 8

Thermal Application Design

Successfully drying particles depends on thermally removing sufficient water to preclude free standing water formation in the burial condition. There are two methods used for determining the process endpoint. The difference between the two methods stems from the existence of water uptake data (water content versus humidity of contacting air) for the particle type. If the data exists, then a purely quantitative method is used. This is the case with most applicable ion exchange resins. Such data may not exist for specialty resins, zeolites, carbons, and filter aids. For these particles the humidity endpoint can be determined by direct test on the full scale system. Either method for determining the process endpoint is applicable only to the removal of adsorbed water.

Quantitative Thermal Design Application

A particle will be a mixture of three materials: relatively pure water, chemicals in the water, and the substrate holding the water and chemicals. The heat capacity values for each pure substrate are usually well documented. However, the heat capacity value of the particle mixture usually is not documented. The mixture heat capacity can be proportioned from the components by using molar fractions of the component heat capacities. The mixture heat capacity is determined from Equation 9 and generalized for all applicable materials as follows:

$$C_{PPart}=X_{H2O}C_{PH2O}+X_{Chem}C_{PChem}+X_{Sub}C_{PSub} \qquad \text{Eq. 21A}$$

wherein $C_{PPart}$ = heat capacity of particle mixture $X_{H2O}$ = molar fraction of water adsorbed in the particle $X_{Chem}$ = molar fraction of chemical salts in the particle $X_{Sub}$ = molar fraction of the particle's substrate $C_{PH2O}$ = heat capacity of water adsorbed in the particle $C_{PChem}$ = heat capacity of chemical salts in the particle $C_{PSub}$ = heat capacity of particle substrate.

Determining the boundary and, therefore, the molar fraction of water and the chemical solution is not clear cut. For example, there is a certain degree of hydration and ion disassociation around the ion exchange groups. At what distance from the ion exchange group is the solution considered a chemical solution or reasonably pure water? There are several ways to answer this question. They are:

1. Consider the entire solution to be a dilute chemical solution. In other words, there is not any pure water and the chemical salts are distributed throughout the adsorbed water.

2. Consider the chemical portion of the adsorbed water to be a 100% chemical solution. This is the preferred method.

The mass of the chemical portion can be derived from resin capacity, assumptions on the chemical type, equilibrium chemistry, or general analogy to other chemical solutions. However, the contribution of the chemical solution to the overall particle heat capacity is typically less than 1%. This is realistic since the heat capacity of water is 3 times the chemical heat capacity, and the water molar fraction is over 40 times the chemical molar fraction. Therefore, whichever method is used to determine the chemical mass, it is not significant to the final composite heat capacity value.

Once the heat capacity of the resin is determined, all of the factors needed to find the particle's heat content available for water condensation at the burial temperature are known:

the particle heat capacity
the particle volume in the process/disposal container
the density of the particles
the bulk temperature of the particles
the ultimate burial storage temperature.

With the above factors, the heat content applicable to evaporating adsorbed water and condensing at the buried container walls is determined from Equation 10. The ambient temperature of the particles, $T_\infty$, is typically, the burial temperature of 55° F. The heat content divided by the water heat of vaporization, or latent heat, gives the number of pounds of adsorbed water that could condense in the process/disposal container as the particles cool from their original temperature to the burial temperature. From here, determining the final relative humidity drying endpoint depends on the existence of water uptake curves for the particular waste form. In the absence of water uptake curves, the required volume of removed water is measured starting when the relative humidity monitor drops below 100% R.H. These alternative methods are described below.

Process Endpoint With Water Uptake Curves

FIG. 20 is an example of water uptake curves. They are simply a plot of the particle water content versus the humidity of the surrounding air for various chemical forms of some specific resin types. The poundage of condensable water, as described above, in the container divided by the total particle weight in the container will give the value to be subtracted from the saturated water uptake value (i.e., the water uptake value on FIG. 20 corresponding to 100% R.H.). Then the corresponding relative humidity at that water uptake value, on the curve corresponding to its chemical form, becomes the process endpoint.

Process Endpoint Without Water Uptake Curves

Many non-ion exchange resin particles (carbons, zeolites, diatamaceous earth, etc.) do not have known published water uptake curves. However, a method less direct than an air relative humidity reading is available. Since the volume of water to be removed is known, as described above, that volume of removed water can be measured as it is removed from the water separator. The problem is determining when to start measuring that volume.

If the measurement is taken too early, the water volume may contain a high level of interstitial water and not enough bound water. The result would be condensation of some adsorbed water prior to the container reaching the equilibrium burial temperature. However, the point at which bound water is being removed is the point that some energy is required to overcome the attraction of the water to the particle. That point is indicated by a drop below 100% relative humidity, and the water measurement can begin at that point. When enough waste temperature to water removal volume relationships are established, and verified by cooling a container, then process endpoint curves can be developed and relative humidity can become the measurable endpoint value.

Other Process Endpoints

A slurry bed may not have the prerequisite bed rigidity or drying characteristics as those previously mentioned. One example is powdered ion exchange resins. While the water uptake curves exist, the gas fluid characteristics do not follow fixed bed methods. The powdered material cracks as it drys and allows preferential airflow through the slurry bed. The endpoint for such a system would be the same as for particles without water uptake curves. The exiting water volume would be measured beginning at a drop from 100% relative humidity. However, a historically based endpoint curve probably could not be developed because of the random nature of the particle cracking.

While the present invention has been described in conjunction with preferred embodiments, one of ordinary skill after reading the foregoing specification will be able to effect various changes, substitutions of equivalents, and other alterations to the methods, devices, and compositions set forth herein. It is therefore intended that the protection granted by Letters Patent be limited only by the definition contained in the appended claims and equivalents thereof.

The embodiments of the invention in which an exclusive property or privilege is claimed are defined as follows:

1. A method of dewatering a slurry containing radioactive particles to a condition for permanent storage, comprising the steps:

(a) removing substantially all interstitial water from the slurry;

(b) contacting the particles with a low humidity gas at a dewatering temperature, the dewatering temperature being greater than a predetermined storage temperature of about 55° F., to dewater the particles by removing at least a volume of adsorbed water from the particles such that at the predetermined storage temperature the particles will be just unsaturated with respect to adsorbed water; and (c) sealing the dewatered particles in a disposable container along with a volume of compressible gas, the extent of unsaturation of the dewatered particles being related to the volume of compressible gas such that any increase in particle volume if the particles become further hydrated at the predetermined storage temperature will not exceed the volume of compressible gas.

2. The method of claim 1, wherein the radioactive particles comprise liquid treatment media.

3. The method of claim 2, wherein the liquid treatment media comprise one or more of the group consisting of bead type ion exchange resins and powdered type ion exchange resins.

4. The method of claim 1, wherein the slurry comprises one or more particles of the group consisting of bead type ion exchange resins, powdered type ion exchange resins, filter aid materials, carbon particles, zeolites, filter sand, diatomaceous earth, anthracite particles, and sludges.

5. The method of claim 1, wherein the slurry comprises particles ranging from about 0.1 to about 1000 microns in diameter.

6. The method of claim 5, wherein the particles have an average diameter greater than about 20 microns.

7. The method of claim 1, wherein the disposable container comprises a particle-filled bottom region and a gas-filled top region.

8. The method of claim 1, wherein the removal of substantially all interstitial water from the slurry in step (a) forms a particle bed, and wherein the low humidity gas in step (b) is caused to pass uniformly through the particle bed.

9. The method of claim 8, wherein step (a) comprises:

(i) removing substantially all free-standing water from the slurry to form a particle bed, and (ii) causing a low humidity gas to pass through the particle bed to remove substantially all interstitial water from the particle bed.

10. The method of claim 9, wherein the free-standing water is pumped from the slurry.

11. The method of claim 8, wherein the disposable container comprises a gas-filled top region and a particle-filled bottom region.

12. The method of claim 11, wherein the disposable container comprises a fluid distributor means selectively disposed within the container bottom region.

13. The method of claim 12, wherein the low humidity gas enters the container top region and passes through the particle bed and into the fluid distributor means before exiting the container.

14. The method of claim 12, wherein the low humidity gas enters the fluid distributor means and passes through the particle bed and into the container top region before exiting the container.

15. The method of claim 11, further comprising the steps:

introducing additional radioactive particles to substantially fill the container top region before sealing the container, the introduced particles being at least unsaturated with respect to adsorbed water at the storage temperature.

16. The method of claim 8, wherein step (a) occurs within a disposable container comprising a gas-filled top region and a particle-filled bottom region.

17. The method of claim 16, wherein step (a) comprises:

(i) removing substantially all free-standing water from the slurry to form a particle bed, (ii) causing a low humidity gas to pass through the particle bed to remove at least some of the remaining interstitial water from the particle bed, (iii) thereafter introducing additional radioactive particles to substantially fill the container top region, the introduced particles being either saturated or unsaturated with respect to adsorbed water at the storage temperature, and (iv) thereafter removing substantially all interstitial water from the particle bed.

18. The method of claim 8, wherein the volume of adsorbed water removed from the particle bed is determined by measuring the relative humidity of the gas after passing through the particle bed.

19. The method of claim 1, wherein step (a) forms a particle bed from the slurry and wherein step (b) further comprises the steps of:

(i) causing the low humidity gas to pass uniformly through the particle bed formed in step (a);

(ii) thereafter separating water from the gas; and (iii) dehumidifying the gas from step (ii) and circulating the dehumidified gas through the particle bed in accordance with steps (i) and (ii).

20. The method of claim 19, wherein the volume of adsorbed water removed from the particle bed is monitored by measuring the water separated in step (ii).

21. The method of claim 19, wherein the volume of adsorbed water removed from the particle bed is monitored by measuring the relative humidity of the gas between steps (i) and (ii).

22. The method of claim 21, wherein step (b) is continued until the relative humidity of the gas after passing through the particle bed correlates with a relative humidity endpoint on a dewatering endpoint curve of FIG. 21.

23. A method of dewatering a slurry containing radioactive particles to a condition for permanent storage, comprising the steps:

(a) removing substantially all interstitial water from the slurry;

(b) contacting the particles with a low humidity gas at a dewatering temperature, the dewatering temperature being greater than a predetermined storage temperature of about 55° F. to dewater the particles by removing a volume of adsorbed water from the particles such that at the predetermined storage temperature the particles will be just unsaturated with respect to adsorbed water; and (c) sealing the dewatered particles in a disposable container.

24. The method of claim 23, wherein the slurry comprises one or more particles of the group consisting of bead-type ion exchange resins, powdered-type ion exchange resins, filter aid materials, carbon particles, zeolites, filter sand, diatomaceous earth, anthracite particles, and sludges.

25. The method of claim 23, wherein step (a) forms a particle bed from the slurry and the low humidity gas in step (b) is caused to pass uniformly through the bed of particles from, step (a).

26. The method of claim 25, wherein step (a) comprises:

(i) removing substantially all free-standing water from the slurry to form a particle bed; and (ii) causing a low humidity gas to pass through the particle bed to remove substantially all interstitial water from the particle bed.

27. The method of claim 25, wherein step (a) occurs within a disposable container comprising a gas-filled top region and a particle-filled bottom region.

28. The method of claim 27, further comprising the step of:

introducing additional radioactive particles to substantially fill the container top region before sealing the container, the introduced particles being at least unsaturated with respect to adsorbed water at the storage temperature.

29. The method of claim 27, wherein step (a) comprises:

(i) removing substantially all free-standing water from the slurry to form a particle bed;

(ii) causing a low humidity gas to pass through the particle bed to remove at least some of the remaining interstitial water from the particle bed;

(iii) thereafter introducing additional radioactive particles to substantially fill the container top region, the introduced particles being either saturated or unsaturated with respect to adsorbed water at the storage temperature; and (iv) thereafter removing substantially all interstitial water from the particle bed.

30. The method of claim 23, wherein step (a) forms a particle bed from the slurry and wherein step (b) further comprises:

(i) causing the low humidity gas to pass uniformly through the particle bed formed in step (a);

(ii) thereafter separating the water from the gas; and (iii) dehumidifying the gas from step (ii) and circulating the dehumidified gas through the particle bed in accordance with steps (i) and (ii).

31. The method of claim 30, wherein the volume of adsorbed water removed from the particle bed is monitored by measuring the water separated in step (ii).

32. The method of claim 30, wherein the volume of adsorbed water removed from the particle bed is monitored by measuring the relative humidity of the gas between steps (i) and (ii).

33. The method of claim 32, wherein step (b) is continued until the relative humidity of the gas after passing through the particle bed correlates with a relative humidity endpoint on a dewatering endpoint curve of FIG. 21.

34. A method of dewatering a slurry containing radioactive particles to a condition for permanent storage, comprising the steps:

(a) removing substantially all interstitial water from the slurry;

(b) contacting the particles with a low humidity gas at a dewatering temperature, the dewatering temperature being greater than a predetermined storage temperature, to dewater the particles by removing at least a volume of adsorbed water from the particles such that at the predetermined storage temperature the particles will be just unsaturated with respect to adsorbed water;

(c) sealing the dewatered particles in a disposable container along with a volume of compressible gas, the extent of unsaturation of the dewatered particles being related to the volume of compressible gas such that any increase in particle volume if the particles become further hydrated at the predetermined storage temperature will not exceed the volume of compressible gas; and (d) storing the dewatered particles in the disposable container at the predetermined storage temperature.

35. The method of claim 34, wherein the slurry comprises one or more particles of the group consisting of bead-type ion exchange resins, powdered-type ion exchange resins, filter aid materials, carbon particles, zeolites, filter sand, diatomaceous earth, anthracite particles, and sludges.

36. The method of claim 34, wherein step (a) forms a particle bed from the slurry and the low humidity gas in step (b) is caused to pass uniformly through the bed of particles from step (a).

37. The method of claim 36, wherein step (a) comprises:

(i) removing substantially all free-standing water from the slurry to form a particle bed; and (ii) causing a low humidity gas to pass through the particle bed to remove substantially all interstitial water from the particle bed.

38. The method of claim 36, wherein step (a) occurs within a disposable container comprising a gas-filled top region and a particle-filled bottom region.

39. The method of claim 38, further comprising the step of:

introducing additional radioactive particles to substantially fill the container top region before sealing the container, the introduced particles being at least unsaturated with respect to adsorbed water at the storage temperature.

40. The method of claim 38, wherein step (a) comprises:

(i) removing substantially all free-standing water from the slurry to form a particle bed;

(ii) causing a low humidity gas to pass through the particle bed to remove at least some of the remaining interstitial water from the particle bed;

(iii) thereafter introducing additional radioactive particles to substantially fill the container top region, the introduced particles being either saturated or unsaturated with respect to adsorbed water at the storage temperature; and (iv) thereafter removing substantially all interstitial water from the particle bed.

41. The method of claim 34, wherein step (a) forms a particle bed from the slurry and wherein step (b) further comprises:

(i) causing the low humidity gas to pass uniformly through the particle bed formed in step (a);

(ii) thereafter separating water from the gas; and (iii) dehumidifying the gas from step (ii) and circulating the dehumidified gas through the particle bed in accordance with steps (i) and (ii).

42. The method of claim 41, wherein the volume of adsorbed water removed from the particle bed is monitored by measuring the water separated in step (ii).

43. The method of claim 41, wherein the volume of adsorbed water removed from the particle bed is monitored by measuring the relative humidity of the gas between steps (i) and (ii).

44. The method of claim 43, wherein step (b) is continued until the relative humidity of the gas after passing through the particle bed correlates with a relative humidity endpoint on a dewatering endpoint curve of FIG. 21.

* * * * *